US007040566B1

(12) United States Patent
Rodrian et al.

(10) Patent No.: US 7,040,566 B1
(45) Date of Patent: May 9, 2006

(54) DISPENSER WITH MATERIAL-RECOGNITION APPARATUS AND MATERIAL-RECOGNITION METHOD

(75) Inventors: James A. Rodrian, Grafton, WI (US); Lawrence R. Hansen, Green Bay, WI (US); Daniel C. Kananen, New Franken, WI (US); Alan P. Paal, New Franken, WI (US); Robert T. Buczkiewicz, West Bend, WI (US)

(73) Assignee: Alwin Manufacturing Co., Inc., Green Bay, WI (US)

( * ) Notice: Subject to any disclaimer, the term of this patent is extended or adjusted under 35 U.S.C. 154(b) by 93 days.

(21) Appl. No.: 10/408,970

(22) Filed: Apr. 8, 2003

(51) Int. Cl.
*B65H 43/00* (2006.01)

(52) U.S. Cl. ..... 242/563; 242/564.2

(58) Field of Classification Search ..... 242/564, 242/564.1, 564.2, 563; 312/34.22, 34.8; 235/462.01, 462.13, 454, 470
See application file for complete search history.

(56) References Cited

U.S. PATENT DOCUMENTS

| | | | | |
|---|---|---|---|---|
| 4,796,825 | A * | 1/1989 | Hawkins | 242/564 |
| 4,961,088 | A | 10/1990 | Gilliland et al. | |
| 5,452,033 | A | 9/1995 | Balling et al. | |
| 5,481,100 | A | 1/1996 | Terauchi | |
| 5,507,277 | A | 4/1996 | Rubsamen et al. | |
| 5,694,156 | A | 12/1997 | Hoisington et al. | |
| 5,772,291 | A * | 6/1998 | Byrd et al. | 312/34.22 |
| 5,829,434 | A | 11/1998 | Ambrosio et al. | |
| 5,832,972 | A | 11/1998 | Thomas et al. | |
| 5,940,103 | A | 8/1999 | Hetzer et al. | |
| 5,992,698 | A | 11/1999 | Copeland et al. | |
| 5,995,774 | A | 11/1999 | Applegate et al. | |
| 6,105,633 | A | 8/2000 | Pedersen et al. | |
| 6,109,480 | A | 8/2000 | Monsrud et al. | |
| 6,143,257 | A | 11/2000 | Spriggs et al. | |
| 6,158,486 | A | 12/2000 | Olson et al. | |
| 6,170,937 | B1 | 1/2001 | Childers et al. | |
| 6,209,184 | B1 | 4/2001 | Copeland et al. | |
| 6,250,530 | B1 | 6/2001 | LaCount et al. | |

(Continued)

FOREIGN PATENT DOCUMENTS

| | | |
|---|---|---|
| CA | 2328540 | 12/2000 |

(Continued)

*Primary Examiner*—William A. Rivera
(74) *Attorney, Agent, or Firm*—Jansson, Shupe, Munger & Antaramian, Ltd.

(57) ABSTRACT

Dispenser apparatus for dispensing flexible sheet material including material-recognition apparatus permitting the dispenser to recognize sheet material from an authorized source and to be enabled for operation with such material. The dispenser preferably includes standard mechanical components for dispensing sheet material from the dispenser including a housing, structure for supporting a roll of sheet material, drive and tension rollers forming a nip through which the sheet material is displaced as the drive roller rotates and drive apparatus in power-transmission relationship with the drive roller. The material-recognition apparatus includes a sensor mounted in the dispenser housing and in position to scan a code, preferably located on the core on which the sheet material is wound. The sensor generates a code signal corresponding to the code. A control circuit operatively connected to the sensor is adapted to receive the code signal and compare the code represented by said code signal to at least one code in a code database. The dispenser is placed in a dispenser-enabled state capable of dispensing sheet material corresponding to agreement between the codes and a dispenser-disabled state in which the dispenser is disabled when no such code agreement exists.

70 Claims, 33 Drawing Sheets

U.S. PATENT DOCUMENTS 6,324,350 B1 11/2001 Ito et al.
6,325,495 B1 12/2001 Foth
6,363,228 B1 3/2002 Ream
6,406,120 B1 6/2002 Pauschinger
6,411,920 B1 * 6/2002 McConnell et al. ..... 242/564.1
6,446,901 B1 9/2002 Haen et al.
6,460,798 B1 10/2002 Haen et al.
6,684,751 B1 * 2/2004 Kapiloff et al. ..... 242/564
6,695,246 B1 * 2/2004 Elliott et al. ..... 242/564.1

FOREIGN PATENT DOCUMENTS

JP 5-290227 * 5/1993
JP 05-290227 11/1993

* cited by examiner

FIG. 18
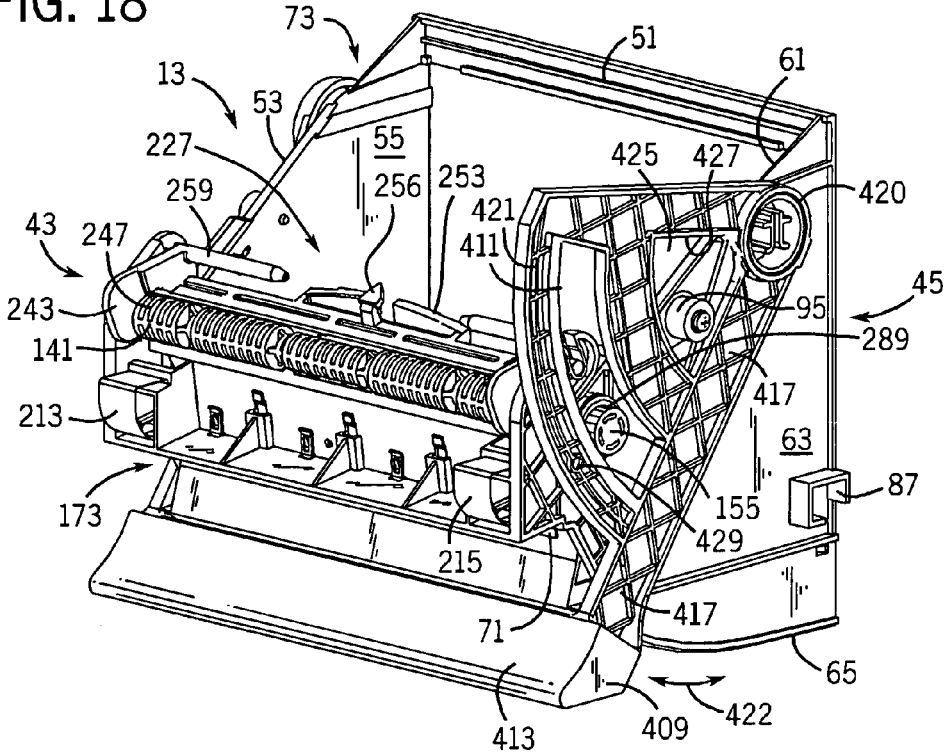
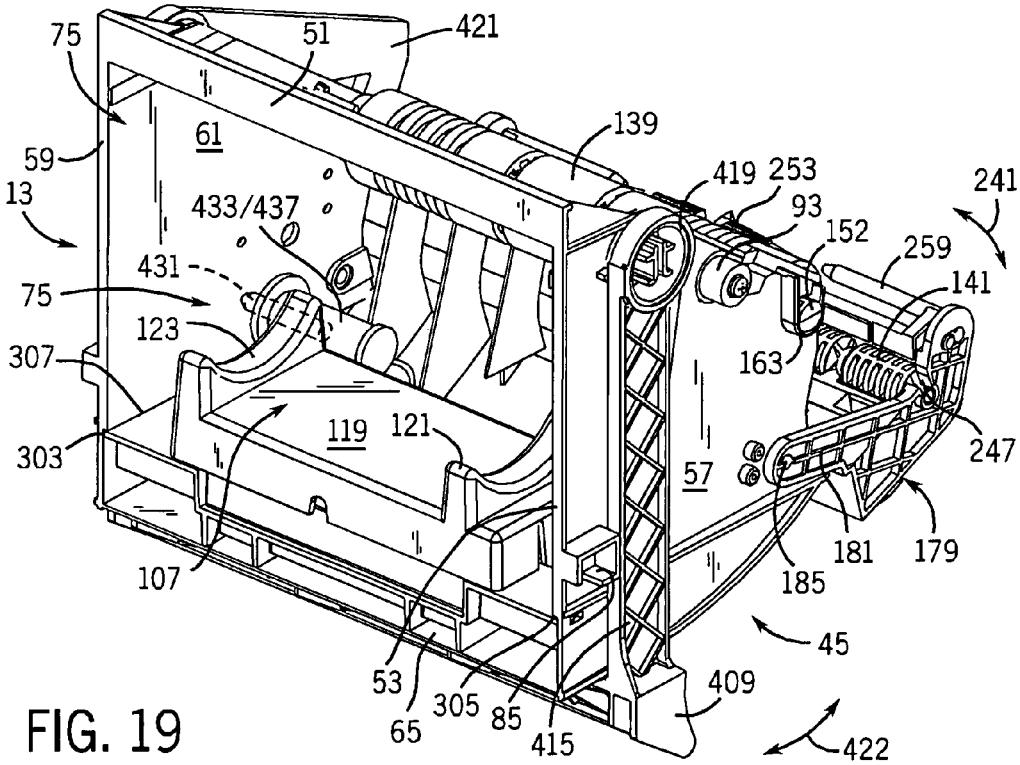
FIG. 19

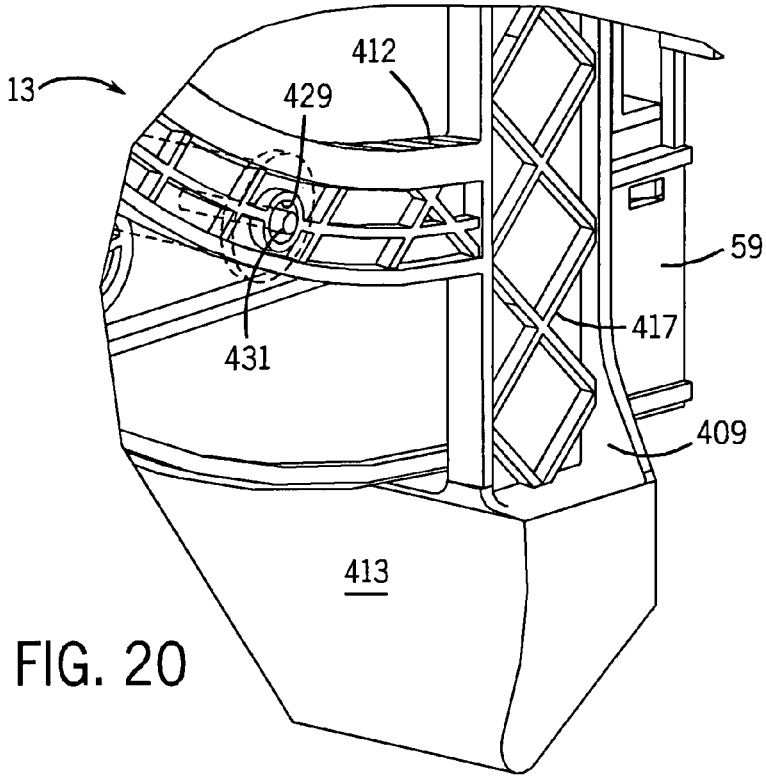
FIG. 20
FIG. 21
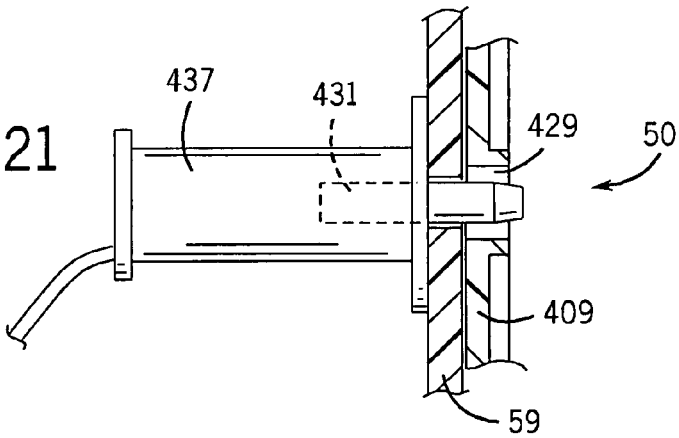
FIG. 22
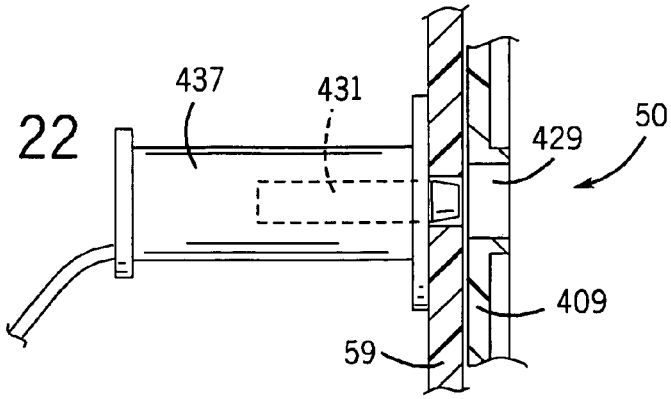

1
25
19
41
125
109
133
10
527
137
1005
75
1001
256
227
251
250
253
141
289
17
241
245
1001
155
283
139
287
279
263
157
257
276
107
39
1005
123
275
281
71
183
69
119
47
331
333
311
271
309
65
273
309
312
539
335
357
49
187
67
1001

DISPENSER WITH MATERIAL-RECOGNITION APPARATUS AND MATERIAL-RECOGNITION METHOD

BACKGROUND OF THE INVENTION

1. Field of the Invention

This invention is related generally to dispenser apparatus and, more particularly, to apparatus for dispensing flexible sheet material including apparatus for recognition of the sheet material to be dispensed.

2. Description of Related Art

Dispenser apparatus for dispensing flexible sheet material, such as paper towel and the like, are well known in the art. Such dispensers typically discharge sheet material provided in the form of a sheet material roll. The sheet material roll comprises a sheet material web wound about a core. The core is typically in the form of a cylindrically-shaped hollow core made of cardboard, plastic or a like material. The core typically has an inner surface and open ends provided to mount the sheet material roll within the dispenser. The sheet material roll may be mounted within the dispenser, for example, by means of a yolk with roll holders or mandrels adapted for insertion into the open ends of the core.

The sheet material is dispensed in any number of ways including by actuation of the dispenser with a proximity detector, by manually pushing a button actuating the dispenser, by manipulating a lever or by manually grasping and pulling the sheet material tail extending from the dispenser.

Within the dispenser, the web of sheet material is typically drawn from its storage location and through a nip formed between drive and tension rollers. The sheet material is then directed out of the dispenser. The drive roller may be powered by many different means including by an electric motor in power-transmission relationship with the drive roller, or by a manually-operated apparatus such as a lever or push bar in power-transmission relationship with the drive roller or still further by frictional engagement between the drive roller and sheet material caused when the sheet material is grasped and pulled by the user.

An important issue affecting these types of dispensers involves the need to ensure that the dispenser operates reliably and without the need for constant service by an attendant. The dispenser must not only operate reliably, but it must do so under rigorous and demanding conditions. For instance, the dispenser must withstand many thousands of operational cycles and must withstand the often rough treatment imposed by users. Further, the dispenser must withstand the rigors of operation under difficult environmental conditions such as the high-humidity environments typical of athletic locker rooms and public washrooms.

The sheet material selected for use with the dispenser must facilitate reliable operation of the dispenser under these extreme conditions. As an initial consideration, the sheet material itself must be selected for compatibility with the mechanical apparatus of the dispenser. Such mechanical apparatus will vary depending on the structure and operation of the dispenser. The sheet material used with the dispenser must be of sufficient weight so that the material will not prematurely tear when tensile forces are applied to the material during the dispensing process. The sheet material must also be uniform and free of irregularities which could result in premature tearing or buckling of the sheet material. The sheet material must be capable of being dispensed irrespective of the humidity and other environmental conditions to which the dispenser is exposed.

It is apparent, therefore, that dispenser operation can be improved by enabling dispenser operation with sheet material designed for use with such dispenser and selected for use under the environmental conditions in which the dispenser is expected to operate. However, selection of the optimal sheet material can be unduly complicated because there are many commercial sources of sheet material and because seemingly identical types of sheet material may, in fact, not have the properties required for optimal dispenser operation. Dispensers presently available lack any capability to identify sources of sheet material which are designed for use with such dispensers, potentially enabling dispenser operation with sheet material not suited for use with the dispenser and contributing to unreliable operation of the dispenser.

It would be a significant improvement in the art to provide dispenser apparatus for dispensing sheet material which would include apparatus permitting recognition of sheet material suited for use with that dispenser and which would enable operation of the dispenser with such suitable sheet material thereby optimizing efficient operation and use of the dispenser.

SUMMARY OF THE INVENTION

The invention is directed to improved dispenser apparatus for dispensing flexible sheet material in the form of a web. The dispenser of the invention includes apparatus for recognition of the sheet material to be dispensed and the invention includes a method of material recognition. The dispenser and material-recognition apparatus may be adapted for use with sheet material of any suitable form including paper towel, toilet tissue, kraft paper, cotton-based cloth, plastic sheet, films and the like. Advantageously, such material-recognition apparatus is not limited for use with any particular dispenser apparatus and may be adapted to operate with the structure of the particular dispenser of interest. The recognition apparatus enables dispenser operation with sheet material sourced for the dispenser thereby providing the dispenser owner with a degree of control over the sheet material used with the dispenser. Advantageously, this permits the dispenser to be used with sheet material tailored for optimal dispenser operation while minimizing the risk of dispenser failure caused by premature or unwanted tearing, buckling or folding of the sheet material.

The dispenser apparatus for use in practicing the invention may be of any type suitable to dispense the sheet material. Preferred forms of dispenser apparatus will include a dispenser housing enclosing the mechanical components of the dispenser. These components preferably include a sheet material roll support for rotatably supporting a sheet material roll within the housing, drive and tension rollers rotatably mounted with respect to the housing and drive apparatus in power-transmission relationship with the drive roller. The drive apparatus is provided to rotatably power the drive roller such that the sheet material moves through the nip formed between the drive and tension rollers and out of the dispenser into the hand of the user.

In general, the material-recognition apparatus for use with the dispenser comprises a sensor mounted in the housing and a control circuit operatively connected to the sensor.

Preferably, manually-driven dispenser embodiments may include an interlock device operatively connected to the control circuit through which the dispenser is enabled or disabled. A power supply apparatus supplies electrical energy to the sensor, control circuit and interlock device.

The sensor is provided to read a code associated with the roll and to generate a code signal corresponding to the code.

Preferably, the code read by the sensor is a bar code and the code signal is an analog signal corresponding to the elements comprising the bar code. Most preferably, the bar code is located on the inner surface of the cylindrically-shaped, hollow core on which the sheet material is wound. It is also preferred that the roll support comprises a pair of opposed roll holders and that the sensor is mounted on at least one of such roll holders in a position to read the bar code.

Preferred forms of the sensor include an optical source adapted to direct optical energy toward the roll-associated code and an optical detector adapted to receive the optical energy from the roll-associated code and generate the code signal corresponding to the roll-associated code. The optical source most preferably is an infrared-emitting diode and the optical detector is most preferably a phototransistor adjacent the diode.

The control circuit most preferably includes a microcontroller and related components. The highly preferred microcontroller is adapted to receive the code signal from the sensor and compare the code represented by the code signal to at least one code in a code database stored within the microcontroller memory. Agreement between the codes represents recognition of the sheet material as sheet material from an authorized source suitable for use with the dispenser. Preferably, the microcontroller generates a signal or signals resulting in the dispenser being set to a dispenser-enabled state if the codes agree and a dispenser-disabled state if the codes do not agree or if there is no code to be read.

The dispenser-enabled and disabled states may be set in various ways consistent with the invention. For dispensers with motor-driven drive apparatus, it is most highly preferred that the microcontroller either enable or disable the motor. As a result, the motor either is, or is not, responsive to actuation of a user input device, such as an ON/OFF switch or proximity detector.

For dispensers with manually-driven drive apparatus, it is most preferred that the microcontroller affect the drive apparatus. In preferred embodiments, the enabled or disabled state of the drive apparatus may be set through an interlock device comprising an electromechanical component responsive to the microcontroller in combination with a mechanical device which interfaces with the drive apparatus. In highly preferred embodiments of the invention, an interlock device, such as a solenoid, reversible DC motor or the like, may move a floating free-wheel gear between a gear-engagement position enabling the dispenser and a gear-disengagement position disabling the dispenser. The "gear-engagement" position refers to a position in which the free-wheel gear may be moved to a position whereby the drive apparatus may be powered through the free-wheel gear. The "gear-disengagement" position refers to a position in which the free-wheel gear is in a position whereby the drive apparatus cannot be powered through the free-wheel gear, such position corresponding to the dispenser-disabled state.

In other preferred embodiments, such interlock device may, responsive to the microcontroller, move an armature, locking pin or the like, between a position in which the armature, pin or other device interferes with operation of the drive apparatus mechanical components and a further position in which free operation of the drive apparatus is permitted. In certain embodiments, the armature, pin or like device could arrest movement of a user contact member, such as a push bar or lever, the movement of which is required to operate the dispenser. In other embodiments, the armature, pin or like device could interface directly with the drive roller arresting drive roller rotation. If the drive apparatus is enabled, the dispenser is in a state ready to dispense sheet material to a user upon operation of the drive apparatus and, conversely, the dispenser will not dispense sheet material if the dispenser is in the dispenser-disabled state.

The power supply apparatus may be any suitable source of DC power. Batteries are a preferred power source but the power source may also comprise, for example, a step-down transformer hard wired to a building electrical system.

The material-recognition method of the invention enables dispenser operation with sheet material recognized as being from an authorized source. In general, the material recognition method comprises an initial step of loading a roll of sheet material in the dispenser. A code is associated with the roll indicating that the roll is from the authorized source. Most preferably, the code is a bar code. The roll-associated code is sensed and an associated code signal is generated. Preferred forms of the sensing step include the steps of directing optical energy toward the bar code while rotating the roll. Such preferred sensing step is completed by receiving the optical energy from the bar code. The code signal is received by a control circuit operatively connected to the sensor and the code represented by the code signal is compared to at least one code in a code database to determine whether the roll is from the authorized source. Code agreement indicates that the roll is from the authorized source. A dispenser-enabled state is set corresponding to agreement between the codes. A dispenser-disabled state is set when no such agreement exists or when there is no code to be read.

It is preferred that the method include a "CoreCheck" routine. The preferred CoreCheck routine is a polling process repetitively conducted to identify the existence of conditions indicating that a partially or fully depleted sheet material roll (known in the industry as a "stub roll"), has been removed from the dispenser and that a replacement sheet material roll has been loaded in place of the stub roll. Recognition of such roll replacement event is used to initiate the material-recognition steps set forth above. In certain highly preferred forms of the method, the CoreCheck routine may be optically-based; that is the method uses detection of light to determine whether the stub sheet material roll has been removed and a sheet material roll loaded in its place. In other highly preferred forms of the method, the CoreCheck may be based on closing of a cover interlock switch provided to indicate that the dispenser cover has been closed, for example, after loading of the new sheet material roll into the dispenser.

The method most preferably includes further steps resulting in discharge of sheet material from the dispenser subsequent to material recognition. In a form of the method based on a motor-driven dispenser embodiment, the step of setting the dispenser-enabled state allows an electric motor to operate such that a length of sheet material is dispensed when operation of the electric motor is triggered responsive to a user.

In a further form of the method which is based on a manually-driven dispenser embodiment, the method most preferably includes the steps of generating an interlock signal based on agreement between the codes, receiving the interlock signal with an interlock device, setting, through the interlock device, the dispenser-enabled state and dispensing a length of sheet material with the enabled dispenser. In the most highly preferred forms of the method, the step of setting the dispenser-enabled state includes the step of actuating an electromechanical interlock device and moving, through the electromechanical interlock device, a free-wheel gear to the gear-engagement position. As a highly preferred alternative, the step of setting the dispenser-enabled state includes the steps of actuating an electromechanical interlock device and moving, through the electromechanical interlock device, a pin to a pin-disengagement position to enable the dispenser drive apparatus and set the dispenser-enabled state. A length of sheet material is dispensed responsive to operation of the enabled dispenser.

Further details regarding the invention are set forth in the drawings and detailed descriptions which follow.

BRIEF DESCRIPTION OF THE DRAWINGS

The drawings illustrate preferred embodiments which include the above-noted characteristics and features of the invention. The invention will be readily understood from the descriptions and drawings. The drawings are not necessarily to scale, emphasis instead being placed upon illustrating the principles of the invention. In the drawings:

FIG. 18 is a perspective view of the front side of the dispenser frame of the manually-driven dispenser of FIG. 8.

FIG. 19 is perspective view of the rear side of the dispenser frame of FIG. 18. A solenoid-based interlock device with a locking armature is shown.

FIG. 20 is an enlarged partial perspective view of a solenoid-based interlock device with the armature extended through a corresponding opening in the push bar arm thereby arresting movement of the push bar and placing the dispenser in the dispenser-disabled state.

FIG. 21 is an enlarged view of the solenoid-based interlock device of FIG. 20 with the armature extended thereby arresting movement of the push bar.

FIG. 22 is an enlarged view of the solenoid-based interlock device of FIG. 20 with the armature retracted thereby freeing the push bar for movement and placing the dispenser in the dispenser-enabled state.

DETAILED DESCRIPTION OF PREFERRED EMBODIMENTS

Figure 1:
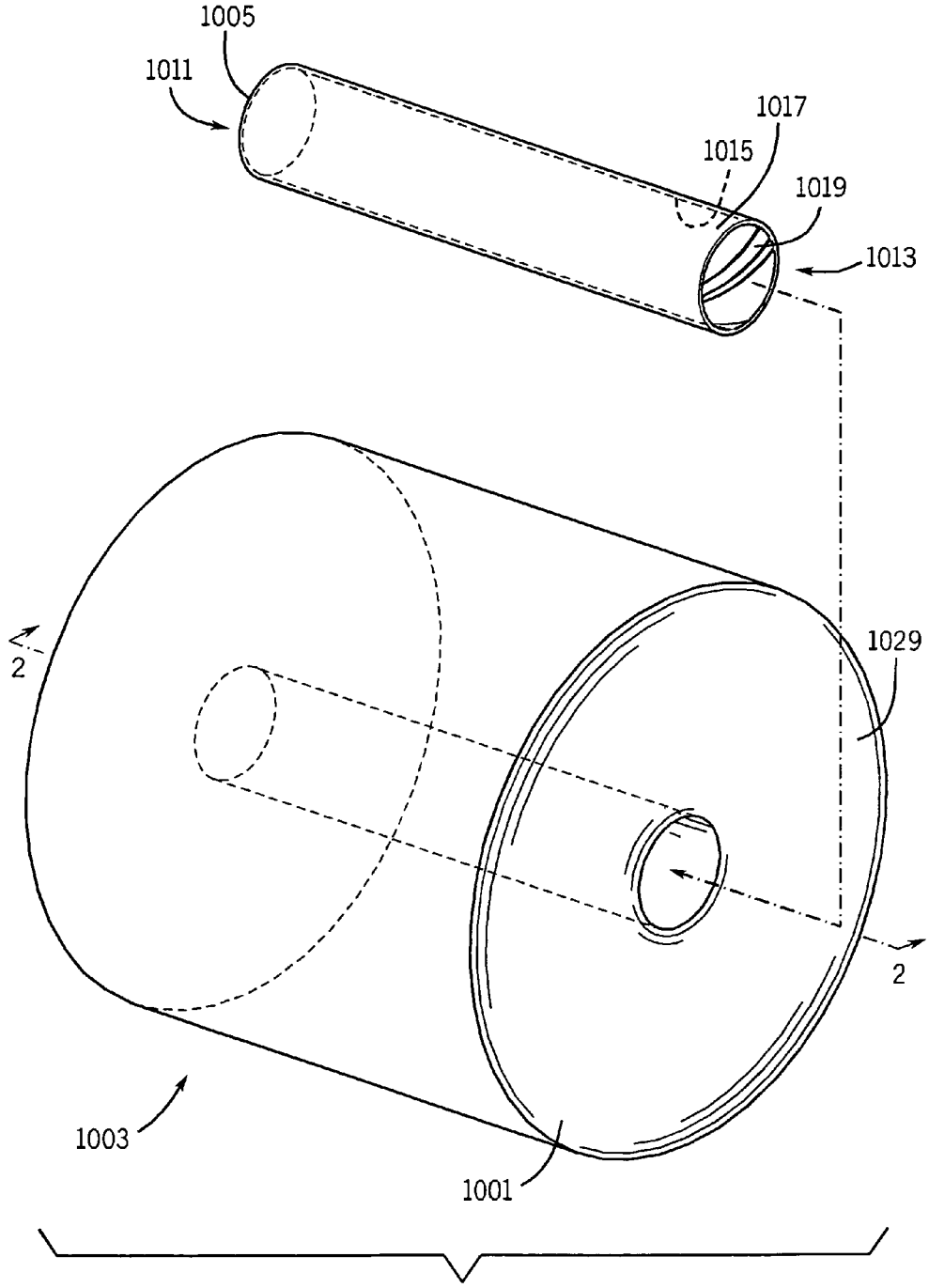
FIG. 1 is a roll of sheet material, including sheet material, a core and machine-readable code suitable for use in accordance with this invention.
Figure 2:
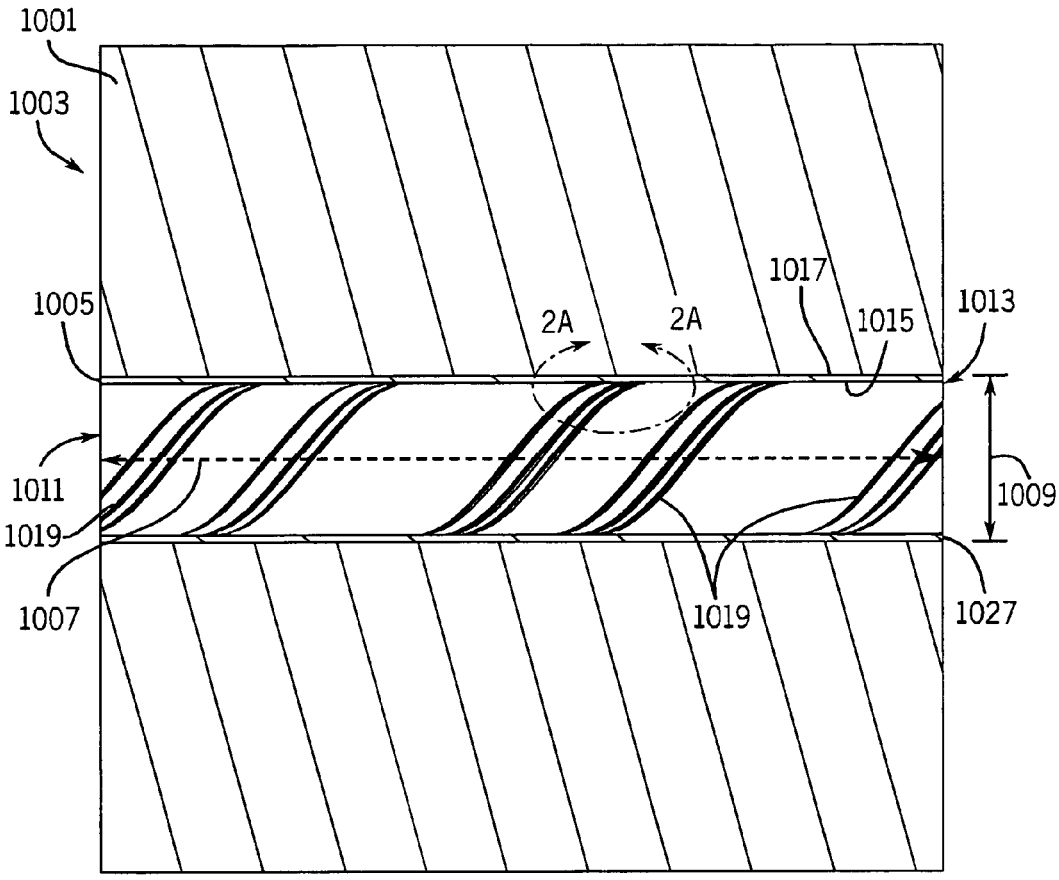
FIG. 2 is a sectional view of the sheet material roll, core and code taken along section line 2—2 of FIG. 1.
Figure 2A:
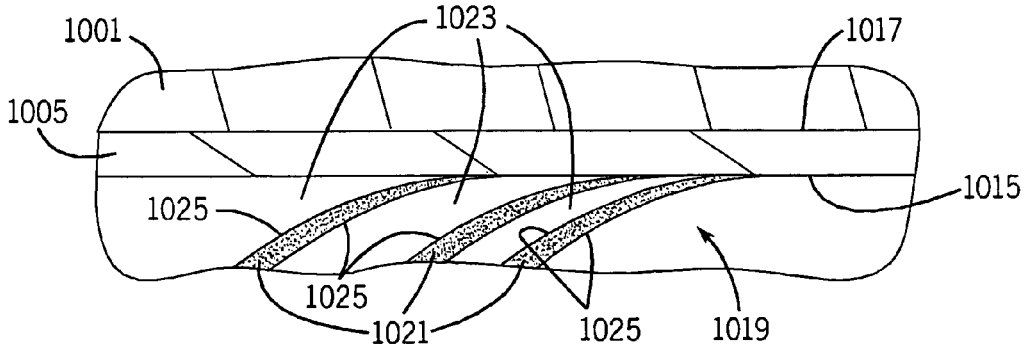
FIG. 2A is an enlarged portion of the sheet material roll, core and code taken along portion 2A—2A of FIG. 2.

Exemplary material-recognition apparatus 10 will now be described in conjunction with an exemplary source of sheet material 1001 and motor-driven 1 and manually-driven 3 dispensers suitable for use in dispensing such sheet material 1001 to a user. As will be apparent, the material-recognition apparatus 10 and dispensers 1, 3 share many identical components and parts which operate in an identical manner. For purposes of brevity and simplicity, identical reference numbers will be used to describe and identify such identical components and parts.

Exemplary Sheet Material

Referring first to FIGS. 1–2A and 14, those figures show an exemplary source of sheet material suitable for dispensing utilizing dispensers 1 and 3. The sheet material 1001 shown is provided in the form of a sheet material roll 1003. The roll 1003 consists of a web of sheet material 1001 wound about a core 1005. As is apparent, the roll 1003 is constructed such that sheet material 1001 is unwound from the roll 1003 as the roll is rotated during dispensing or during material recognition as described herein.

The sheet material 1001 may be of any suitable material-type, grade, weight or length sufficient to be dispensed reliably with the selected dispenser, such as dispensers 1, 3. For instance, and depending on the specific application, sheet material 1001 may consist of paper towel, toilet tissue, kraft paper, cotton-based cloth, plastic sheet, films and the like. The sheet material 1001 is preferably of a type tailored for optimized use with the mechanical components of the specific dispenser to ensure that the sheet material 1001 will be dispensed in a consistent manner and without premature tearing or buckling over the many operational cycles of the dispenser. Further, the sheet material 1001 may be tailored to the operational conditions under which the dispenser is anticipated to be used, for example, in high-humidity environments such as an athletic locker room or in exterior applications such as at the gasoline-pump island of an automotive service station. By enabling the dispenser to recognize the source of the sheet material 1001 and to operate only with such sheet material, the material-recognition apparatus 10 of the invention advantageously permits a greater degree of control over operation of the dispenser such that the dispenser and the sheet material 1001 will be in a condition to operate optimally for the desired application.

The core 1005 has an axial length 1007, a diameter 1009 and a pair of core ends 1011, 1013. Core 1005 is preferably hollow and includes core inner and outer surfaces 1015, 1017. Core 1005 may be manufactured in any suitable manner and of any suitable material. In the example shown in FIGS. 1–2A and 14, core 1005 is a cardboard core common in the industry. Core 1005 consists of a helically-wound lamination of paper sheets forming the cardboard core. Core 1005 may be made of other materials, including plastic and the like.

Located on core inner surface 1015 is a machine-readable code, preferably in the form of a bar code 1019. The bar code 1019 may be of any suitable type adapted for use with the material-recognition apparatus 10 as described below. Referring further to FIGS. 1–2A and 14, a bar code 1019 may consist of a series of varying width bars 1021 and spaces 1023 which are collectively referred to as elements of the bar code 1019. Each bar 1021 and space 1023 has an edge 1025. The bar code 1019 is sensed by a sensor apparatus 138 as set forth in detail herein. The bar code 1019 may be of any suitable format such as an Interleaved 2 of 5 bar code or a Manchester Encoded bar code. The bar code 1019 shown in FIGS. 1–2A and 14 is preferably printed on the paper used to form core 1005 during manufacture of the core 1005. Bar code 1019 has a helical appearance consistent with the helically-wound paper forming the core 1005. This helical arrangement of the bar code 1019 is advantageous because it permits efficient manufacture of the core 1005 with bar code 1019 uniformly positioned along the entire axial length 1007 of core 1005 while using mass production processes commonly used in the cored sheet material industry.

The placement and orientation of bar code 1019 with respect to roll 1003 is limited only insofar as the code 1019 must be in a position capable of being read and recognized by the material-recognition apparatus 10. Therefore, and by way of example only, exemplary bar code 1019 may be positioned: (1) in a helically-disposed pattern as shown in FIGS. 1–2A and 14; (2) concentrically about the center of the core inner surface 1015 along end 1011 or 1013; (3) along core end edge surface 1027; or (4) along an edge surface 1029 of the sheet material roll 1003. The bar code 1019 need not be printed on the core 1005 and could, for example, be provided in the form of an adhesive-backed tag affixed to the core 1005. In the dispenser embodiments 1, 3, the bar code 1019 is sensed by the material-recognition apparatus 10 as the sheet material roll 1003 rotates as fully described herein.

In order to place the sheet material 1001 and material-recognition apparatus 10 in context with dispensers 1 and 3, the components of dispensers 1 and 3 will now be described with particular reference to FIGS. 3–27. Each of dispensers 1 and 3 are of the type useful in dispensing sheet material of the type shown in FIGS. 1–2A and 14, for example a roll 1003 of paper towel.

General Mechanical Dispenser Components

Preferred illustrative general mechanical components of the motor-driven 1 and manually-driven 3 sheet material dispensers will now be described with reference to FIGS. 3–30. Like reference numbers are used to identify components shared by dispensers 1, 3.

Dispensers 1, 3 preferably include housing 11 and frame 13 mounted within an interior portion 15 of housing 11. Housing 11 and frame 13 are identical for dispenser embodiments 1, 3. As will be readily apparent to those of skill in the art, frame 13 may be adapted for use in either of dispenser embodiments 1, 3. The material recognition apparatus 10 is preferably mounted within housing 11. Housing 11 includes a front cover 17, rear wall 19, side walls 21, 23 and top wall 25. Cover 17 may be connected to housing 11 in any suitable manner. Housing 11 and cover 17 may be made of any suitable material. Formed sheet metal and molded plastic are particularly suitable materials for use in manufacturing housing 11 and cover 17 because of their durability and ease of manufacture.

As shown in FIGS. 3–11, cover 17 is attached for pivotal movement to housing 11 by means of axially aligned pins (not shown) in cover 17 configured and arranged to mate with a respective axially aligned openings 27, 29 provided in housing side walls 21, 23. Flanged wall surfaces 31, 33, 35 extend into cover 17 when the cover 17 is in the closed position shown in FIG. 3 to ensure complete closure of the dispenser 1, 3. A lock mechanism 37 may be provided in cover 17 to prevent unauthorized removal of cover 17. Cover 17 is opened, for example, to load a sheet material roll 1003 into the dispenser or to service the dispenser 1, 3.

The motor-driven and manually-driven dispenser embodiments 1, 3 may optionally be configured to dispense first from one sheet material roll 39 and, upon predetermined depletion of roll 39, from a full sheet material roll 41. This process is referred to as a material "transfer event" and is described fully herein, particularly in connection with FIGS. 29–30. Sheet material rolls 39, 41 are identical to each other and to sheet material roll 1003 in all respects including the form of a bar code 1019 disposed along the core inner surface 1015 as shown and described in connection with FIGS. 1–2A and 14. The partially depleted sheet material roll (e.g., roll 39) is referred to herein as a "stub" roll while the sheet material roll 41 is referred to herein as a "full" roll because such roll is unused and in a condition ready to be dispensed. It should be noted that the material-recognition apparatus 10 may be used with sheet material dispensers which dispense from any number of sources of sheet material 1001, including dispensers which dispense solely from a single source of sheet material.

Frame 13 and the principal mechanical components of exemplary dispensers 1, 3 are shown in FIGS. 4–7 and 10–14 in which cover 17 is removed from dispenser 1, 3 and in FIGS. 15–19 in which frame 13 is apart from housing 11. Frame 13 is preferably positioned within a portion of housing interior 15 as shown in FIGS. 4–11. Frame 13 is provided to support the major mechanical and electrical components of dispensers 1, 3 including the discharge apparatus 43, drive apparatus 45, power supply apparatus 47, control circuit 49 and interlock device 50. Frame 13 is made of a material sufficiently sturdy to resist the forces applied by the moving parts mounted thereon. Molded plastic is a highly preferred material for use in manufacture of frame 13.

Frame 13 includes a rear support member 51 (preferred frame 13 does not include a full rear wall), a first sidewall 53 having sidewall inner 55 and outer 57 surfaces, a second sidewall 59 having sidewall inner 61 and outer 63 surfaces and bottom wall 65. Web discharge opening 67 (FIGS. 29–30) is provided between web-guide surface 69 and tear bar 71. Side walls 53 and 59 define frame front opening 73. Housing rear wall 19 and frame walls 53, 59, 65 and 69 define a space 75 in which stub sheet material roll 39 can be positioned for dispensing.

Frame 13 is preferably secured along housing rear wall 19 in any suitable manner such as with brackets 77, 79 provided in housing rear wall 19. Brackets 77, 79 mate with corresponding slots 81, 83 provided in frame rear support member 51. Frame 13 may also be secured in housing 11 by mounting brackets 85, 87 (provided along frame sidewall outer surfaces 57, 63) for mating with corresponding brackets (not shown) provided in housing 11. Frame 13 may further be secured to housing 11 by means of fasteners 89, 91 positioned through housing sidewalls 21, 23, bushings 93, 95 and posts 97, 99. Frame 13 need not be a separate component and could, for example, be provided as an integral part of housing 11.

The exemplary dispensers 1, 3 may be mounted on a vertical wall surface (not shown) where dispensers 1, 3 can be easily accessed by a user. As shown particularly in FIGS. 4, 5 and 9–11, dispensers 1, 3 could be secured to such vertical wall surface by suitable fasteners (not shown) inserted through slotted openings in housing rear wall 19 of which slots 101, 103, 105 are representative. Of course, dispensers 1, 3 could be configured in other manners depending on the intended use of dispensers 1, 3.

FIGS. 4–11, 15–19 and 29–30 illustrate one or both roll support apparatus 107, 109 for the stub 39 and full sheet material rolls 41. Support apparatus 107 includes cradle 119 with arcuate support surfaces 121, 123 against which the stub roll 39 rests. Surfaces 121, 123 are preferably made of a low-friction material permitting the near fully depleted stub roll 39 to freely rotate as sheet material 1001 is withdrawn from roll 39. Cradle 119 and frame 13 are preferably sized so that only a partially-depleted stub roll 39 will fit on cradle 119. In such embodiment, full roll 41 must be mounted for dispensing on support apparatus 109 thereby facilitating recognition of roll 41 as described fully herein. Optionally, sheet material 1001 may be dispensed solely from a sheet material roll (e.g., roll 1003) mounted on support apparatus 109.

Referring further to FIGS. 4–14 and 29–30, there is shown a preferred support apparatus 109 on which the full sheet material roll 41 is preferably mounted. Support apparatus 109 includes yoke 125 attached in a suitable manner to housing rear wall 19, such as by brackets 127, 129 formed around yoke 125. Yoke 125 comprises arms 131, 133 and roll holders 135, 137, mounted on respective arms 131, 133. Sensor apparatus 138 is mounted on roll holder 137 as described further below. Yoke 125 and arms 131, 133 are preferably made of a resilient material, for example 0.156 diameter music wire, so that they may be easily formed and spread apart and so that roll holders 135, 137 may receive respective core ends 1011, 1013 of roll 41 permitting free rotation of roll 41.

A preferred discharge apparatus 43 for feeding sheet material 1001 from respective rolls 39, 41 and out of dispensers 1, 3 will next be described with reference to FIGS. 4–11, 15–19 and 29–30. As is readily apparent, most components of dispensers 1, 3 are identical in structure and operation and identical reference numbers will be used to describe such components. The specific components of discharge apparatus 43 will, of course, vary depending on the particular dispenser selected for use with the material-recognition apparatus 10.

Referring then to FIGS. 4–11, 15–19 and 29–30, the discharge apparatus 43 of dispensers 1, 3 each facilitate discharge of the sheet material 1001 through nip 157 (FIGS. 29–30) as drive roller 139 rotates. Each discharge apparatus 43 comprises drive roller 139, tension roller 141 forming nip 157 therebetween and the related components as hereinafter described and as shown.

Figure 17:
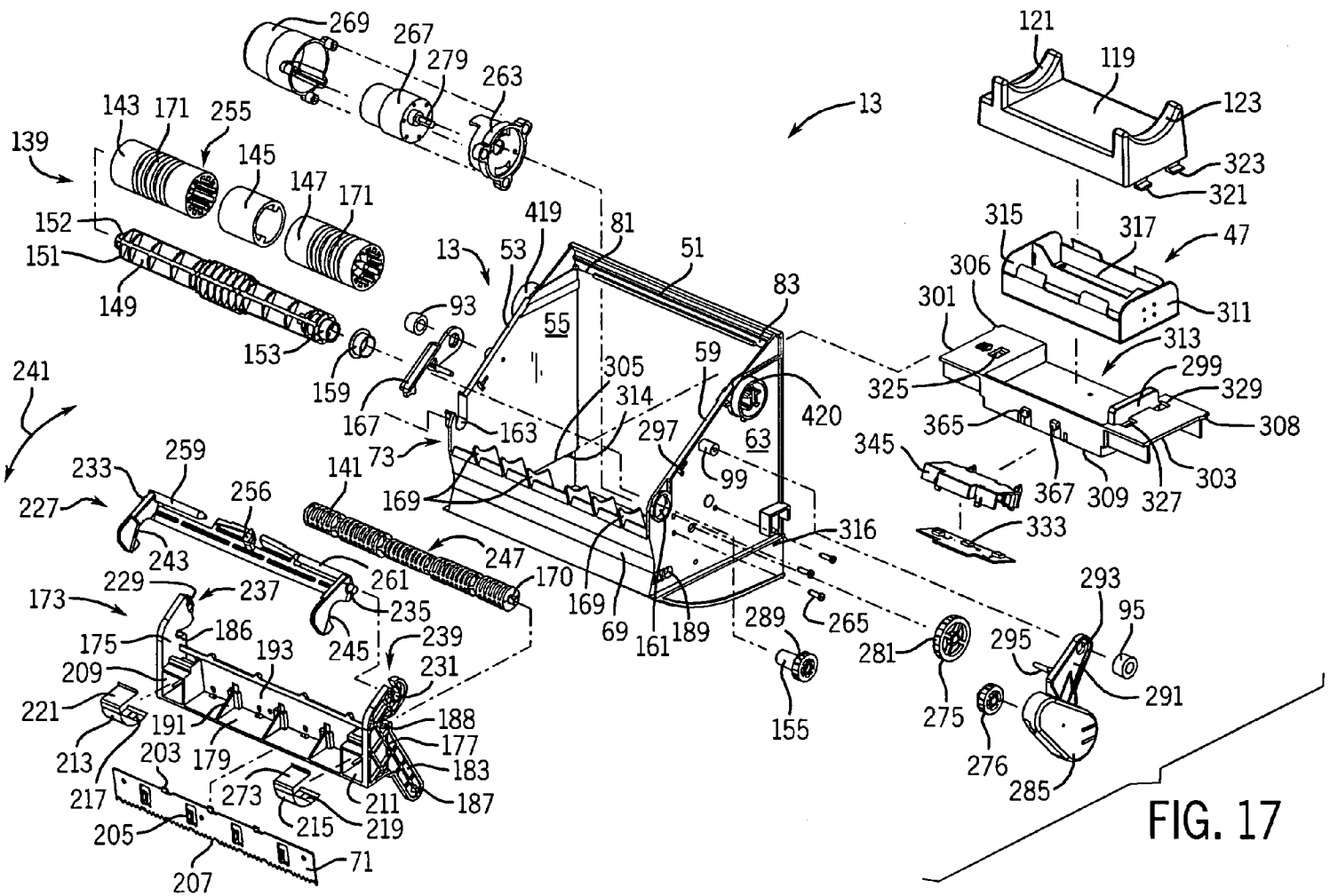
FIG. 17 is an exploded perspective view of the frame of FIG. 15 and certain preferred mechanical components mounted with respect to the frame.

As best seen in FIG. 17, in each of dispensers 1, 3, drive roller 139 is rotatably mounted on frame 13 and includes a plurality of longitudinally spaced apart drive roller segments 143, 145, 147 on a shaft 149. Drive roller 139 includes ends 151, 153 and drive gear 155 rigidly connected to end 153. Drive gear 155 is a component of the drive apparatus 45 which rotates drive roller 139 as described in more detail below. Segments 143–147 rotate with shaft 149 and are preferably made of a high-friction material such as rubber, sand paper or the like provided for the purpose of engaging and feeding sheet material 1001 through a nip 157 between drive and tension rollers 139, 141 and out of the dispenser 1, 3 through discharge opening 67.

Referring further to FIG. 17, for both dispensers 1, 3, shaft end 153 is inserted in bearing (for example, a nylon bearing) 159 which is seated in opening 161 in frame side wall 59.

Stub shaft 152 at shaft end 151 is rotatably seated on bearing surface 163 in frame first side wall 53 and is held in place by arm 167 mounted on post 97.

As is well shown in FIG. 17, dispensers 1, 3 include a plurality of teeth 169 which extend from guide surface 69 into corresponding annular grooves 171 around the circumference of drive roller arcuate surface 257. The action of teeth 169 in grooves 171 serves to separate any adhered sheet material 1001 from the drive roller 139 and to direct that material through the discharge opening 67.

The tension roller 141 is mounted for free rotation on a roller frame 173 which is identical for dispenser embodiments 1, 3 and is best shown in FIG. 17. Roller frame 173 includes spaced apart side wall members 175, 177 interconnected by a bottom plate 179. Roller frame 173 is provided with arm extensions 181, 183 having axially-oriented inwardly facing posts 185, 187 which extend through coaxial pivot mounting apertures in frame sidewalls 53, 59, one of which 189 is shown in FIG. 17 (the other identical aperture is hidden behind guide surface 69) pivotably mounting roller frame 173 to frame 13. Reinforcement members, such as member 191, extend from the bottom plate 173 to an upstanding wall 193. Bearing surfaces 186, 188 are located at the top of the side walls 175, 177 to receive respective stub shafts 168, 170 of tension roller 141 as described in detail below.

Tear bar 71 is either mounted to, or is integral with, the bottom of the roller frame 173. The tear bar 71 may be provided with tabs 203 and clips 205 for attachment to the bottom of the roller frame 173 if the tear bar 71 is not molded as part of the roller frame 173. A serrated edge 207 is at the bottom of tear bar 71 for cutting and separating the sheet material 1001 into discrete sheets.

Roller frame 173 further includes spring mounts 209, 211 at both sides of roller frame 173. Leaf springs 213, 215 are secured on mounts 209, 211 facing forward. Leaf spring bottom spring legs 217, 219 are mounted in a fixed-position relationship with respective mounts 209, 211 with upper spring legs 221, 223 being mounted for forward and rearward movement. Cover 17, when in the closed position of FIG. 3, urges springs 213, 215 and roller assembly 173 rearwardly thereby urging tension roller 141 firmly against drive roller 139 forming nip 157.

Dispenser embodiments 1, 3 may optionally include a transfer mechanism 227 mounted on bearing surfaces 229, 231 of the roller frame 173. Transfer mechanism 227 is identical in structure and operation for dispensers 1, 3 and is well shown, particularly in FIG. 17. Transfer mechanism 227 is provided to automatically feed the full roll 41 sheet material 1001 into nip 157 upon exhaustion of the stub roll 39 sheet material 1001 thereby permitting the sheet material 1001 from roll 41 to be dispensed. The transfer mechanism 227 is provided with a stub shaft 233 at one end in bearing surface 229 and a stub shaft 235 at the other end in bearing surface 231. Each bearing surface 229, 231 is located at the base of a vertically-extending elongate slotted opening 237, 239. Each stub shaft 233, 235 is loosely supported in slots 237, 239. This arrangement permits transfer mechanism 227 to move in a forward and rearward pivoting manner in the directions of dual-headed arrow 241 and to translate up and down along slots 237, 239, both types of movement being provided to facilitate transfer of sheet material 1001 from full roll 41 into nip 157 after depletion of sheet material 1001 from roll 39 as described below. Pivoting movement in a direction away from drive roller 139 is limited by hooks 243, 245 at opposite ends of transfer mechanism 227. Hooks 243, 245 are shaped to fit around tension roller 141 and to correspond to the arcuate surface 247 of tension roller 141.

Transfer mechanism 227 includes a drive roller contact surface 250, an arcuate portion 251 with outwardly extending teeth 253 which are moved against drive roller arcuate surface 257 during a transfer event as described below. A catch 256 is provided to pierce and hold the full roll 41 sheet material 1001 prior to transfer of the sheet material 1001 to the nip 157. Opposed, inwardly facing coaxial pins 259, 261 are mounted on respective ends of mechanism 227 also to hold the full roll 41 sheet material 1001 prior to transfer to the nip 157. Operation of transfer mechanism 227 will be described in more detail below.

The drive and tension rollers 139, 141, roller frame 173, transfer mechanism 227 and related components may be made of any suitable material. Molded plastic is a particularly useful material because of its durability and ease of manufacture.

Drive Apparatus

The preferred drive apparatus 45 for motor-driven dispenser 1 will now be described with reference to FIGS. 4–7 and 15–17. The drive apparatus 45 for motor-driven dispenser 1 includes a motor 267 which powers drive roller 139 through a gear train comprising input gear 275, intermediate gear 276, and drive gear 155.

Figure 29:
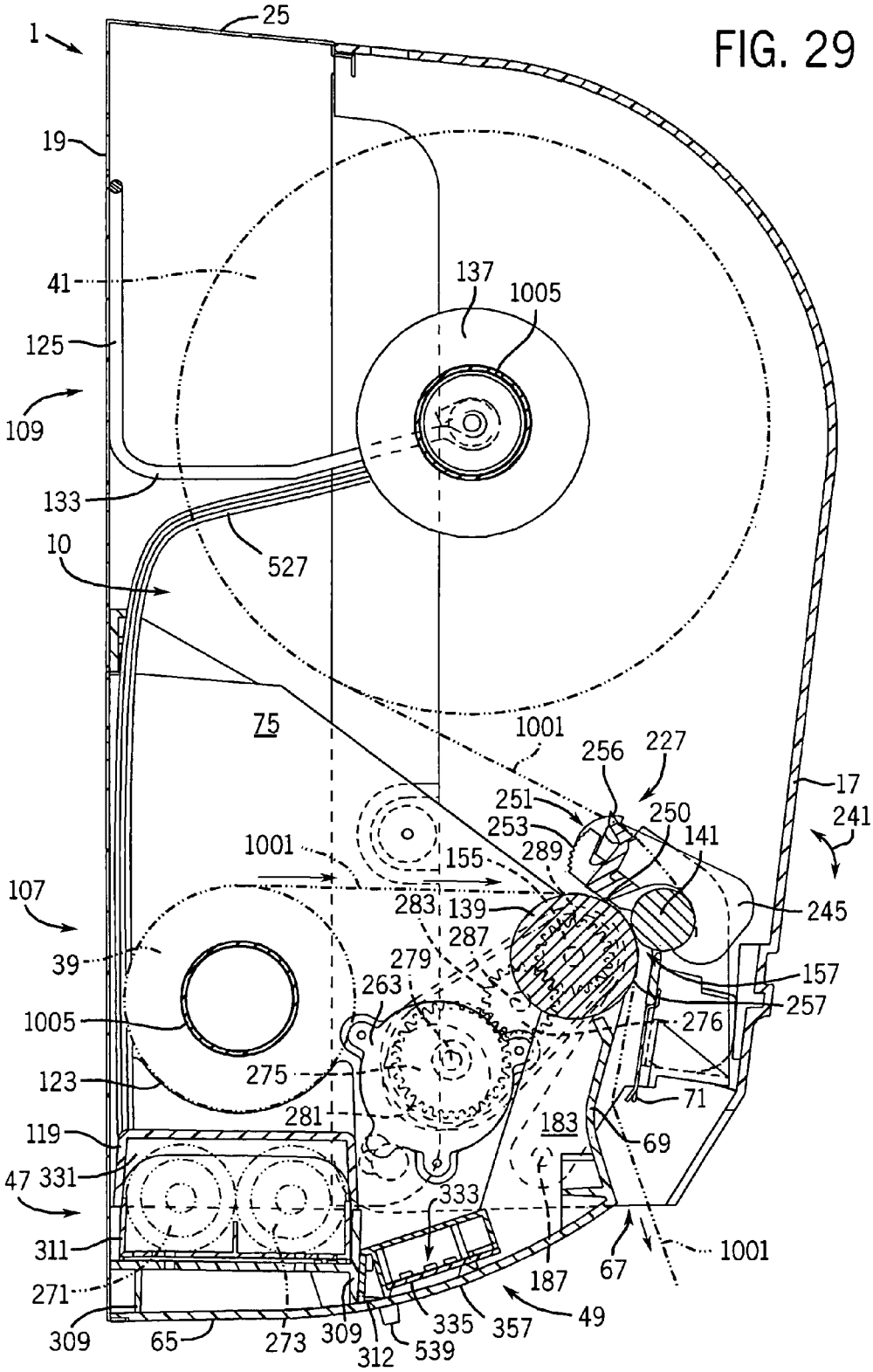
FIG. 29 is a sectional view of the exemplary motor-driven dispenser of FIG. 3 taken along section 29—29 of FIG. 3 provided to illustrate an optional transfer mechanism and material transfer event. Certain hidden parts are shown in dashed lines. Sheet material is being dispensed from the partially-depleted stub sheet material roll while the full roll is loaded on the mechanism awaiting the transfer event.
Figure 30:
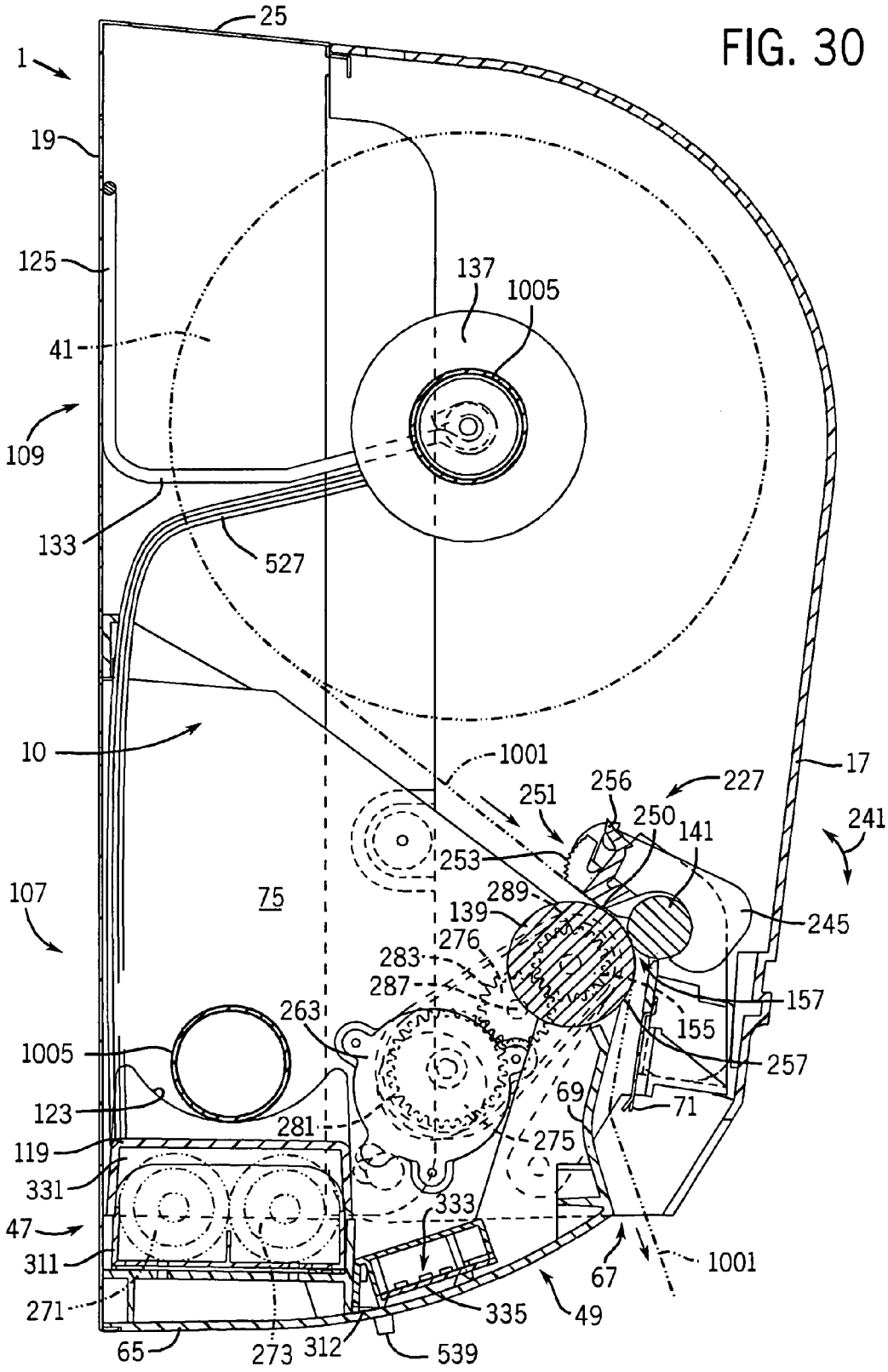
FIG. 30 is a further sectional view of the exemplary motor-driven dispenser taken along section 29—29 of FIG. 3 provided to illustrate the dispenser state subsequent to the optional sheet material transfer event. The stub sheet material roll is depleted and sheet material is being dispensed from the full sheet material roll following operation of the transfer mechanism.

A geared DC motor 267 is secured to the inside surface 61 of frame sidewall 59 by attachment to motor mount 263. Motor mount 263 is mounted to the frame side wall 59 by fasteners of which screw 265 is exemplary. A suitable geared DC motor is the model 25150-50 motor available from Komocon Co. Ltd. of Seoul, Korea. Motor 267 is enclosed by motor housing 269 mounted over motor 267 to mount 263. Motor 267 is preferably powered by a power supply apparatus 47 consisting of four series-connected 1.5 volt D-Cell batteries, two of which 271, 273 are shown in FIGS. 29 and 30. Optionally, motor 267 may be powered by a power supply apparatus 47 consisting of direct current from a low-voltage transformer (not shown). Motor 267 drives a power-transmission assembly consisting of input gear 275 intermediate gear 276, and drive gear 155. Input gear 275 is mounted on motor shaft 279. A plurality of input gear teeth 281 mesh with plural teeth 283 of intermediate gear 276 which is rotatably secured to housing 285 by a shaft 287 extending from housing 285. Intermediate gear teeth 283 in turn mesh with plural drive gear teeth 289 to rotate drive gear 155 and drive roller 139.

Housing 285 covers gears 155, 275 and 276 and is mounted against side wall outer surface 63 by arm 291 having an opening 293 fitted over post 99. Bushing 95 secured between walls 23 and 59 by fastener 91 urges arm 291 against side wall outer surface 63 holding housing 285 in place. Further support for housing 285 is provided by pin 295 inserted through mating opening 297 in side wall 59.

The motor 267 of drive apparatus 45 is controlled by control circuit 49 which includes microcontroller 403 acting through solid-state field effect transistor 489 as described in full detail below. Consequently, control circuit 49 sets the dispenser in a dispenser-enabled or dispenser-disabled state.

The preferred drive apparatus 45 for manually-driven dispenser 3 will now be described with reference to FIGS. 8–11 and 18–19. The drive apparatus 45 for manually-driven dispenser includes a contact member in the form of a push bar 409 or the like which powers drive roller 139 through a gear train comprising input gear 411, shown as a quadrant gear or rack, and enmeshed drive gear 155. More specifically, the push bar 409 of drive apparatus 45 extends across the bottom of housing 11 and includes a concave surface 413 against which the user pushes. Push bar 409 is connected to arms 415, 417 at opposite ends of the push bar 409. Arm 415 is pivotably connected to the frame side wall 53 and arm 417 is pivotably connected to the frame sidewall 59. As seen in FIGS. 18–19, the arms 415, 417 are mounted on bearings 419, 420 which mount push bar 409 to the frame 13. (FIG. 17 shows bearings 419, 420 on frame 13 adapted for use with motor-driven dispenser 1.) As a result of this mounting structure, push bar 409 is pivotably mounted for back and forth movement in the directions shown by dual-headed arrow 422.

Referring to FIGS. 18–20, arm 417 includes an arcuate segment 421 which carries input gear 411 with a plurality of gear teeth 412 spaced along surface 423 and adapted to be enmeshed with drive gear 155 teeth 289 to power drive roller 139 when the push bar 409 is pushed rearward by a user during a dispensing cycle. A second open portion 425 in segment 421 has a stop wall 427 which contacts bushing 99 to limit rearward pivoting movement of the push bar 409 as the push bar 409 is pressed rearward (to the position shown in FIG. 19) by a user. An unshown torsion spring cooperates with the arm 415 in a manner which is well known, to provide resistance to the actuation of the push bar 409 and to bias the push bar 409 into its fully forward rest position illustrated in FIGS. 10–11 and 17.

The enabled or disabled state of manually-driven dispenser 3 is controlled by interlock device 50 which is preferably in the form of an electromechanical actuator. The structure and operation of preferred interlock device 50 embodiments are described in conjunction with FIGS. 20–25 while the electronic circuit for each interlock device 50 embodiment is fully described below in conjunction with the control circuits 49 of FIGS. 31–33.

Referring then to FIGS. 20–22, those figures show an interlock device comprising latching solenoid 437 and armature 431 adapted to co-act with push bar arm arcuate segment 421 to enable or disable the dispenser drive apparatus 45. More specifically, opening 429 is provided in arcuate segment 421 to receive the extendable/retractable pin, shown as armature 431 of latching solenoid 437. A suitable latching solenoid 437 is a model SH2LCO524 permanent magnet solenoid available from Densitron Corporation of Sante Fe Springs, Calif. (www.densitron.com). Solenoid 437 armature 431 is capable of bi-directional movement. As is known, the armature 431 is displaced in one direction by applying current to a first coil (not shown) and is moved in an opposite direction by applying current to a second coil (not shown).

The armature 431 is received in opening 429 when the dispenser cover 17 is opened and the dispenser is set in the disabled state as described below. Opening of dispenser cover 17, for example to load a full roll of sheet material 41 in the dispenser, urges push bar 409 rearward to the position shown in FIGS. 8–9 and 20. A CoreCheck routine detects removal of the core 1005 of the stub roll 39 mounted on roll holders 135, 137 and sets the dispenser-disabled state by applying an interlock signal in the form of current to one of the solenoid 437 coils resulting in extension of armature 431 into opening 429. When armature 431 is in its fully extended position (FIGS. 20–21) and is received in opening 429, armature 431 locks push bar 409 in the position shown in FIGS. 8, 9 and 20 thereby disabling the drive apparatus 45 and dispenser 3 as described in detail below. Armature 41 is retracted to the position shown in FIG. 22 responsive to an interlock signal generated by microcontroller 403 following recognition of the sheet material roll 1003. The interlock signal represents current applied to the second solenoid 437 coil. Retraction of armature 431 frees push bar 409 for movement and for subsequent sheet material dispensing cycles.

In a further embodiment (FIG. 33), a reversible DC micromotor 503 serves as an interlock motor which could be substituted for solenoid 437 and used in an identical manner to displace a pin (not shown), such as armature 431, through a suitable linkage (not shown) into an out of engagement with opening 429 in push bar arcuate segment 421 as shown in FIGS. 20–23. As is known, the motor 503 rotates a shaft (not shown) in a first direction when current is applied to the motor 503 and reversal of current polarity causes motor 503 to rotate shaft in a second direction. The bi-directional rotation of the shaft may be used to displace the pin through the linkage between the positions shown in FIGS. 21 and 22.

FIGS. 23–28 illustrate a further manually-operated drive apparatus 45' embodiment suitable for use in a manually-driven dispenser, such as dispenser 3. Drive apparatus 45' is shown as part of a dispenser sub-assembly removed from a manually-driven dispenser. The profile of a housing 11 is provided around drive apparatus 45' to show the general position of such drive apparatus in the context of a sheet material dispenser, such as dispenser 3. As will be apparent to those of skill in the art, the sub-assembly may be designed to fit within any suitable manual dispenser. For the sake of convenience, an element shown in connection with the embodiment of FIGS. 23–28 may be identified with the same reference number of a like element described in connection with the other dispenser embodiments.

Referring then to FIGS. 23–28, drive apparatus 45' comprises a contact member in the form of lever 439 which powers drive roller 139 through a gear train consisting of input gear 447, free-wheel gear 463 and drive roller gear 155. Rotation of drive roller 139 urges sheet material 1001 from sheet material roll 1003 through nip 157 formed between drive roller 139 and tension roller 141.

Figure 23:
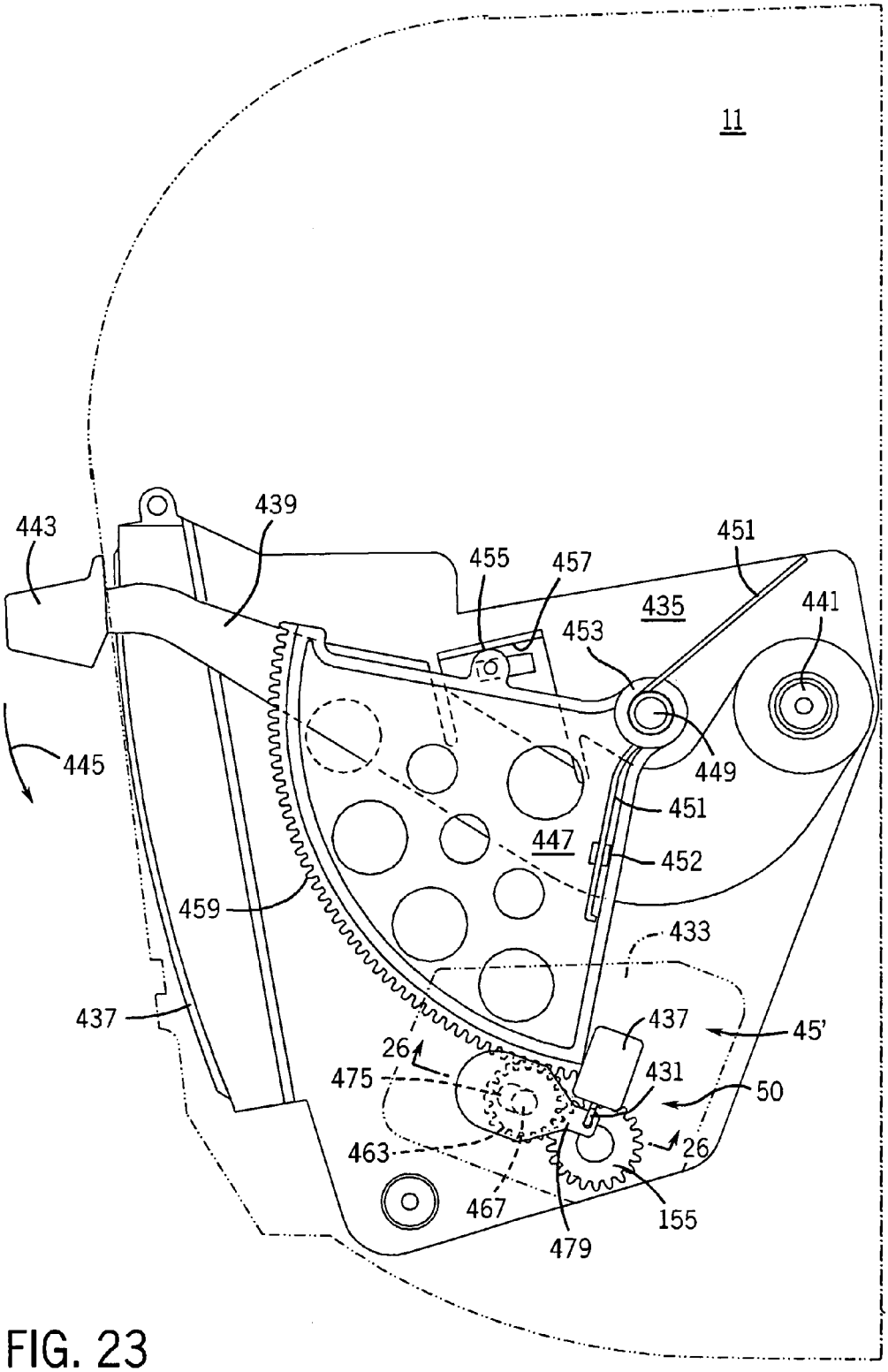
FIG. 23 is partial assembly view of the drive apparatus of an alternative manually-driven dispenser embodiment according to the invention. A solenoid-based interlock device with a free-wheel gear is shown. Certain parts are omitted. Dashed lines are used to indicate the location of hidden parts or the location of full or partially omitted parts.
Figure 27:
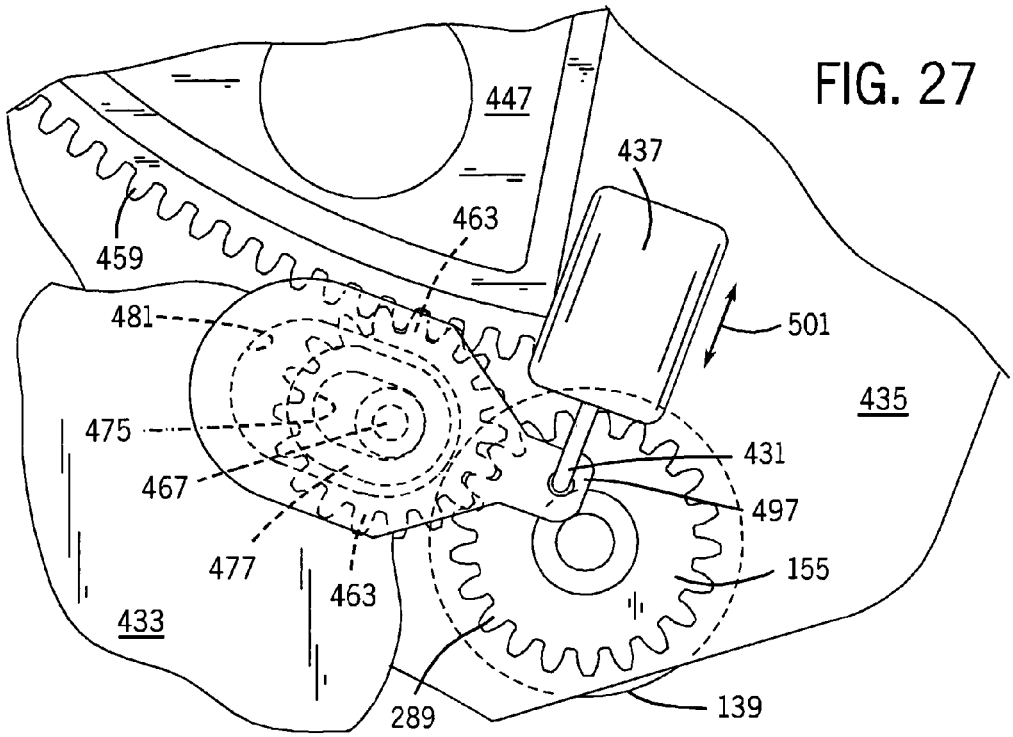
FIG. 27 is an enlarged partial perspective view of the interlock device of FIG. 23 with the free-wheel gear engaged with the input and drive gears thereby placing the dispenser in the dispenser-enabled state. Certain parts are omitted. Dashed lines are used to indicate the location of hidden parts or the location of full or partially omitted parts.
Figure 28:
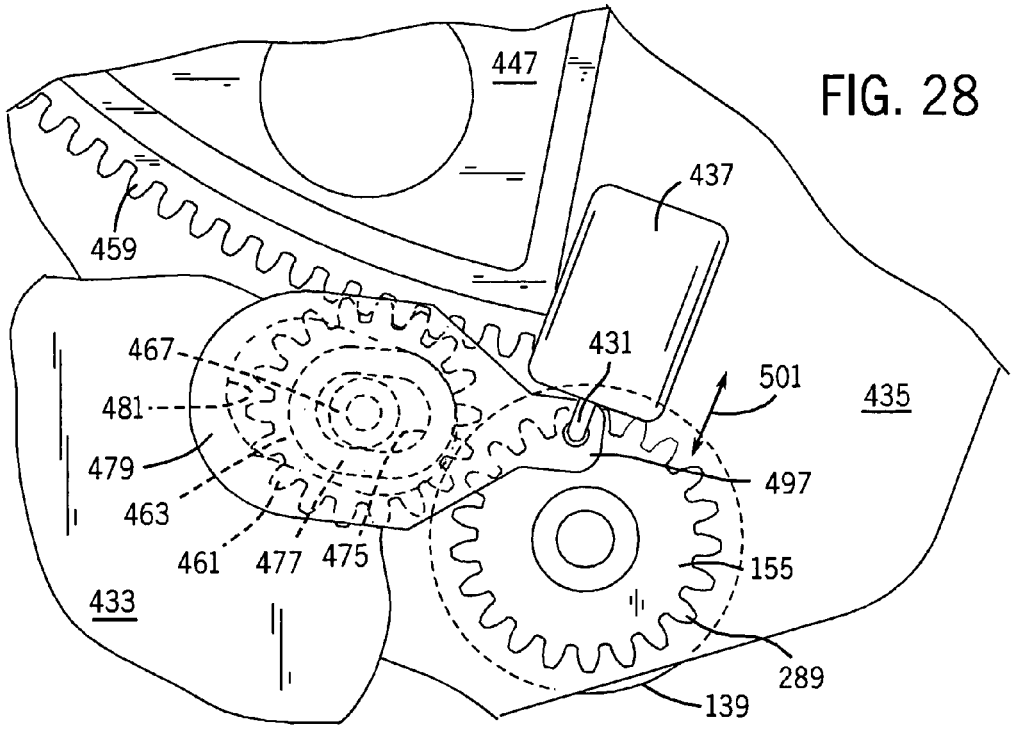
FIG. 28 is a further enlarged partial perspective view of the interlock device of FIG. 23 with the free-wheel gear disengaged from the drive gear thereby placing the dispenser in the dispenser-disabled state. Certain parts are omitted. Dashed lines are used to indicate the location of hidden parts or the location of full or partially omitted parts.

More specifically, the drive apparatus 45' is supported by opposed outer and inner sidewalls 433, 435. (FIGS. 23 and 27–28 show portions of outer wall 433 for context.) wall Inner wall 435 is preferably integral with frame 13 provided to support drive 139 and tension 141 rollers. Outer wall 433 may be part of a unitary cover element 437 secured to inner wall 435 by suitable means, such as with screws (not shown). Cover element 437 may, for example, comprise a unitary molded plastic part.

Lever arm 439 is journaled on shaft 441 between walls 433, 435. As best seen in FIG. 23, lever arm 439 may extend outwardly through a slotted opening (not shown) in cover element 437 outwardly from housing front cover 17 when the subassembly of FIGS. 23–28 is secured within the manually-driven dispenser 3. Handle 443 may then be grasped by a user and pushed down in the direction of arrow 445. Input gear 447 is journaled on shaft 449. Torsion spring 451 supported by gear hub 453 and catch 452 biases input gear raised input gear surface 455 against lever arm flanged surface 457 to bias input gear 447 and lever arm 439 upward (i.e., a direction opposite to arrow 445) to the rest position shown in FIG. 23. Raised input gear surface 455 includes a radius which slides against flanged surface 457 when lever arm 439 is moved in a direction toward and away from arrow 445. Input gear 447 is provided with a plurality of outwardly-oriented teeth 459 positioned to mesh with plural teeth 461 of free-wheel gear 463. Drive gear 155 secured to drive roller 139 is positioned through an opening (not shown) in inner wall 435.

A floating free-wheel gear 463 is provided as part of interlock device 50 to enable or disable the drive apparatus 45'. Free-wheel gear 463 is movable between a gear-engagement position (FIG. 27) in which the lever arm 439 and input gear 447 are in power-transmission relationship with drive gear 155 and drive roller 139 and a gear-disengagement position (FIG. 28) in which the lever arm 439 and input gear 447 are disconnected from drive gear 155 and drive roller 139.

Referring further to FIGS. 23–28, free-wheel gear 463 includes a shaft 467 having shaft first and second ends 469, 471. Shaft first end 469 rides in an elongate slot 473 provided along frame inner wall 435. Shaft second end 471 rides in an elongate slot 475 defined by elongate neck 477 of linkage element 479. Linkage element neck 477 is inserted through outer wall elongate slot 481 defined by neck 483 in outer wall 433. As shown in FIGS. 27 and 28, outer wall slot 481 has an area which is slightly oversized relative to the cross-sectional area of linkage element neck 477. Linkage element 479 slides along outer wall 433 with movement confined by contact between linkage element neck 477 and outer wall slot 481.

Linkage element 479 is urged against outer wall 433 by contact surface 485 of cover 487. Cover 487 is removably mounted to outer wall 433 by hinge 489 and tangs 491, 493 which are inserted into corresponding slots (not shown) in outer wall 433. Contact surface 485 contacts linkage element surface 495 when cover 487 is in the closed position shown in FIG. 24. Contact surface 485 exerts sufficient force against linkage element 479 to hold linkage element 479 against outer wall 433 yet permit sliding movement of linkage element 479 against outer wall 433. Linkage element 479 is preferably made of a low-friction material, such as nylon or acetal, facilitating the confined sliding movement of linkage element against outer wall 433 and contact surface 485.

Linkage element neck 477 and slot 475 and outer wall slot 481 each preferably have an oblong cross-sectional area (i.e., race-track-shaped) as shown in FIGS. 27–28 and inner wall slot 473 preferably has a configuration which permits movement of free-wheel gear 463 between the gear-engagement and disengagement positions. As shown in FIGS. 23–28, linkage element neck 477 defining linkage element slot 475 and outer and inner wall slots 473, 481 are sized and positioned such that shaft 467 is confined in slots 475, 473 with free-wheel gear teeth 461 continuously meshed with input gear teeth 459.

Linkage element end 497 is pivotably linked through coupling 499 to armature 431 of latching solenoid 437 provided as a component of interlock device 50. A Densitron model SH2LCO524 solenoid is a suitable latching solenoid 437. Solenoid 437 is secured to outer wall 433 in any suitable manner. Movement of armature 431 between the extended (FIGS. 23, 27) and retracted (FIG. 28) positions (i.e., the directions of dual headed arrow 501) changes the position and orientation of free-wheel gear 463 and linkage element 479 such that free-wheel gear 449 is moved between the gear-engagement and gear-disengagement positions as now described.

During operation with a recognized full sheet material roll 41, the dispenser is in the dispenser-enabled state. In the dispenser-enabled state, the armature 431 of solenoid 437 is extended to the position shown in FIG. 27. Extension of armature 431 causes linkage element 479 to slide against outer wall 433 and outer wall slot 481 such that linkage element slot 475 is essentially tangent to input gear 447. In the dispenser-enabled state, a user's movement of lever arm 439 down in the direction of arrow 445 causes input gear 447 to urge free-wheel gear 463 fully rearward in slots 473, 475 in the direction of arrow 501 and into engagement with drive gear 155 permitting lever arm 439 to power drive roller 139. During the upstroke of lever arm 439, input gear 447 urges free-wheel gear 463 to slide forward in slots 473, 475 and out of engagement with drive gear 155 permitting the lever arm 439 to return to the rest position without powering drive roller 139. Free-wheel gear 463, in effect, serves as a clutch mechanism. Free-wheel gear 463 engages drive gear 155 on the next lever arm 439 downstroke.

After many dispensing cycles, sheet material 1001 in dispenser 3 is depleted and a new full sheet material roll 41 must be loaded in the dispenser 3 by an attendant. Removal of core 1005 from the dispenser 3 is detected by the material-recognition apparatus 10 during the CoreCheck routine and the dispenser microcontroller 403 places the dispenser 3 in the dispenser-disabled state. An interlock signal in the form of current supplied to one coil of solenoid 437 causes armature 431 to be retracted causing linkage element 479 to slide along outer wall 433 to the position shown in FIG. 28. In such position, linkage element slot 475 is angled with respect to input gear 447. In this orientation of linkage element 479 and free-wheel gear 463, the user's downward movement of lever arm 439 (i.e., the direction of arrow 445) causes input gear 447 to urge free-wheel gear 463 partially rearward in slots 473, 475 in the direction of arrow 501. Free-wheel gear 463 remains meshed with input gear 447 but rotates freely and out of contact with drive gear 155. Lever arm 439 is disconnected from drive roller 155 in this gear-disengagement position. Free-wheel gear 463 cannot move fully rearward and cannot engage drive gear 155 because free-wheel gear 449 is wedged between slot 475 and input gear 447 as a result of the decreasing distance between linkage element slot 475 and input gear 447 toward the end of linkage element slot 475 nearest drive gear 155. Linkage element 479 and gear 463 are moved back to the position shown in FIG. 27 following recognition of the newly-loaded full sheet material roll 41 enabling dispenser operation.

Figure 32:
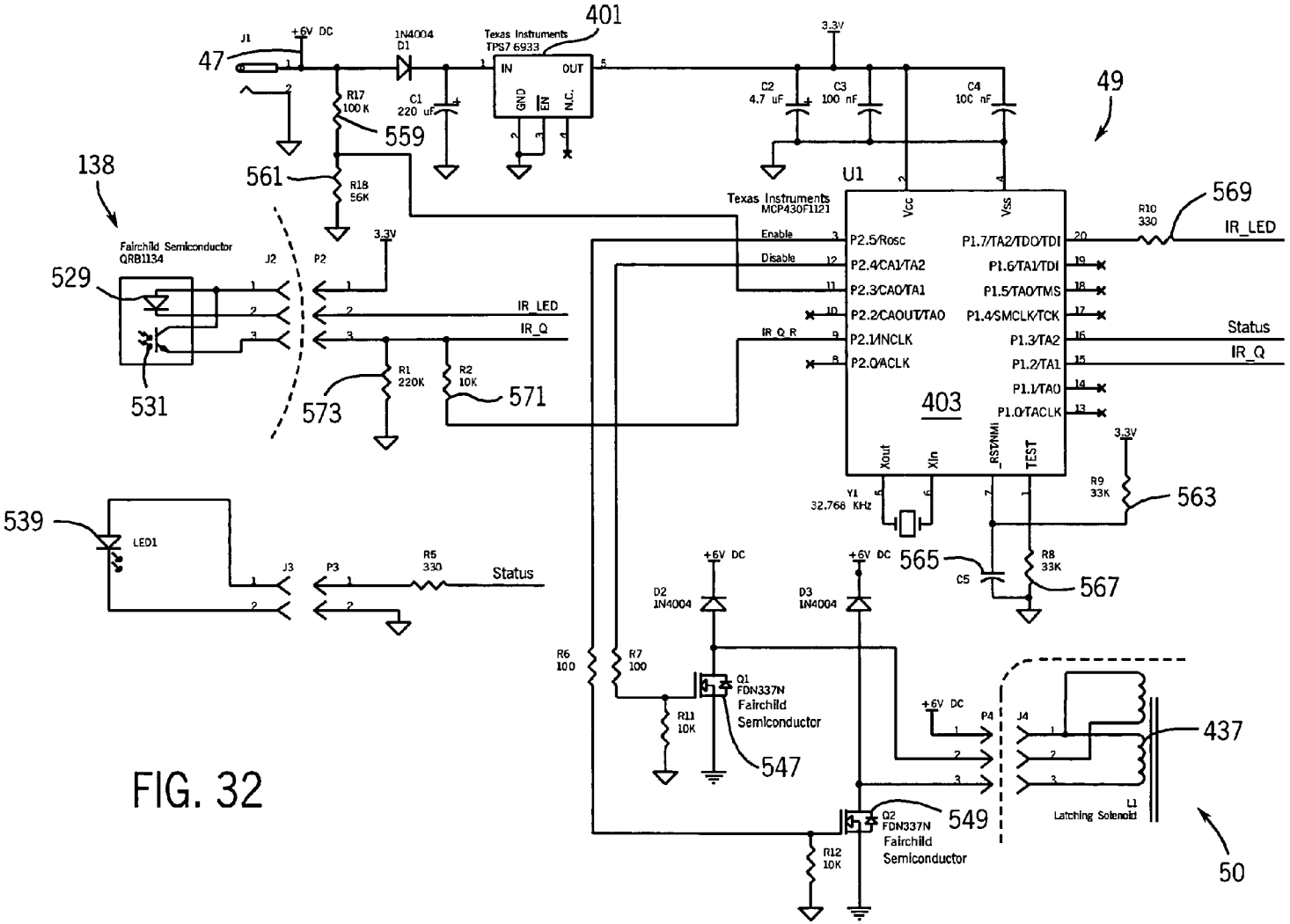
FIG. 32 is a schematic diagram showing preferred electrical components of a material-recognition apparatus including a latching solenoid interlock device suitable for use with the manually-driven dispenser of FIG. 8.

A reversible DC interlock motor 503 may be used in place of solenoid 437 as shown in the schematic of FIG. 32. Interlock motor 503 is connected to free-wheel gear 449 linkage element 455 through a suitable linkage (not shown).

Drive apparatus 45 may be of any suitable type and is not limited to the embodiments disclosed above. For example, a direct drive stepper motor (not shown) could be used in place of motor 267 and gears 275, 276 and 155. By way of further example, drive apparatus 45 may consist of a drive apparatus which is powered by the user manually pulling on the sheet material 1001 "tail" extending from the dispenser housing 11. Such pulling action powers the drive roller 139 as the sheet material 1001 is led from the sheet material roll 1003 on the roll holders 135, 137 and across the drive roller 139 surface 257 and through the nip 157. Such a drive apparatus 45 is disclosed in U.S. Pat. No. 6,446,901 (Haen et al.) the contents of which are incorporated herein by reference. The '901 patent is owned by the owner of the present application. The interlock device 50 for such an embodiment could consist of a solenoid 437 and armature 431 arrangement which stops rotational movement of the drive roller 139 in a manner similar to that shown in FIGS. 20–22.

Power Supply Apparatus

FIGS. 16–17 and 29–33 show a preferred power supply apparatus 47 for supplying electrical energy to sensor apparatus 138, control circuit 49 of dispensers 1 and 3, the motor 267 of dispenser 1 and the interlock device 50 of dispenser 3. The preferred power supply apparatus 47 comprises a 6V battery pack consisting of four D-cell batteries, two of which 271, 273 are shown in FIGS. 29–30. A low-quiescent-current voltage regulator 401 supplies 3.3V to microcontroller 403 (FIGS. 31–33, "U1") at pin 2 and to the related components. A suitable voltage regulator is a Texas Instruments® (TPS76933 voltage regulator available from Texas Instruments, Inc. of Dallas, Tex. (www.ti.com).

It will be readily understood by those of skill in the art that other types of power supply apparatus 47 may be used in conjunction with the invention. Such power supply apparatus 47 could include low-voltage DC power from a step-down transformer and AC-to-DC converter, photovoltaic power or power supplied by other means. Moreover, DC voltage from an external DC source could be combined with a battery power source in which the battery power source serves as a back-up power source.

Referring then to FIGS. 16–17, 19 and 29–30, base 299 is mounted in frame 13 by mechanical engagement of base end edge surfaces 301, 303 with corresponding flanges 305, 307 provided along inner surfaces 55, 61 of respective walls 53, 59 and by engagement of tabs 306, 308 with slots 314, 316 also provided in walls 53, 59. Tabs 310, 312 protruding from frame bottom wall 65 aid in locating base 299 by engagement with base bottom edge 309. Base 299 and frame 13 components are sized to permit base 299 to be secured without fasteners.

Battery box 311 is received in corresponding opening 313 of base 299 and may be held in place therein by any suitable means such as adhesive (not shown) or by fasteners (not shown). Battery box 311 is divided into two adjacent compartments 315, 317 each for receiving two batteries, such as batteries 271, 273, end to end in series connection for a total of four batteries. Positive and negative terminals and conductors (not shown) supply power from the batteries to the dispensers 1, 3.

Cradle 119 is removably attached to base 299 by means of tangs 321, 323 (a third tang is not shown) inserted through corresponding openings 325, 327, 329 in base 299. Cradle 119 includes a hollow interior portion 331 corresponding to the profile of battery box 311. Cradle 119 receives battery box 311 therein when cradle 119 is attached to base 299. Tangs 321, 323 are made of a resilient material permitting them to be urged out of contact with base 299 so that cradle 119 may be removed to access battery box 311, for example to place fresh batteries (i.e., 271, 273) into battery box 311.

Sensor Apparatus

The mechanical structure of an exemplary sensor apparatus 138 for use with dispenser embodiments 1, 3 will be now be described particularly with respect to FIGS. 5, 9, 11, and 12–14. Sensor apparatus 138 is also shown in the schematic diagrams represented by FIGS. 31–33. Sensor apparatus 138 is provided to scan, or sense, bar code 1019 as the code passes within detection range by sensor apparatus 138.

Figure 12:
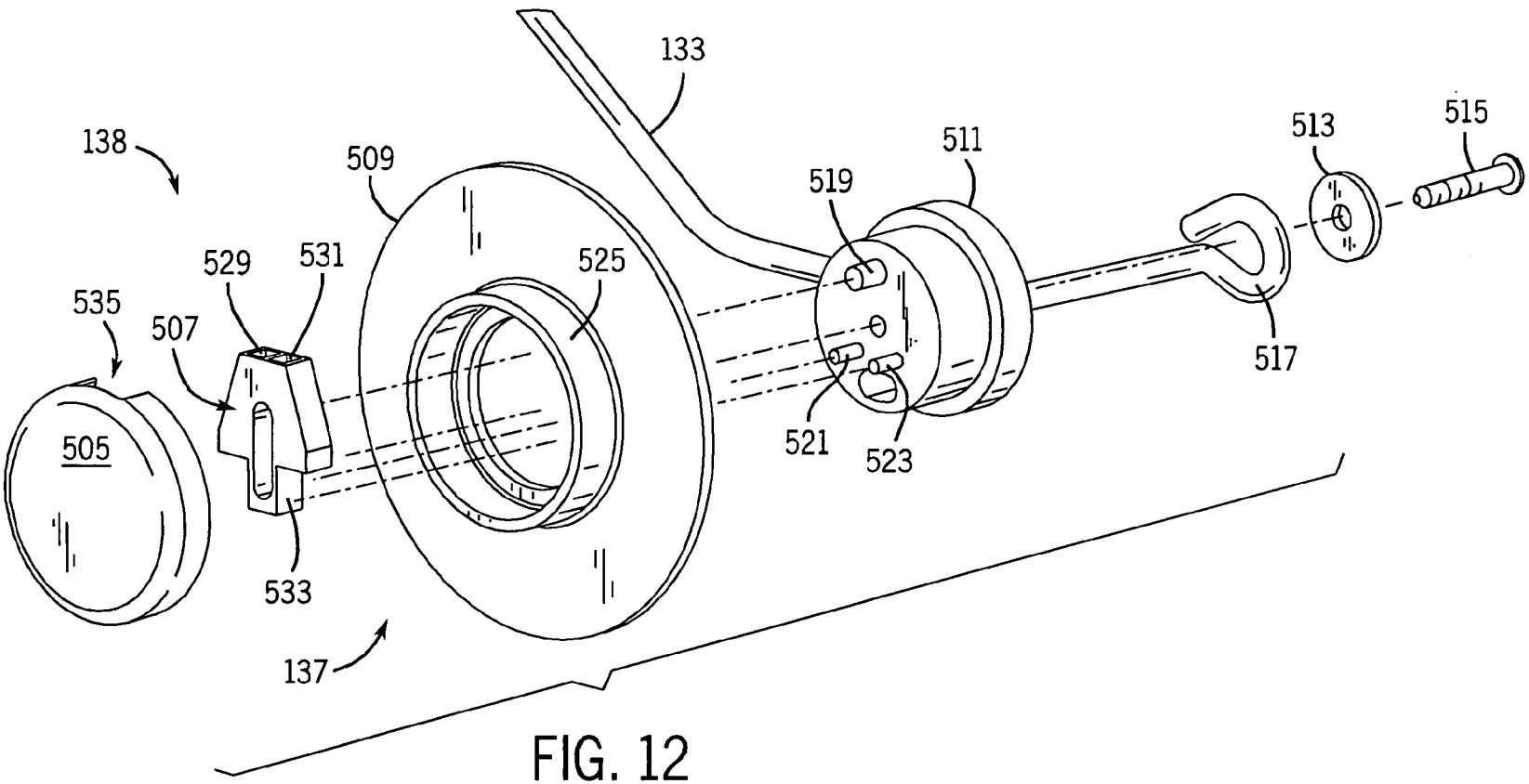
FIG. 12 is an exploded view of a roll holder and sensor apparatus for use in accordance with the invention.
Figure 13:
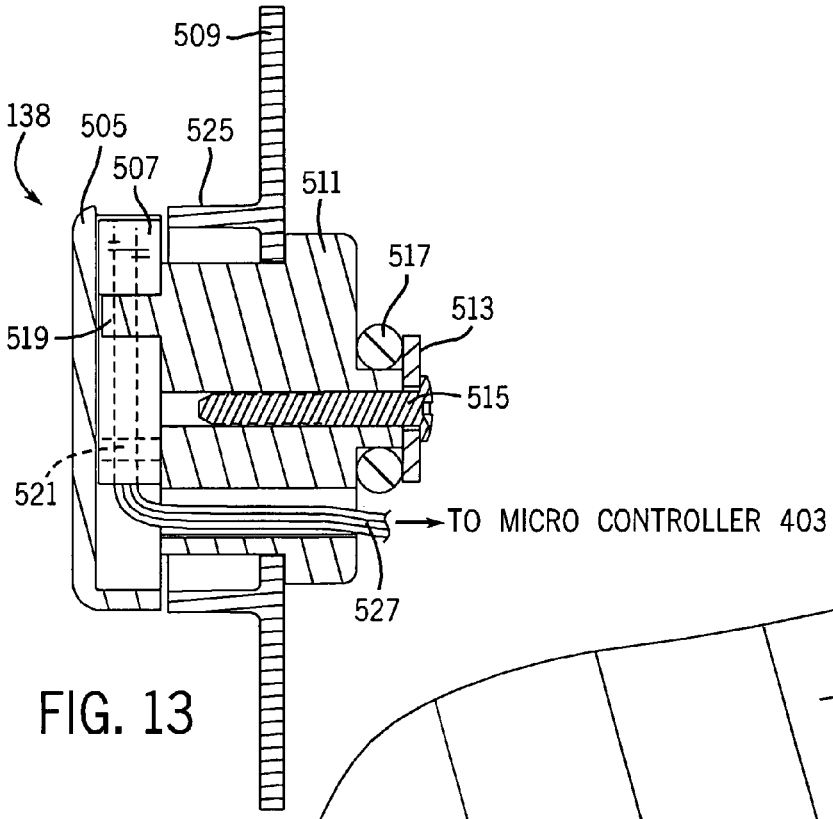
FIG. 13 is a sectional view of a roll holder and sensor apparatus taken along section 13—13 of FIGS. 5 and 11.
Figure 14:
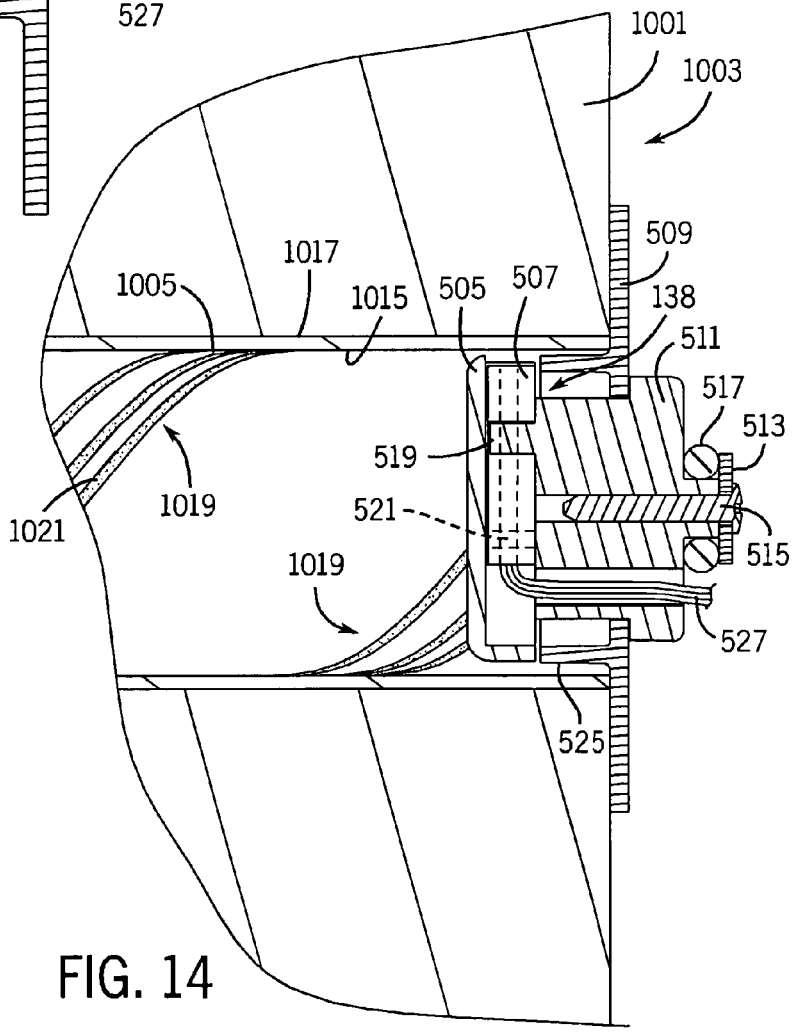
FIG. 14 is a sectional view of a roll holder and sensor apparatus taken along section 14—14 of FIGS. 6 and 8.
Figure 15:
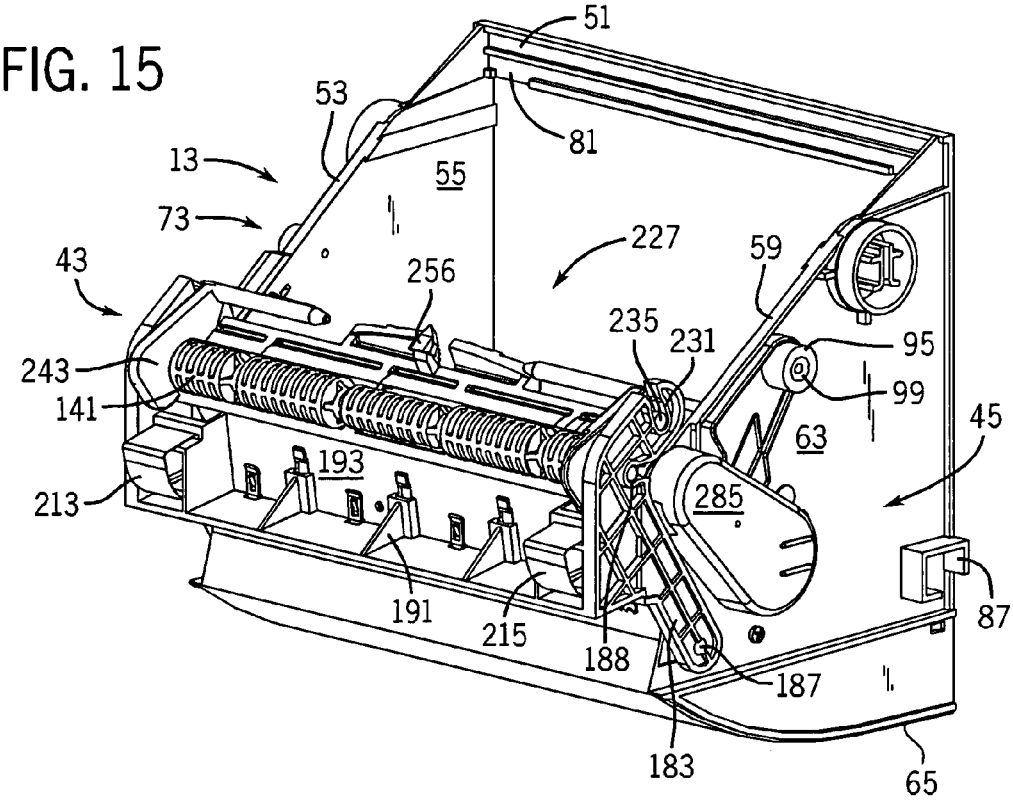
FIG. 15 is a perspective view of the front side of the dispenser frame of the motor-driven dispenser of FIG. 3.
Figure 16:
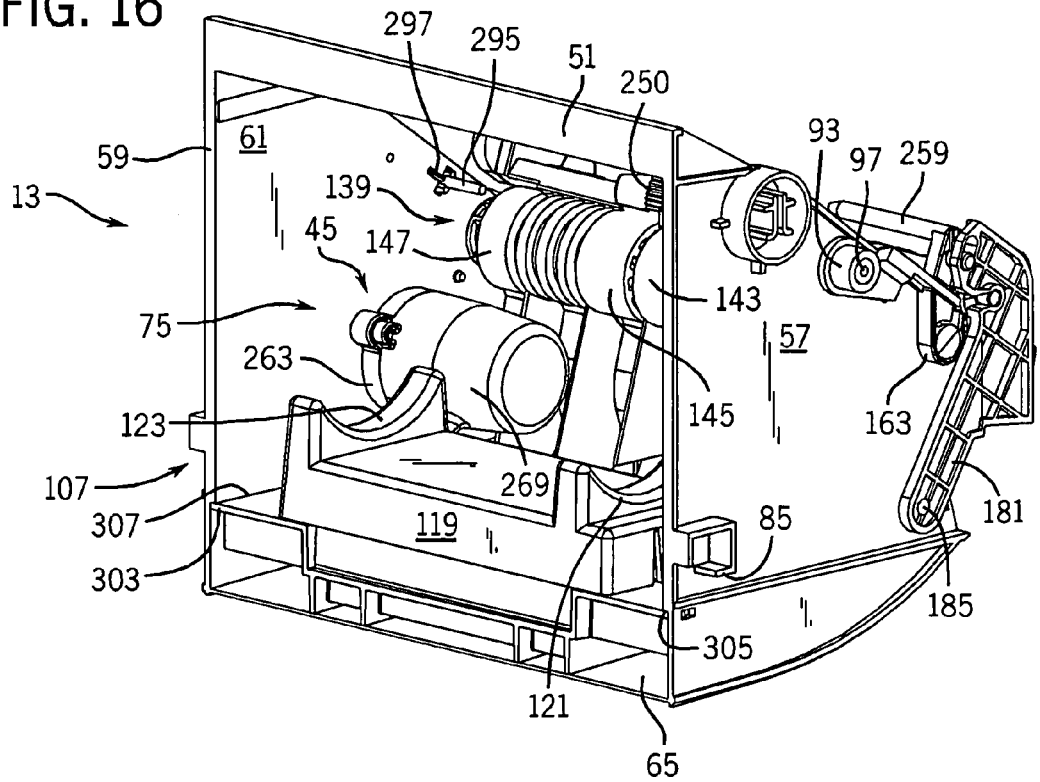
FIG. 16 is a perspective view of the rear side of the dispenser frame of FIG. 15.

Referring specifically to FIGS. 12–14, the preferred sensor apparatus 138 forms a part of roll holder 137 and consists of a cover 505, sensor element 507, roll flange 509, base 511, washer 513 and fastener 515. The sensor apparatus 138 is configured for mounting on yoke 125, specifically on arm 133. Arm 133 includes eyelet 517 formed therein to receive fastener 515 inserted through washer 513. Fastener 515 secures base 511 in fixed-position relationship to arm 133. Pins 519, 521, 523 secure sensor element 507 to base 511 by means of a friction fit and are received into corresponding female openings (not shown) in cover 505 to secure cover 505 to base 511 also by means of a friction fit. Sensor element 507 is in fixed-position relationship to base 511. Roll flange 509 includes a neck 525 sized to be received in end 1013 of core 1005 and to support the core 1005 when mounted on yoke 125 and roll holders 135, 137. The mounting of core 1005 on roll holders 135, 137 is such as to shield sensor element 507 (specifically phototransistor 531) from ambient light for purposes relating to the optically-based CoreCheck routine described in detail below. Roll flange 509 is rotatably supported by base 511 for co-rotation with the core 1005 as the roll 1003 rotates within dispenser 1, 3. Sensor element 507 is operably connected to control circuit 49 by means of conductor 527 and is powered by power supply 47.

The sensor element 507 is preferably a phototransistor reflective object sensor. A suitable sensor is a QRB1113 or 1114 sensor available from Fairchild Semiconductor® of South Portland, Me. (www.fairchildsemi.com). The QRB1113/1114 consists of an infrared emitting diode 529 ("IR LED") and an NPN silicon phototransistor 531 mounted side by side on a converging optical axis in a plastic housing 533. Sensor element 507 is oriented such that IR LED 529 and phototransistor 531 are fixed in place spaced apart from the inner surface 1015 of a core 1005 and are directed toward opening 535 in cover 505. This arrangement orients sensor element 507 to scan the code represented by bar code 1019 when the bar code 1019 is rotated about fixed sensor element 507 during rotation of a core 1005 mounted on roll holders 135, 137.

It should be noted that movement of the bar code 1019 need not be rotational movement as described herein. However, the form of bar code movement past sensor element 507 is dependent on orientation of the bar code 1019 with respect to sheet material roll 1003. For instance, translational movement of the bar code 1019 past the sensor element 507 (for example when inserting core end 1013 onto neck 525 during loading) could be utilized.

The output of sensor element 507 corresponding to an authorized bar code 1019 is an analog code signal (step 607, FIG. 34A) corresponding to the elements comprising bar code 1019 affixed to the core 1005. The analog code signal is transmitted to microcontroller 403 through conductor 527. As is well-known, the analog signal corresponding to the bar code 1019 will have a characteristic time distribution based on the bar code elements. If the bar code 1019 is not present on the roll core 1005 or is a bar code including an unauthorized or incorrect code, then the output of the sensor element 507 will be recognized by the microcontroller 403 as an invalid signal resulting in disablement of the dispenser 1, 3 as described herein.

While the invention is illustrated with a sensor apparatus 138 comprising a bar code reader system with an optical emitter and detector, it is envisioned that other types of sensor apparatus 138 could be utilized to detect types of machine-readable indicia, other than a bar code 1019, associated with the sheet material roll 1003. Other suitable sensor apparatus could include, for example, an optical reflectivity sensor (e.g., a linear optical array) adapted to detect the presence of a reflective object or code on the sheet material roll 1003 (such a system could permit static reading of the object or code, such as a linear bar code or other symbol), a magnetic sensor adapted to detect the presence of magnetic ink or other magnetic object on the roll 1003, a low-power RFID ("radio frequency identification tag") sensor adapted to detect an RFID tag located on the roll 1003, a capacitive field disturbance/proximity detector, or even an electrical contact detector adapted to detect the presence of one or more conductive elements attached to roll 1003.

Control Circuit

Control circuit 49 will now be described for motor-driven and manually-driven dispenser embodiments 1, 3. Particular reference is made to FIGS. 17 and 29–33. Reference is also made to FIGS. 34A–34F which comprise logic flow diagrams illustrating operation of control circuit 49 in conjunction with dispensers 1, 3.

As shown in FIGS. 17 and 29–33, the control circuit 49 of dispensers 1, 3 comprises a microcontroller 403 and related control circuit components operatively connected to sensor apparatus 138 and power supply 47. The control circuit 49 for motor-driven dispenser 3 further requires a separate input device 537 in the form of an ON/OFF switch which is actuated by the user to generate a signal used to indicate that a user is calling for a length of sheet material 1001 and to cause the dispenser 1 to commence a dispensing cycle. Control circuit 49 for manually-driven dispenser 3 includes suitable components for controlling interlock device 50. An optional LED indicator 539 and cover interlock switch 541 may be provided as described below.

Figure 34A:
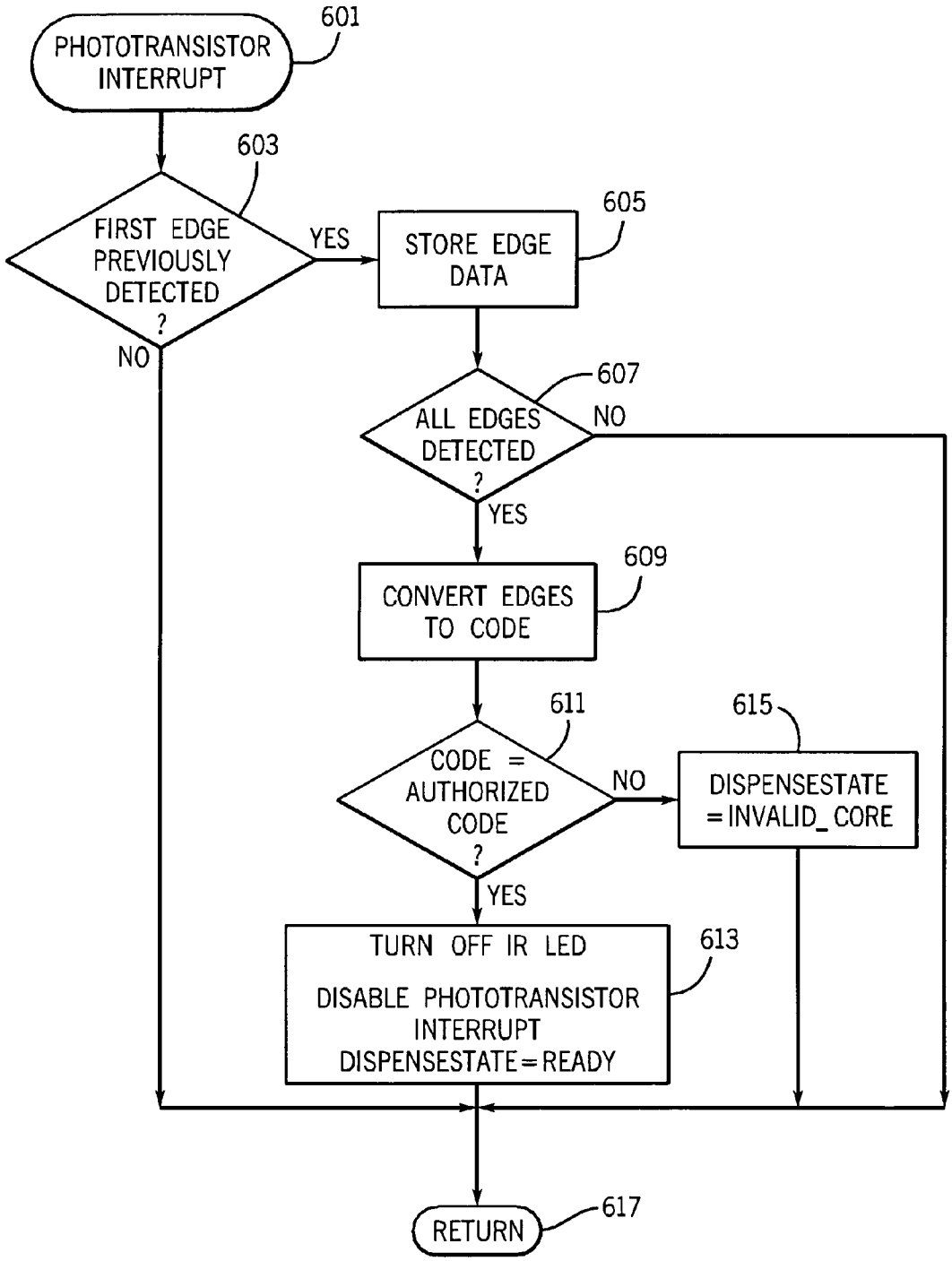
FIGS. 34A–34F are flow charts showing the steps of a preferred method of dispenser operation, including sheet material recognition, according to the invention.

As represented by the logic flow diagram of FIG. 34A, microcontroller 403 of control circuit 49 captures the analog code signal generated by the sensor element 507 (steps 601–607, FIG. 34A), converts the edge signals (i.e., time distribution signals) to a digital code (step 609) and then processes the code by comparing the code to at least one code in a code database (step 611) in microcontroller 403. If there is agreement between the codes then the control circuit 49 sets a READY state in which the dispenser is enabled for operation (step 613).

In the motor-driven embodiment 1, the control circuit 49 affects the electric motor 267 such that, in the dispenser-enabled state, motor operation is triggered responsive to a signal from the input device 537 and, in the dispenser-disabled state, the electric motor 267 is disabled. In the manually-driven dispenser 3, control circuit 49 generates an "interlock signal" based on the code comparison and presents such interlock signal to the interlock device 50. The interlock signal is any signal which is capable of enabling or disabling the dispenser interlock device 50. The interlock device 50 receives the interlock signal and sets a dispenser-enabled state in which the dispenser 3 is enabled for operation if there is agreement in the above code comparison. Alternatively, interlock device 50 sets a dispenser-disabled state in which the dispenser is disabled if no such agreement is found.

The microcontroller 403 and related control circuit 49 components 333 for dispenser embodiments 1, 3 may be mounted on printed circuit board 335 ("PC board"). The microcontroller 403 and control circuit 49 components 333 shown in FIGS. 17 and 29–30 are provided for illustrative purposes only and do not represent the actual appearance of the components utilized in the invention. A detailed description of the actual circuit 49 components and circuit operation will be provided below, particularly with respect to FIGS. 31–33.

Figure 26:
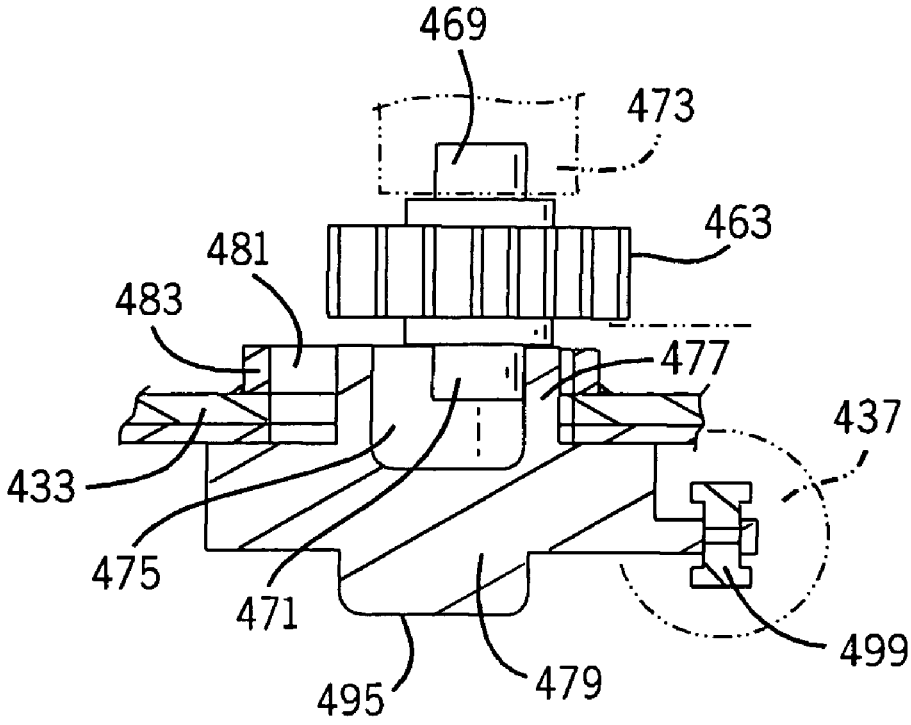
FIG. 26 is partial sectional view of certain drive apparatus components taken along section 26—26 of FIG. 23.

PC board 335 on which microcontroller 403 is mounted is a rigid resin-based board with electrical conductors (not shown) deposited thereon between the appropriate control circuit 49 components as is typical of those used in the electronics industry. PC board 335 may be mounted in dispenser 1, 3 in any suitable manner. In the embodiments shown, PC board 335 is mounted in frame 13 by attachment to housing 345. Housing 345 has a hollow interior space 347 in which microcontroller 403 is received. PC board rear edge 349 is inserted in slot 357 and front edges of PC board 353, 355 are inserted in co-planar housing slots, one of which (ref no. 357), is shown in FIG. 26 and the other of which is a mirror image of slot 357. As best shown in FIGS. 26 and 27, housing 345 is held in place along frame bottom wall 65 with housing rear wall 361 abutting base front wall 363 with tangs 365, 367 engaged with corresponding openings (not shown) in housing rear wall 361. Housing front and rear legs 369, 371 rest on frame bottom wall 65.

Figure 31:
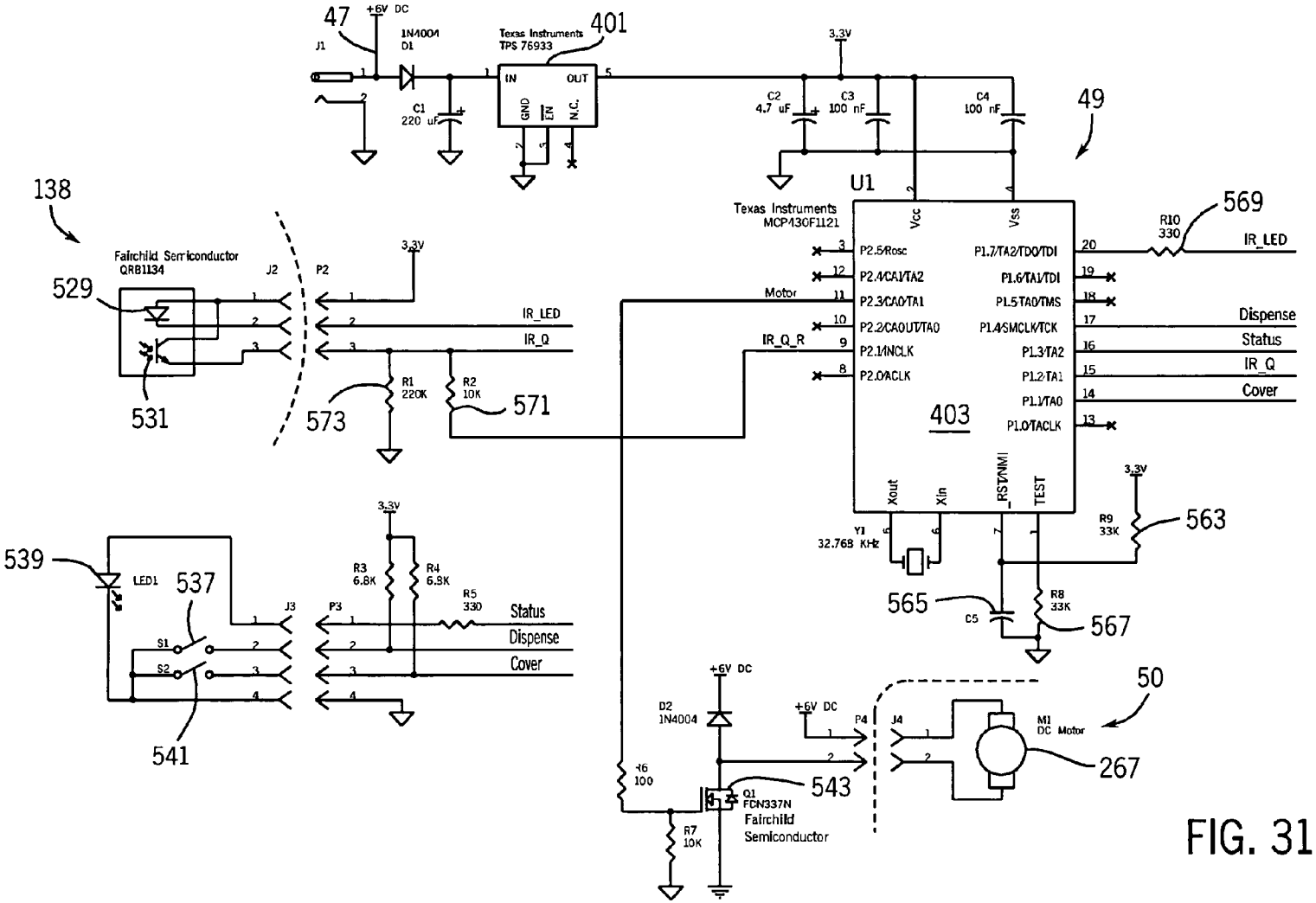
FIG. 31 is a schematic diagram showing preferred electrical components of a material-recognition apparatus suitable for use with the motor-driven dispenser of FIG. 3.

Referring now to FIG. 31, there is shown a control circuit 49 for the motor-driven dispenser embodiment 1. Central to control circuit 49 of such embodiment is microcontroller 403 which may be a Texas Instruments MSP430F1121 mixed signal microcontroller. Voltage regulator 401 supplies 3.3V to the microcontroller 403 at pin 2 and to the sensor element 507. As illustrated in the schematic of FIG. 31, motor-driven dispenser 1 microcontroller 403 is connected at pin 11 to field effect transistor ("FET") 543. FET 543 may be a Fairchild Semiconductor field effect transistor FDN337.

A "high" signal on microcontroller 403 pin 11, is a consequence of an appropriate signal from input device 537 and the dispenser 1 being in the dispenser-enabled state. Motor 267 is turned off in the dispenser-enabled state when pin 11 of microcontroller 403 goes "low," resulting from the motor timer being decremented to 0 (FIG. 34C, step 643). (In this context, "high" and "low" indicate voltage levels representing logical high and low signals as commonly used in digital circuit descriptions.) FET 543 provides adequate current to drive motor 267 in response to such "high" signal on pin 11 of microcontroller 403. In effect, FET 543 acts as a solid-state "switch" which is controlled by microcontroller 403.

Figure 3:
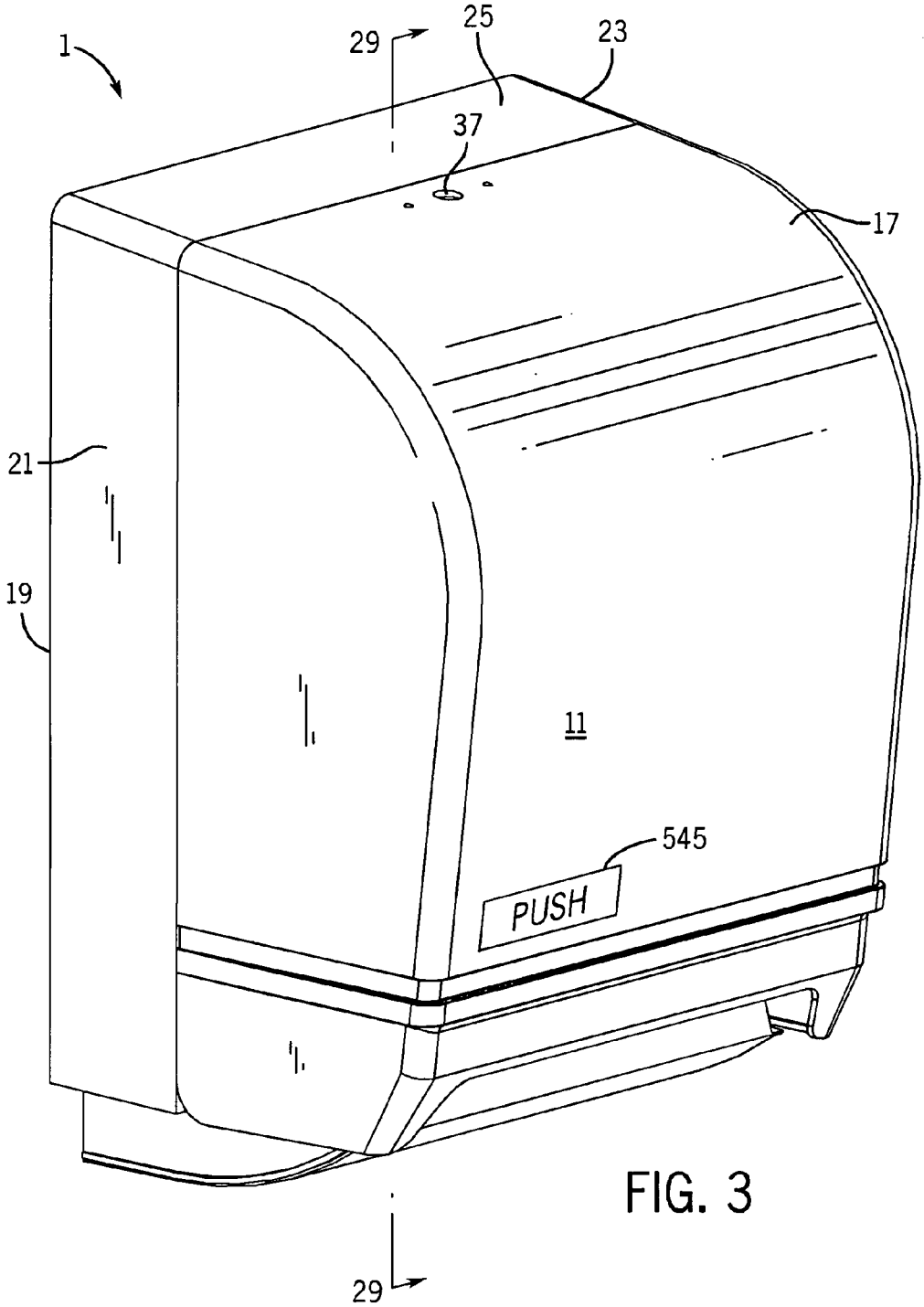
FIG. 3 is a perspective view of a motor-driven dispenser embodiment in accordance with this invention. The housing cover is closed.

The motor-driven dispenser 1 further requires a suitable user input device 537 (i.e., an ON/OFF mechanism) which causes the enabled dispenser 1 to commence a dispensing cycle responsive to the request of a user for a length of sheet material. Such input device 537 is represented schematically on FIG. 31 as a switch (Switch "S1"). Input device 537 may be of any type sufficient to cause the enabled dispenser 1 to commence a dispensing cycle. For example, input device 537 may represent a momentary push button switch (FIG. 31, "S1") which is momentarily closed when the user presses a push button 545 on the housing front cover (FIG. 3).

Dispensing is able to occur only when the dispenser 1 is in the dispenser-enabled, or READY state. Contact closure of switch comprising input device 537 acts as a request to dispense the sheet material 1001. Closing of switch S1 of input device 537 causes microcontroller 403 to run the motor 267 for a predetermined time interval resulting in discharge of a length of sheet material 1001.

Alternatively, input device 537 may consist of a hand proximity detector apparatus which closes an unshown solid-state switch (replacing switch S1 of input device 537) based on the presence of the user adjacent the dispenser 1. As with the embodiment of FIG. 29, closing of the solid-state switch would cause microcontroller 403 to run the motor 267 for a predetermined time interval resulting in discharge of a length of sheet material 1001.

An example of a suitable proximity detector apparatus which could be used in dispenser 1 is shown and described in U.S. patent application Ser. No. 10/160,863 the entire contents of which are incorporated herein by reference. Such '863 application is owned by the owner of the present application. The proximity detector of the '863 application generates a signal based on detected changes in the capacitance of a sensor element. The change in capacitance occurs when a user places her hand proximate the sensor. A signal is generated in response to such change in capacitance and the signal is used to close a solid-state switch used in place of switch S1 of input device 537, thereby causing an electric motor to power a drive roller to dispense a predetermined length of sheet material.

As shown in FIG. 31, the control circuit 49 of the motor-driven dispenser 1 may include a cover interlock switch 541 (Switch "S2"). Cover interlock switch 541 is provided to indicate that a roll replacement event has occurred. Optional cover switch 541 is preferably a microswitch connected to microcontroller 403 at pin 14. Switch 541 contacts are opened when dispenser cover 17 is opened (e.g., lowered to the position shown in FIGS. 8 and 9 in connection with the manually-driven dispenser 3) and the contacts are closed when the cover 17 is in the closed position shown in FIG. 3. Closing of the switch indicates to microcontroller 403 that a full roll 41 of sheet material has been loaded on roll holders 135, 137. In response, microcontroller 403 turns on motor 267 for a fixed time period (a typical value may be 1.5 seconds) so that the bar code 1019 can be sensed as described below. An open contact or broken wire condition indicates the cover 17 is open and the bar code 1019 must be read and verified before dispensing is allowed.

The transfer mechanism 227 illustrated for use with the motor-driven dispenser 1 is not used if the embodiment includes the optional cover interlock switch 541. In such embodiment, sheet material 1001 is dispensed solely from a sheet material roll 41 mounted on roll holders 135, 137.

The control circuit 49 of the motor-driven and manually-driven dispensers 1, 3 may optionally include an LED dispenser status indicator 539 (FIGS. 29–33). The LED 539 is preferably a red LED visible from outside the dispenser housing 11. LED 539 provides a visual indication that the dispenser is in a disabled or enabled state. If provided, LED 539 may be connected to microcontroller at pin 16. The microcontroller 403 is preferably programmed to cause LED 539 to blink at a first, rapid rate (preferably two blinks per second) when the dispenser is disabled, for example when in the INVALID_CORE or READING_CODE states described below in conjunction with the logic flow diagrams FIGS. 34A–34F. The LED 539 preferably blinks at a second, slower rate (preferably one blink per five seconds) when the dispenser is in the dispenser-enabled, or READY state. The rapid blink rate in the disabled state provides a clear indication to the attendant that the dispenser 1, 3 requires service.

Figure 33:
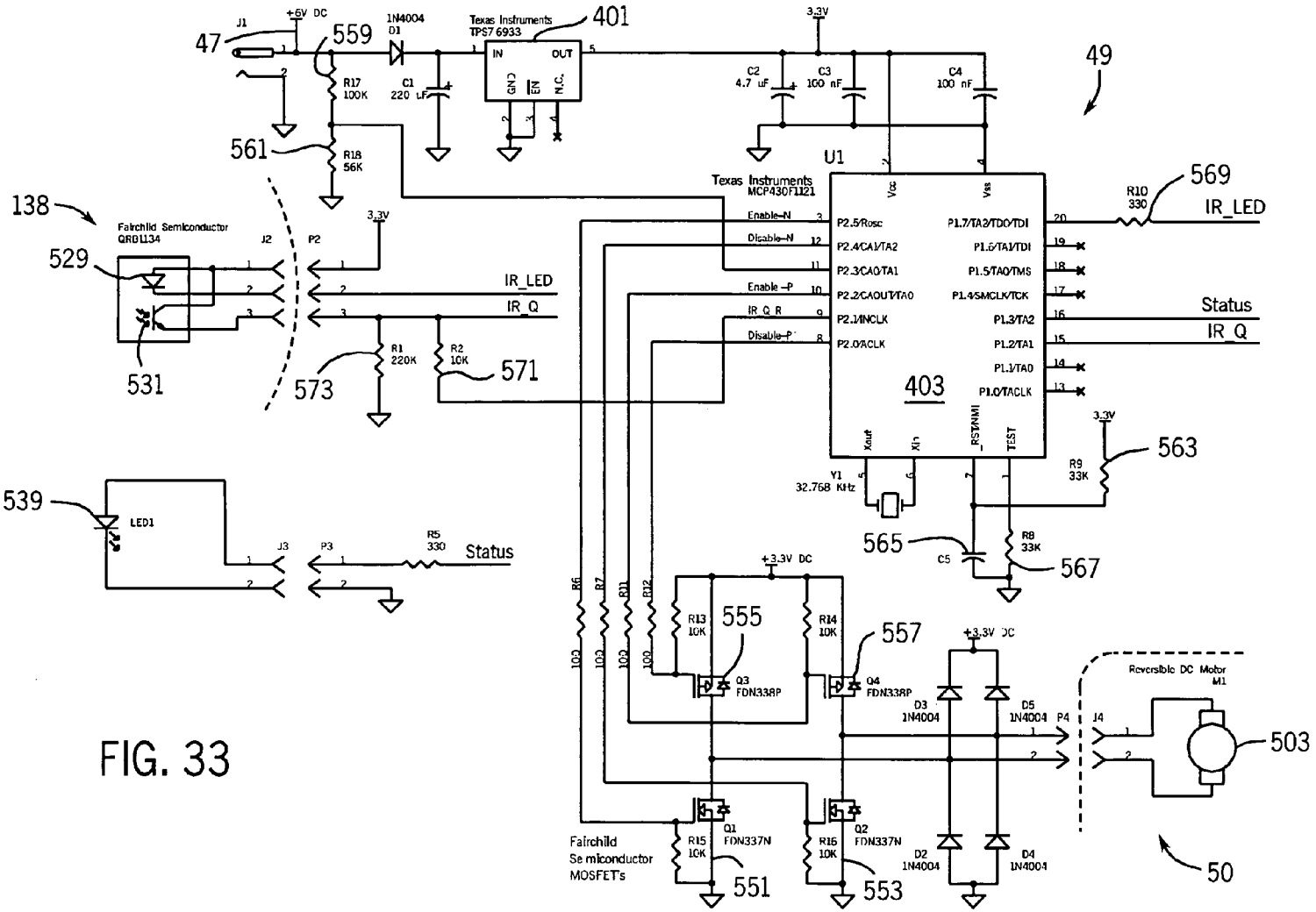
FIG. 33 is a schematic diagram showing preferred electrical components of a material-recognition apparatus including a micromotor-driven interlock device suitable for use with the manually-driven dispenser of FIG. 8.

Referring to FIGS. 32–33, control circuit 49 of manually-driven dispenser 3, may be tailored to the specific interlock device 50 selected for use with dispenser 3. For example, FIGS. 32–33 separately show control circuits 49 for an interlock device 50 comprising a latching solenoid 437 (FIG. 32) or a reversible DC Motor 503 (FIG. 33) each of which may be used to displace free-wheel gear 463, armature 431, a locking pin similar to armature 431 or a like device as described fully in connection with FIGS. 20–28.

Referring first to the control circuit 49 for latching solenoid-based interlock device 50 of FIG. 32, two FET switches 547, 549 controlled by microcontroller 403 pins 12 and 3 respectively, control latching solenoid 437. An interlock signal in the form of a "high" pulse on microcontroller pin 3 causes the solenoid 437 armature 431 to move in one direction while a further interlock signal in the form of a "high" pulse on microcontroller 403 pin 12 causes the solenoid 437 armature 431 to move in an opposite direction. As described in connection with FIGS. 20–22, movement of the armature 431 may be used to disable and enable operation of push bar 409. In the further embodiment described in connection with FIGS. 23–28, movement of armature 431 may be used to move free-wheel gear 463 between the gear-engaged and gear-disengaged positions respectively enabling or disabling the dispenser 3.

In the example of FIG. 33, interlock device 50 comprises a reversible interlock motor 503 in combination with the free-wheel gear 463 or locking pin similar to armature 431. In this embodiment, four field effect transistor switches 551, 553, 555, 557 controlled by microcontroller 403 pins 3, 12, 8, and 10 respectively, control the reversible motor 503. Interlock signals in the form of "high" signals on microcontroller pins 3 and 10 cause the motor 503 to drive a shaft (not shown) in one direction while "high" interlock signals on microcontroller pins 12 and 8 cause the motor 503 to drive the shaft in an opposite direction. Movement of the shaft can be used, through a suitable linkage, to displace a locking pin or free-wheel gear 463 to enable or disable the dispenser drive apparatus 45 as shown and described in connection with FIGS. 20–28.

Referring further to the schematic circuit diagrams of FIGS. 32–33, the control circuits 49 of the manually-driven dispenser 3 with either a latching solenoid 437 or reversible motor 503 are shown with an optional voltage divider provided to disable the dispensers 3 if the battery voltage drops below a predetermined threshold, in these embodiments below 4.5V. More specifically, resistors 559, 561 ("R17", "R18") form a voltage divider that supplies an analog signal to microcontroller 403 pin 11. Microcontroller 403 is configured such that pin 11 is an input to an analog comparator with a comparison threshold of 1.65V. Normally the voltage at microcontroller 403 pin 11 is approximately 2.2V.

Material Recognition

Operation of material-recognition apparatus 10 will now be described in conjunction with motor-driven and manually-driven dispensers 1, 3. A summary of the material-recognition method will first be described with respect to FIG. 34A followed by a description of the specific operational steps of the dispenser embodiments 1, 3.

An optional material transfer event will be described in connection with FIGS. 29–30 which represent a motor-driven dispenser 1 with an optically-based "CoreCheck" routine as described below in connection with steps 651–672. Such description is applicable to the manually-driven dispenser embodiment 3 because the structure and operation of the transfer mechanism 227 for dispenser 3 is identical to that for motor-driven dispenser 1 with the optically-based CoreCheck. FIGS. 22–30 represent the state of dispenser 1 in which a previously recognized sheet material stub roll 39 is mounted on support 107 while a full sheet material roll 41, following material recognition, is mounted on support 109.

Referring first to FIG. 34A, that figure represents the material-recognition steps common to the material-recognition apparatus 10 of all dispenser embodiments 1, 3. The material-recognition steps of the present invention are described in connection with recognition of a sheet material roll 1003, such as the full sheet material roll 41 shown in FIGS. 29–30. The full sheet material roll 41 loaded on roll holders 135, 137 includes a bar code 1019 associated therewith indicating that the roll 41 is from an authorized source.

The logic represented by the flow diagram of FIG. 34A has an entry point at which a series of phototransistor interrupt signals 601 are received when a bar code 1019 passes sensor element 507. At this point 601, the Phototransistor Interrupt has previously been enabled (FIG. 34E, step 671, FIG. 34F, step 677) and IR LED 529 is turned on, allowing the microcontroller 403 to perform the material-recognition steps shown in FIG. 34A. These interrupt signals 601 correspond to the edges 1025 of the bar code 1019. After detection of a first bar code edge 1025 at decision point 603, the code in microcontroller 403 stores the time at which subsequent edges are detected at step 605 until it is determined at step 607 that all bar code edges 1025 have been detected. Microcontroller 403 cycles through RETURN point 617 until all edges have been detected. Once all edges of the code are sensed (step 607), the stored edge data is converted to a digital code (step 609) and compared with at least one code in a code database at step 611. If the code signal is a valid code signal then the dispenser 1, 3 is placed in a dispenser-enabled, or READY, state at step 613. In the motor-driven dispenser embodiment 1, the dispenser is placed in a READY state awaiting a signal from input device 537 indicating that a user is requesting that the dispenser 1 dispense a length of sheet material 1001. In the manually-driven dispenser embodiments 3, an interlock signal may be generated at step 613 causing interlock device 50 to enable the dispenser 3 for operation as described above. Also at step 613, the PHOTOTRANSISTOR INTERRUPT is disabled and the IR LED 539 is turned off. Alternatively, in step 615, the dispenser 1, 3 is placed in a dispenser-disabled, or INVALID_CORE, state corresponding to non-agreement between the codes.

Referring now to FIGS. 6–8 and 29–30, the steps leading up to the material recognition by material-recognition apparatus 10 will now be described in detail with respect to operation of the exemplary dispenser embodiments 1, 3. As mentioned, the first step of the method involves loading the dispenser 1, 3 with a roll of sheet material, such as sheet material roll 41 or 1003. (The process will be described with respect to roll 41.) The dispenser 1, 3 may be powered or unpowered at the time the sheet material roll 41 is loaded.

For the sheet material dispensers 1, 3 such loading is accomplished in the following manner. The dispenser cover 17 is initially opened causing roller frame 173 to pivot outwardly. The movement of roller frame 173 positions tension roller 141 and transfer mechanism 227 away from drive roller 139 providing unobstructed access to housing interior 15 and space 75. At this time, cradle 119 could be removed to insert fresh batteries into battery box 311.

If a stub roll 39 is present as in FIGS. 29–30, the sheet material 1001 from that roll 39 continues to rest against drive roller 139 arcuate surface 257 and extend through discharge opening 67. Full sheet material roll 41 is placed on yoke 125 by spreading arms 131, 133 apart so as to locate the roll holders 135, 137 into roll core 1005 ends 1011, 1013. The dispenser 1, 3 is now loaded and ready for material recognition and subsequent dispensing if the sheet material 1001 of roll 41 is recognized as being from an authorized source.

Subsequent steps involve the electrical/mechanical components of the material-recognition apparatus 10 including the sensor apparatus 138, control circuit 49 and interlock device 50 and are discussed with particular reference to the logic flow diagrams of FIGS. 34A–34F. It would be expected that the instructions for execution of the steps set forth in FIGS. 34A–34F are provided in the form of software code embedded on firmware provided, for example, in the memory of microcontroller 403.

The specific method of material recognition will be based on whether the dispenser is a motor-driven dispenser 1 or manually-driven dispenser 3. The method of operation will also vary somewhat based on whether the dispenser 1, 3 is equipped for an optically-based CoreCheck (steps 651–672) or cover-switch-based CoreCheck (steps 673–677) as described fully herein.

Figure 34B:
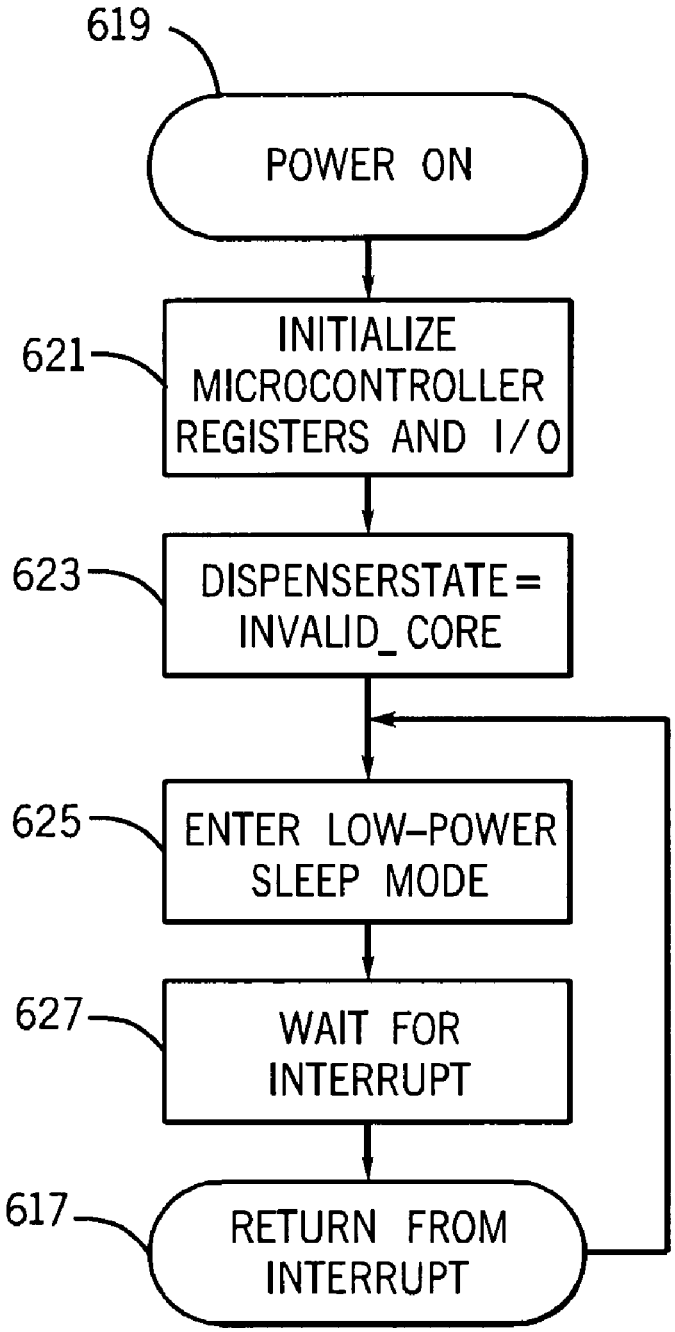
Figure 34C:
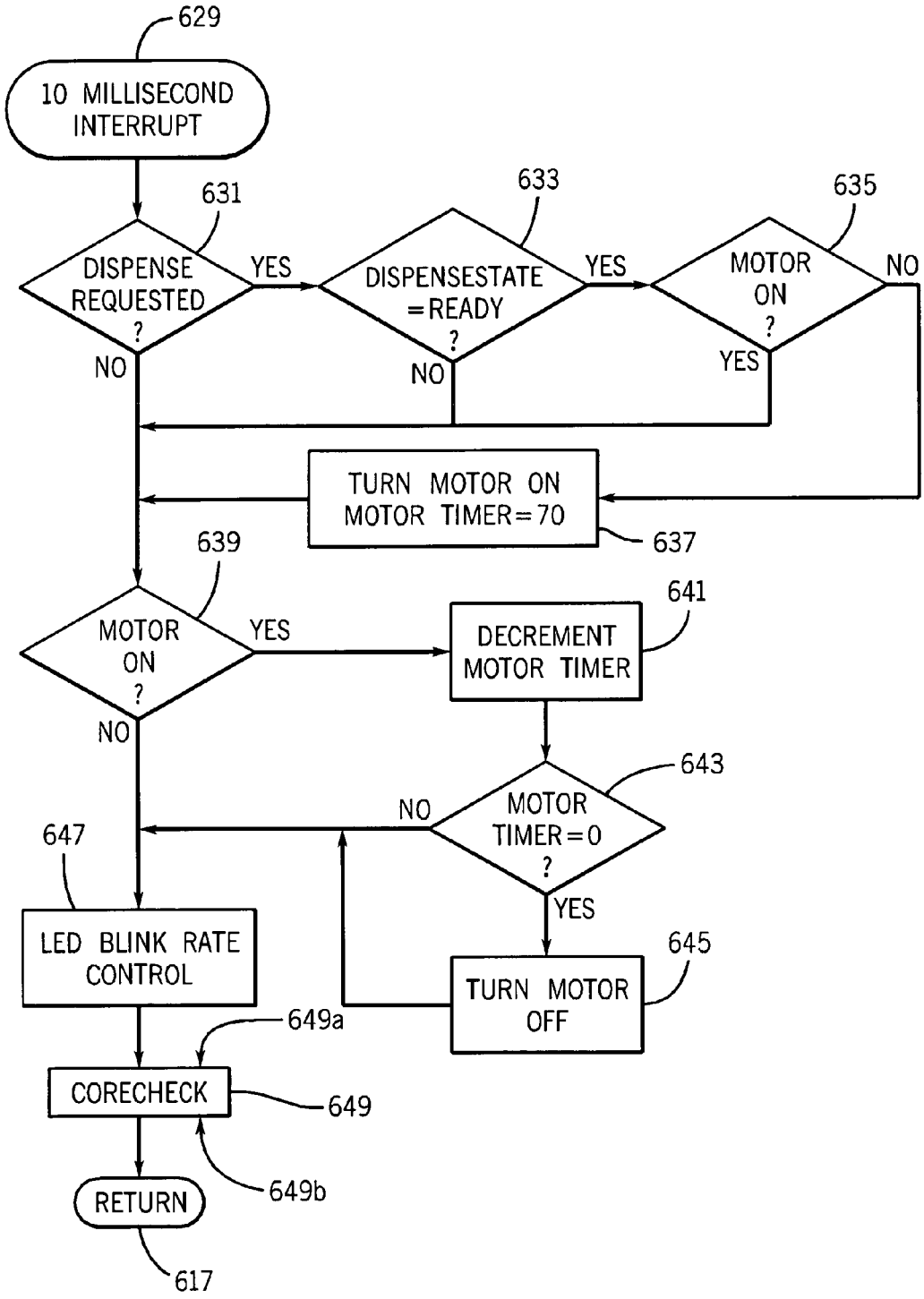

Referring now to FIG. 34B, the material-recognition apparatus 10 of loaded dispensers 1, 3 enters the POWER ON state when the power is turned on as represented by entry point 619. The microcontroller 403 is initialized in step 621. At POWER ON, resistor 563 ("R9") and capacitor 565 ("C5") generate a reset signal to ensure orderly initialization of the microcontroller 403. Resistor 567 ("R8") is required to keep microcontroller 403 in its normal run mode (not test mode). Upon completion of initialization, a variable DISPENSERSTATE is set (step 623) equal to an INVALID_CORE state disabling the dispenser 1, 3. An INVALID_CORE state is equivalent to a dispenser-disabled state as set forth above. Microcontroller 403 sets a state disabling motor 267 of dispenser 1 or interlock signal affects interlock device 50 to disable the dispenser 3. In step 625, the material-recognition apparatus of dispensers 1, 3 enters a SLEEP MODE (to conserve electrical power) awaiting an interrupt event corresponding to point 627 in the logic flow diagram.

There are two types of interrupts. One interrupt is a timed interrupt. The second interrupt is a PHOTOTRANSISTOR INTERRUPT (point 601).

Figure 34D:
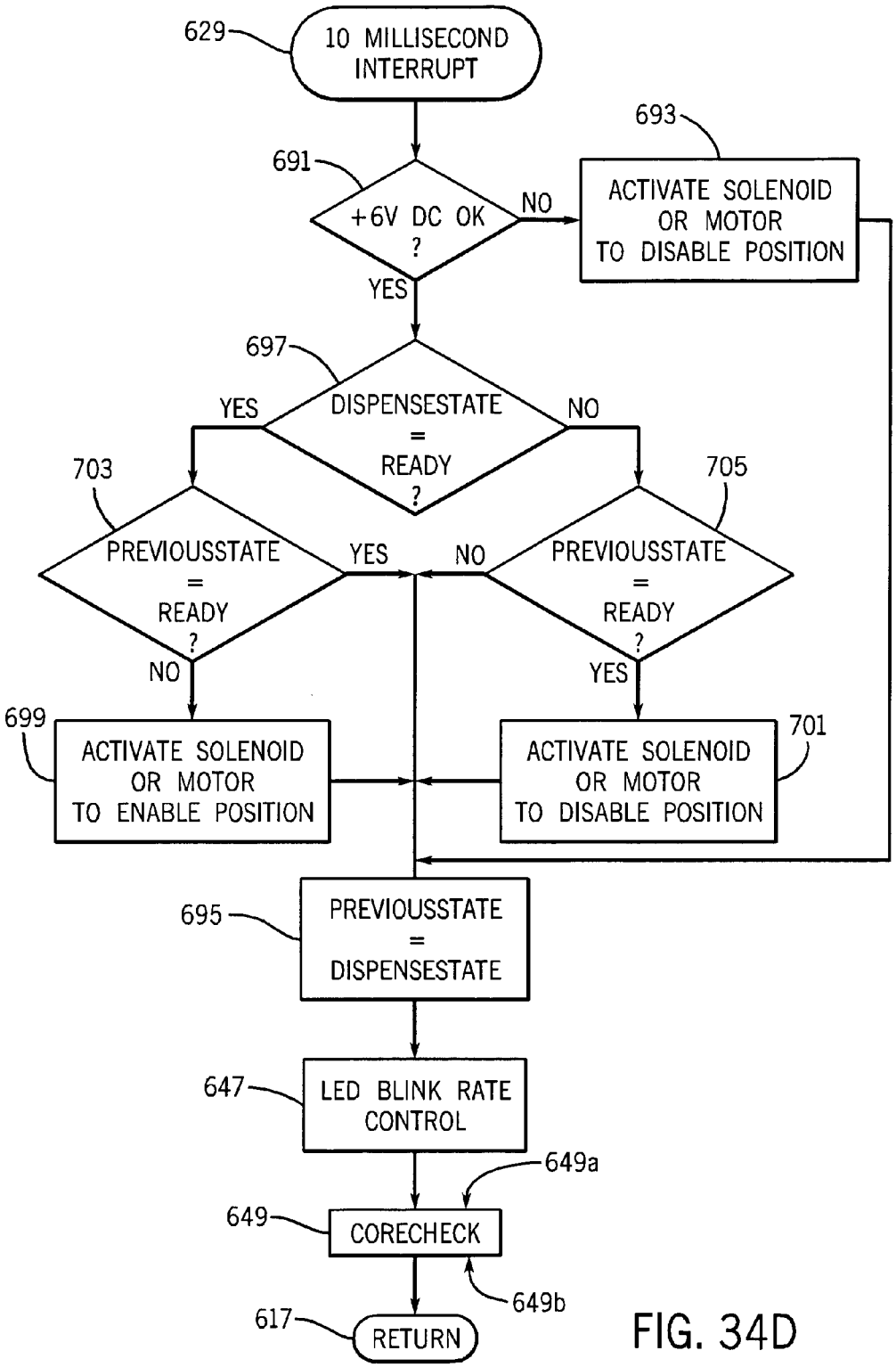

Timed interrupt events occur at predetermined intervals, preferably once every 10 milliseconds. As illustrated in FIG. 34C for the motor-driven dispenser 1, the timed interrupt triggers a series of checks, including a check for a request to dispense paper from a user and a check of the LED 539 blink rate. In the manual dispenser 3 with latching solenoid 437 or reversible motor-based 503 interlock device 50, the timed interrupt event may optionally include a check to determine whether battery voltage is above a predetermined threshold (FIG. 34D, step 691). Such voltage check could optionally be included in any of the dispenser embodiments 1, 3 described herein.

The PHOTOTRANSISTOR INTERRUPT event represents detection of a bar code 1019 affixed to a new full sheet material roll 41 loaded in the dispenser 1, 3. Following each interrupt cycle, the dispenser 1, 3 re-enters the SLEEP MODE (step 625.)

Motor-Driven Dispenser Embodiment

FIG. 34C illustrates the logic for the timed interrupt events in the motor-driven dispenser 1 while FIG. 34D illustrates the logic for the timed interrupt events for the manually-driven dispenser embodiments with interlock devices 50 including latching solenoid 437 or reversible motor 503.

Referring first to FIG. 34C and the motor-driven dispenser 1, step 629 represents receipt of a timed interrupt signal which preferably occurs every 10 milliseconds. Upon receipt of a timed interrupt signal, the microcontroller 403 conducts the timed interrupt event including a determination of whether a user has called for a length of sheet material as represented by the DISPENSE REQUESTED? step 631. Such dispense request is generated by, for example, pressing momentary dispense switch S1 of input device 537 or actuating a proximity detector resulting in actuation of a solid-state switch used in place of input device 537 switch S1. If a dispense request has occurred, then the microcontroller 403 determines whether the dispenser 1 is in the READY state represented by the decision block DISPENSESTATE=READY? (step 633). The dispenser 1 is in the READY state if, for example, the full sheet material roll 41 loaded on roll holders 135, 137 was previously recognized by the material-recognition apparatus 10 as coming from an authorized source. If the dispenser 1 is in the READY state (as determined at step 633), the microcontroller 403 then determines if the motor 267 is on (step 635). If it is determined at step 635 that the motor 267 is not on, then the motor 267 is turned on (step 637) and the motor timer is initialized to a count of 70 (also step 637).

The above logical decisions represented by the sequential steps 633, 635 and 637 result in the motor 267 being turned on. All other combinations of logical decisions result in bringing the microcontroller 403 to the same logical decision point without turning the motor 267 on (step 639). Step 639 again determines whether the motor 267 is on.

If the motor 267 is on, the motor timer is decremented (step 641). Then step 643 is a determination of whether the motor timer has been fully decremented from 70 or 150 to 0. If the result of the determination step 643 is YES, the motor is turned off (step 645). If the result of determination of step 643 is NO, the motor 267 continues to run. In effect, the microcontroller 403 continues to actuate the motor 267 throughout seventy 10-millisecond interrupt cycles. The motor-driven rotation of drive roller 139 pulls sheet material 1001 from the stub roll 39, thereby dispensing the sheet material 1001 to the user.

The microcontroller 403 next adjusts the LED 539 blink rate based on the dispenser 1 status as READY or not READY (step 647). If the dispenser 1 status is not READY, the LED indicator 539 is preferably programmed to blink at the relatively faster blink rate indicating that the dispenser 1 is in the dispenser-disabled condition. If the dispenser were in the READY state, the LED indicator 539 is preferably programmed to blink at the relatively slower blink rate indicating that the dispenser 1 is in the dispenser-enabled condition.

Optically-Based CoreCheck

Referring further to FIG. 34C, the timer interrupt event includes a periodic "CoreCheck" routine (step 649), preferably conducted once every 500 milliseconds (i.e., every fifty 10-millisecond interrupt event cycles). The CoreCheck step 649 is actually a repetitive polling process comprising a series of steps, the purpose of which is to determine whether the sheet material roll (e.g., roll 41) loaded on roll holders 135, 137 has been replaced and to enable the PHOTOTRANSISTOR INTERRUPT to read the bar code 1019 on the sheet material roll (e.g., roll 41) following loading of a new full roll of sheet material 41. Reference number 649*a* represents the CoreCheck start point and number 649*b* represents the CoreCheck end point.

Figure 34E:
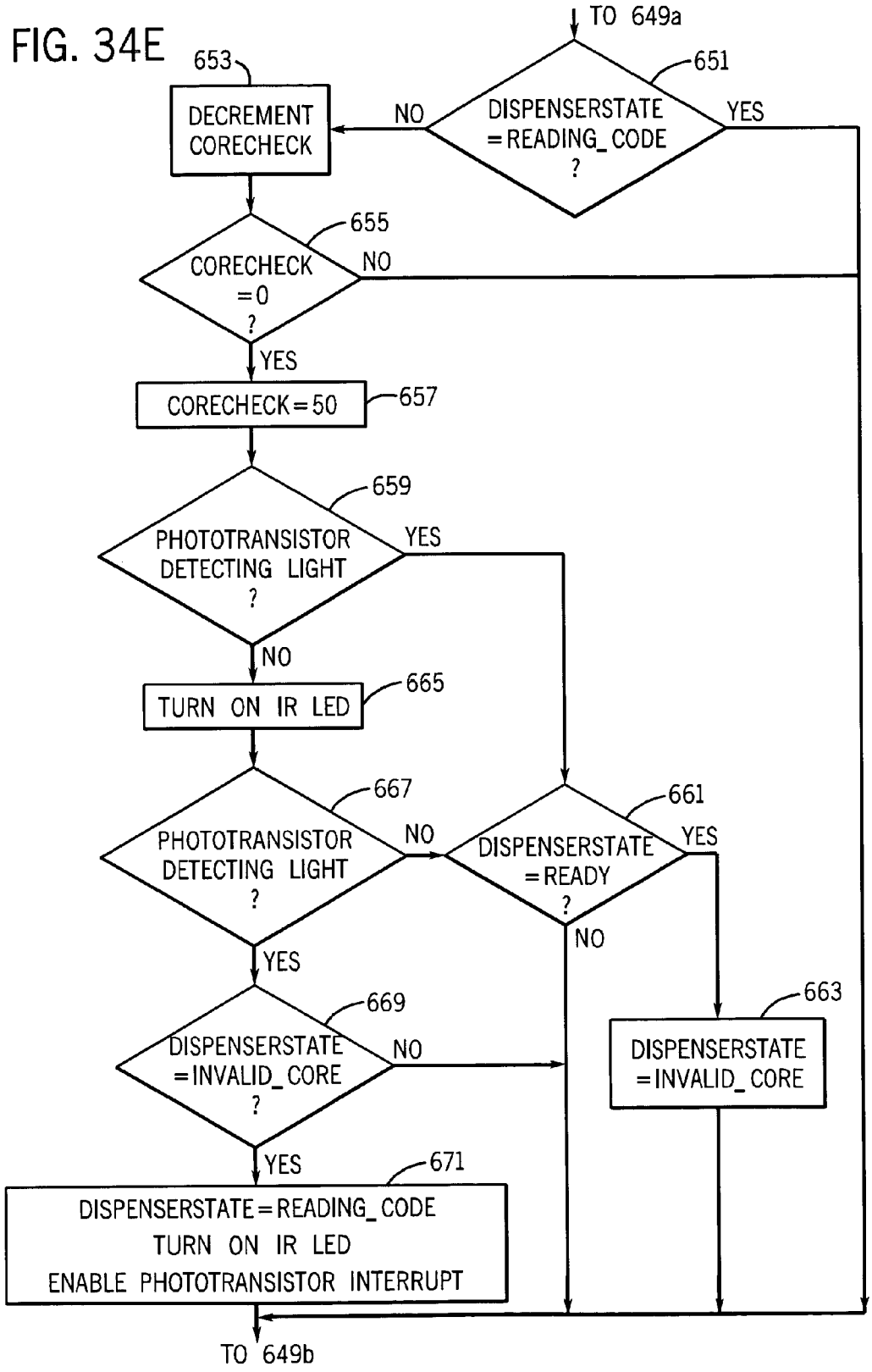
Figure 34F:
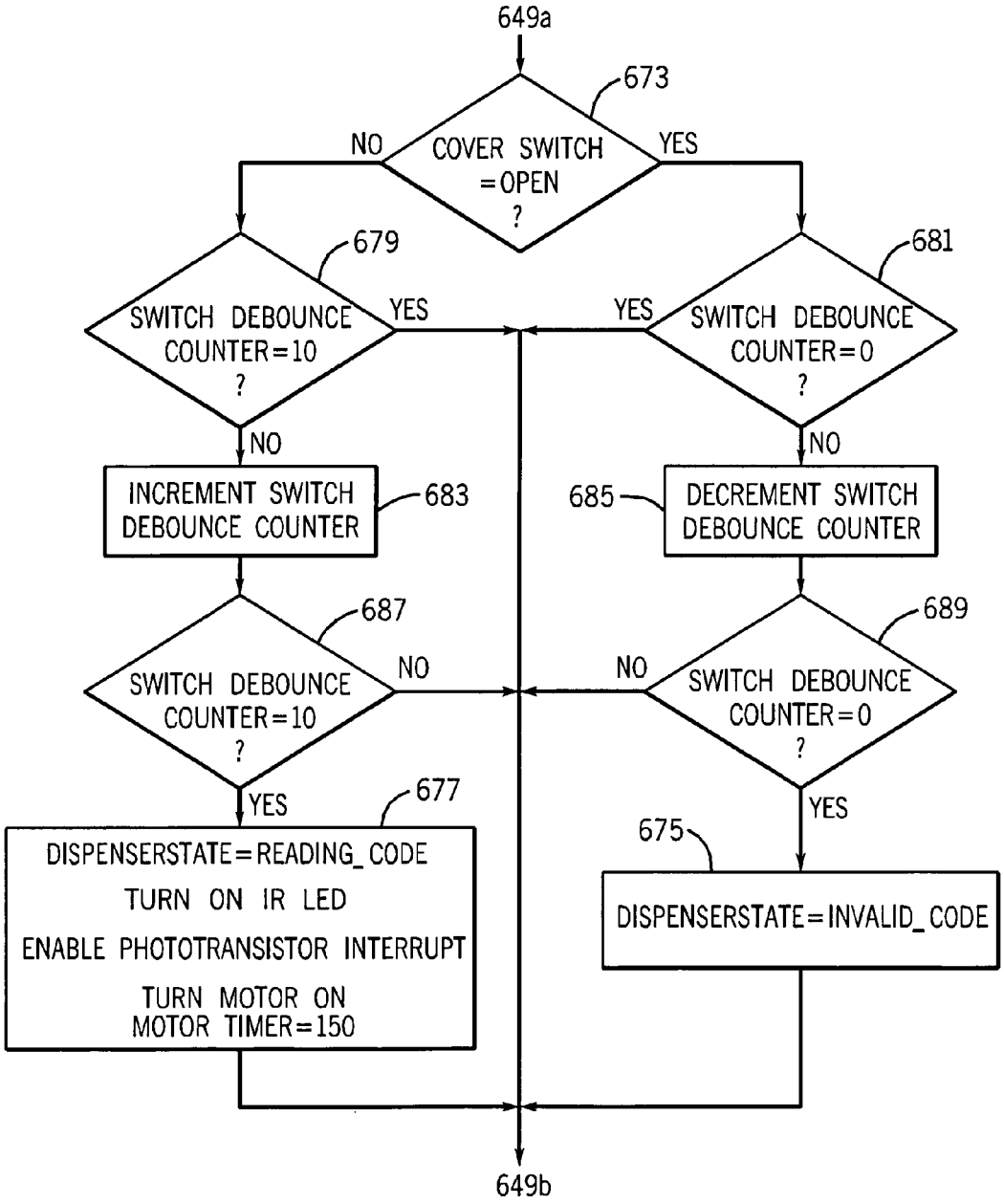
Figure 5:
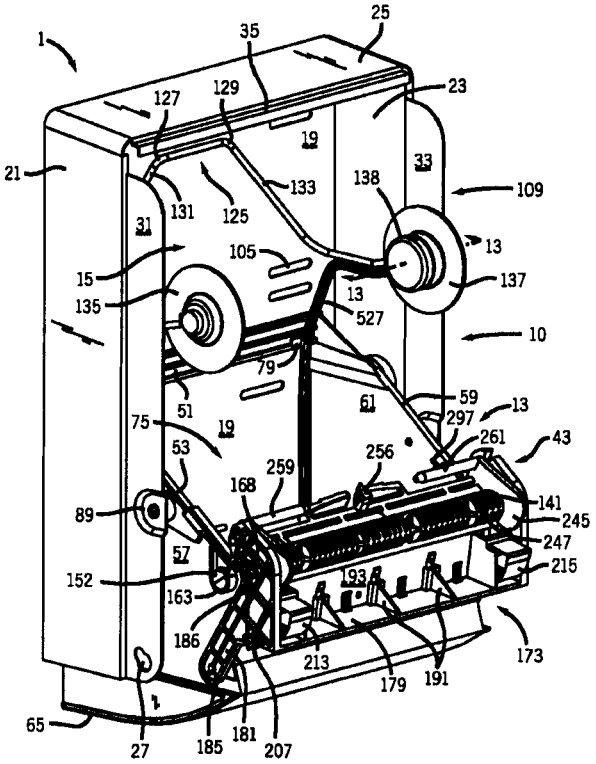
Figure 6:
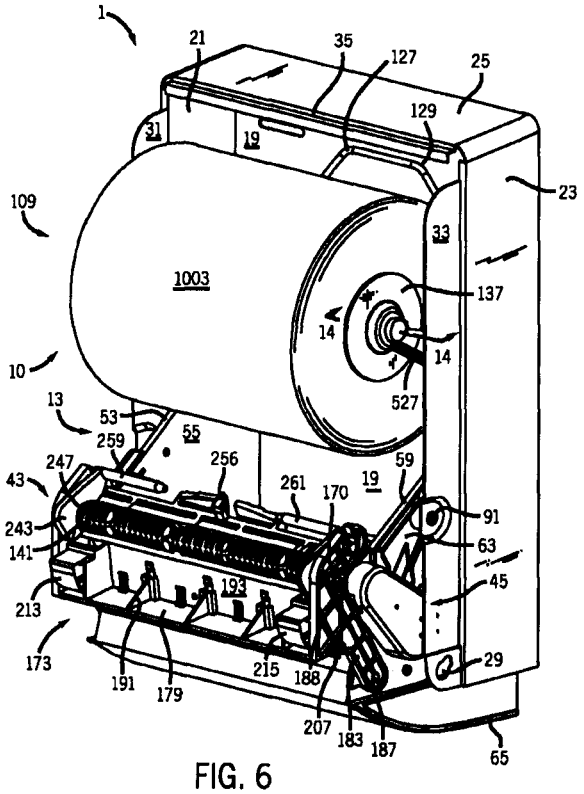
Figure 8:
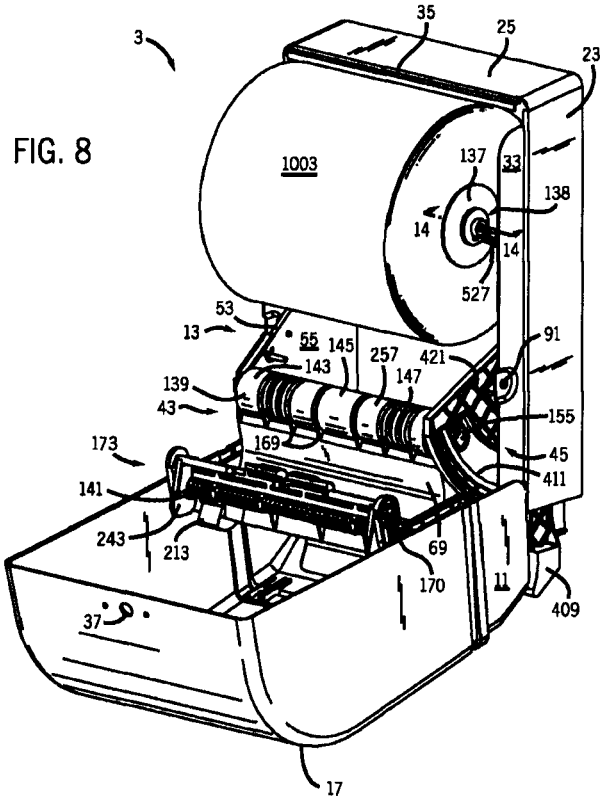
Figure 17:
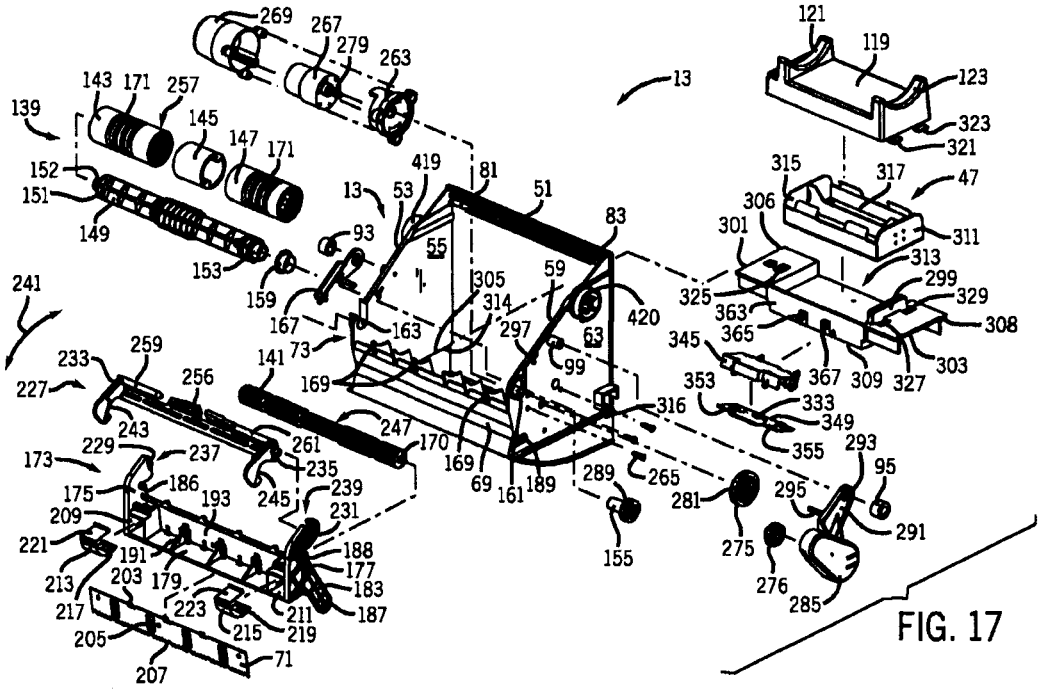
Figure 23:
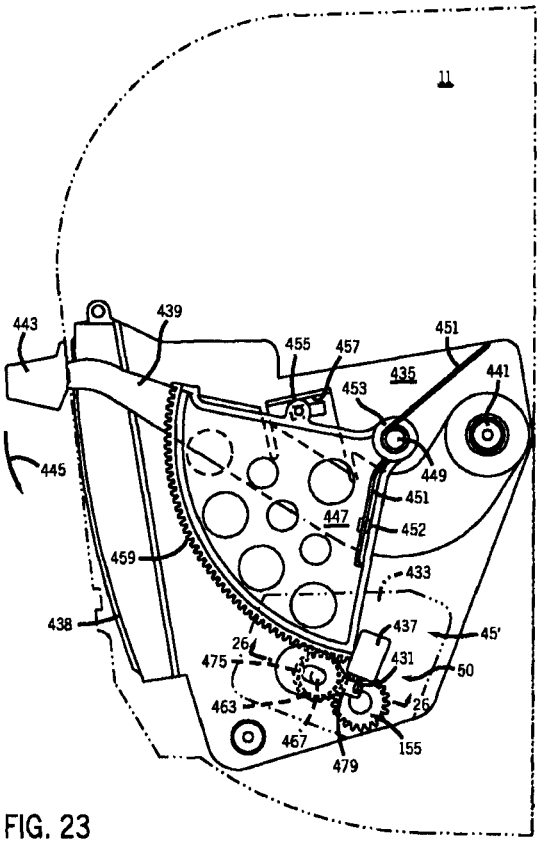
Figure 24:
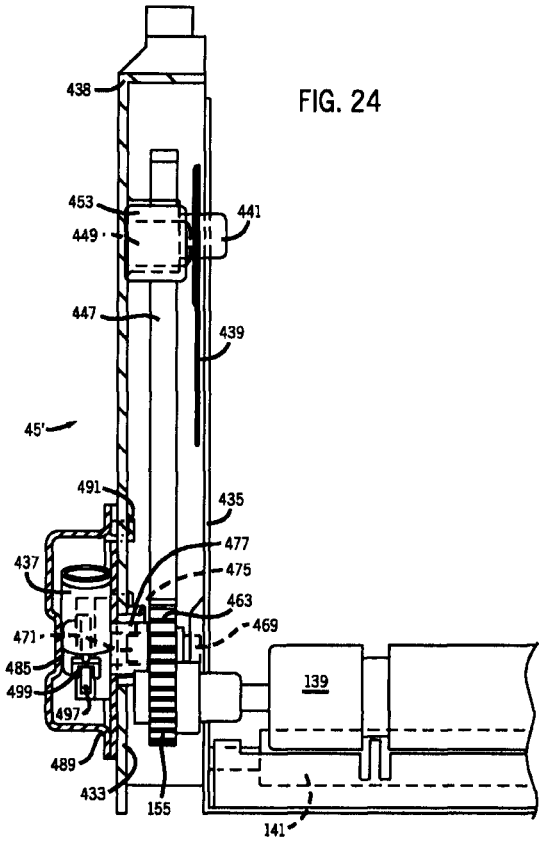
Figure 25:
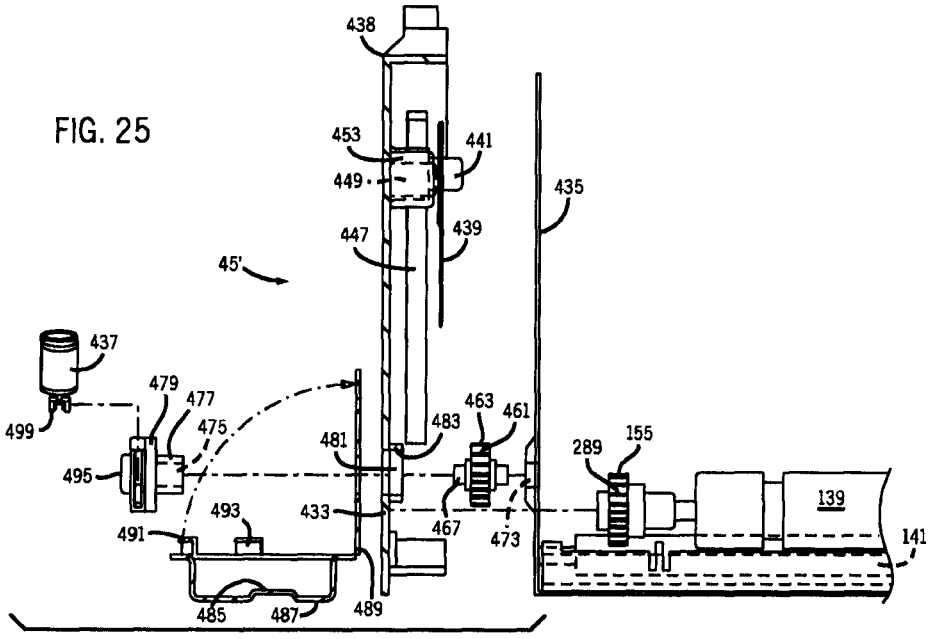

The specific CoreCheck routine will vary depending on the dispenser type or mechanical structure. For example, the CoreCheck for the motor-driven dispenser 1 can be performed using an optically-based CoreCheck routine (FIG. 34E) or, alternatively, a cover-switch-based CoreCheck routine (FIG. 34F).

The CoreCheck step 649 will first be described with respect to the optically-based CoreCheck represented by the logic flow diagram of FIG. 34E. In this embodiment, the bar code 1019 on sheet material roll 39 will be scanned by manual rotation of the sheet material roll 39 on roll holders 135, 137 as described in detail herein.

Most typically, the material-recognition apparatus 10 is not in a state where it is reading a bar code 1019 on a sheet material roll 41. Accordingly, the answer to the DISPENSERSTATE=READING_CODE? decision block (step 651) is typically NO and the CoreCheck counter is decremented from 50 to 0 (step 653). (As part of the initialization of step 621, the CoreCheck counter is set to 50.) If the CoreCheck counter is ≠0 as determined at step 655, the CoreCheck cycles to the RETURN state 617 which is the terminal point of the timed interrupt cycle. If the dispenser is reading a bar code 1019 when it enters the CoreCheck routine, the logic loops immediately to RETURN state 617. When CORECHECK=0 as determined in step 655, 500 milliseconds have elapsed since the previous CoreCheck (step 649). The CoreCheck timer is then reset to 50 (step 657).

Once the timer decrements to 0 (step 655) and the CoreCheck counter is reset to 50 (step 657), microcontroller 403 initiates a series of steps designed to recognize whether the sheet material roll 41 has been replaced since the previous CoreCheck. In step 659, a check is conducted to determine whether the phototransistor 481 has detected ambient light conditions. Detection of ambient light would occur only if the core 1005 of roll 41 had been removed from the roll holders 135, 137 since the core 1005 shields sensor apparatus 138 from ambient light when mounted on the roll holders 135, 137. Such detection of ambient light would occur upon removal of a core 1005 of sheet material roll 41 or 1003 following depletion of its sheet material 1001.

If the phototransistor 481 has detected ambient light (step 659), and the dispenser 1 is in the DISPENSERSTATE=READY? state as determined at step 661, then this condition indicates the first detection of the core 1005 having been removed from the roll holders 135, 137. In response, the dispenser state is set to INVALID_ CORE (step 663) disabling the dispenser as described above.

If the answer to step 659 is NO, then the IR LED 479 is turned on (step 665) to conduct a second test to determine whether the phototransistor 531 is detecting light (step 667). As shown in FIG. 31 (and FIGS. 32–33 for the other embodiments), under microcontroller 403 control, current is supplied to the IR LED 529 through resistor 569 ("R10"). To conserve battery power, current is supplied to the IR LED 529 only when the microcontroller 403 is checking for the presence of the core 1005 or is reading the bar code. During the CoreCheck routine (step 649), microcontroller 403 pin 9 is programmed as an input, which electronically removes resistor 571 ("R2") from the circuit. The high resistance of resistor 573 ("R1") converts the low-level current from the phototransistor 531 to an appropriate voltage level.

The phototransistor 531 responds to optical energy reflected from the core 1005 indicative of the roll 41 being in place on the roll holders 135, 137. If the phototransistor 531 is not detecting light at step 667, then that event would indicate that the sheet material roll 41 mounted on roll holders 135, 137 is not in place on roll holders 135, 137 (i.e., the roll 41, 1003 has been removed from the roll holders). If the dispenser 1 was previously in the state DISPENSERSTATE=READY? as determined at step 661, then failure to detect light would cause the microcontroller 403 to place the dispenser 1 in the DISPENSERSTATE=INVALID_CORE state (step 669) disabling the dispenser 1. The CoreCheck then cycles to RETURN (FIG. 34C, Step 617) ending the timed interrupt cycle.

If the answer to the second PHOTOTRANSISTOR DETECTING LIGHT? step 667 is YES, then the material-recognition apparatus 10 knows that it is now attempting to identify a sheet material roll 41, 1003. The microcontroller 403 determines whether the dispenser state is set to DISPENSERSTATE=INVALID_CORE (step 669). If the dispenser state is not INVALID_CORE, the microcontroller 403 exits the CoreCheck routine and loops to RETURN (step 617). If the dispenser state is INVALID_CORE, then the dispenser state is set at step 671 to read and verify the bar code 1019 as illustrated in FIG. 34A by steps 601–615 previously described. Step 671 includes setting the dispenser state to DISPENSERSTATE=READING_CODE and enabling the PHOTOTRANSISTOR INTERRUPT (point 601).

Manual rotation of sheet material roll 41 by the attendant generates a series of phototransistor interrupt signals to be received at point 601 of FIG. 34A. If the sheet material roll 41 is recognized by the material recognition apparatus 10, then the dispenser is ready to dispense, and is ready for the optional material transfer event as described below.

Cover-Switch-Based CoreCheck

Reference will now be made to FIG. 34F for purposes of describing the CoreCheck routine (steps 673–677) for the motor-driven embodiment 1 including the optional cover interlock switch 493. There are two differences between the cover-switch-based CoreCheck embodiment and the optically-based CoreCheck embodiment previously described. First, a cover interlock switch 541 (FIG. 29) is used to detect the closing of the cover 17. Closing of switch 541 represents the possibility that a full sheet material roll 41 has been loaded on roll holders 135, 137. Thus, the cover switch replaces the sensing of ambient light (steps 659 and 667) described in connection with the optically-based CoreCheck. The CoreCheck step 649 represents a polling process repetitively conducted to determine the cover switch 541 has been closed.

Second, motor 267 is used to rotate sheet material roll 41 to read the bar code 1019. A consequence is that the transfer mechanism 227 is not used as the sheet material roll 41 must be mounted on roll holders 135, 137 with sheet material 1001 pulled through nip 157 in order to scan bar code 1019.

For convenience, and because the relevant mechanical components are identical in structure and operation, reference will be made to the motor-driven dispenser 1 of FIGS. 29–30 to explain the operation of the cover-switch-based CoreCheck routine. It is to be understood that the stub roll 39 would not be present on cradle 119 in such a dispenser embodiment 1.

The cover-switch-based CoreCheck routine has the following logic. The front cover 17 is opened to replace a depleted sheet material roll (i.e., roll 41) mounted on roll support 109. After loading of a full sheet material roll 41 on roll holders 135, 137, the sheet material 1001 is then positioned over drive roller 139 in contact with drive roller segments 143–147. Thereafter, cover 17 is closed as shown in FIG. 3. Movement of cover 17 to the closed position of FIG. 3 causes the leaf springs 213, 215 mounted on the roller frame 173 to come in contact with the inside of cover 17 resiliently to urge the tension roller 141 into contact with sheet material 1001 from sheet material roll 41 thereby ensuring frictional contact between the sheet material 1001 and the drive roller 139 and, more particularly, drive roller segments 143–147. The dispenser 1 is now loaded and ready for recognition of the full sheet material roll 41.

In CoreCheck step 673 the microcontroller 403 first determines whether the cover switch 541 is open or closed as represented by the decision block COVER SWITCH=OPEN? An open switch 541 would indicate that the dispenser cover 17 is open for purposes of loading a replacement roll of sheet material 41 or other service-related reasons. The consequence of a determination that the switch 541 is open is the setting of the dispenser state to INVALID_CODE in step 675. Setting of the dispenser to the INVALID_CODE state corresponding to opening of switch 541 places the dispenser 1 in the disabled state incapable of dispensing sheet material 1001.

The consequences of determining that the cover switch 541 is closed are the events shown as step 677 as follows. The dispenser state is set to READING_CODE; the PHOTOTRANSISTOR INTERRUPT is enabled; the motor 267 is turned on; and the motor timer (i.e., counter) is set to 150. As a consequence of the settings of step 677, the dispenser 1 is now ready for the material-recognition steps of FIG. 34A (Steps 603–615). The motor timer being set to a count of 150 represents operation of the motor 267 and drive roller 139 for 1.5 seconds drawing sheet material 1001 through nip 157 to rotate sheet material roll 41 permitting the code 1019 to be read as the core 1005 rotates within the field of sensor 138. The motor 267 is turned off in step 645.

In FIG. 34F, steps 679–689 illustrate debouncing logic common to many microcontroller systems to which mechanical switches are attached and are well-known to people of skill in the art. The consequence of the debouncing logic is a reliable determination of the state of the cover switch 541.

If the sheet material roll 41 is recognized by the material recognition apparatus 10, in steps 601–617, then the dispenser 1 is placed in the dispenser-enabled state ready to dispense. The dispenser will dispense until such time as sheet material 1001 from roll 41 is depleted. The dispenser will be set in the dispenser-disabled state terminating further dispensing when cover switch 541 is open indicating that the cover 17 is open for purposes of replacing the roll 41.

Manually-Driven Dispenser Embodiments

FIG. 34D shows the steps of material recognition and dispensing utilizing the material-recognition apparatus 10, but with the manually-driven embodiment 3 including an interlock device 50 incorporating a latching solenoid 437 or interlock motor 503.

Referring then to FIG. 34D, the material identification process begins with a 10 MILLISECOND INTERRUPT step 629. Such step 629 occurs every 10 milliseconds during the sleep mode described in connection with step 625 of FIG. 34B.

As an optional initial step 691 of the timed interrupt cycle, the microcontroller 403 first determines whether the battery power is above a predetermined threshold voltage represented by the decision block +6V DC OK? If the voltage is 4.5V or less then microcontroller 403 activates the latching solenoid 437 or reversible interlock motor 503 to the disable position in step 693.

The previous dispense state is set to the current dispense state at block 695.

Microcontroller 403 adjusts the LED blink rate (Step 647) to the more rapid blink rate to indicate that the dispenser 3 is disabled. Subsequently, the optically-based CoreCheck routine (Step 649) is conducted as described in connection FIG. 34E for the motor-driven dispenser 1. Microcontroller 403 then cycles to RETURN (Step 617) and returns to SLEEP MODE (step 625) as described in FIG. 34B ending the timed interrupt events.

Referring further to FIG. 34D, if the voltage is above the 4.5V threshold voltage, then microcontroller 403 determines at step 697 whether the dispenser 3 is ready to dispense, or is not ready to dispense, as represented by the decision block DISPENSE STATE=READY? The latching solenoid 437 or reversible interlock motor 503 are activated to the enable position (step 699) when the dispenser 3 is in the READY state but was previously in a state other than READY as determined in step 703. As described herein, movement of the latching solenoid 437 or reversible interlock motor 503 to the enabled position could represent movement of a free-wheel gear 463 into a position permitting engagement with drive gear 155 (FIGS. 23–28) or movement of a locking armature 431 to a position unlocking the push bar 409 (FIGS. 21–22). The latching solenoid 437 or reversible interlock motor 503 are activated to the disabled position (Step 701) when the dispenser 3 is in a state other than READY state but was previously in the READY state as determined by step 705.

Both of these logical branches lead to steps 695, 647 and 649 as described above. Microcontroller 403 then cycles back to the RETURN state 617.

If the sheet material roll 41 is recognized by the material recognition apparatus 10, following manual rotation of roll 41, then the dispenser 3 is ready to dispense, and is ready for the optional material transfer event as described below.

Dispensing Cycles and Optional Material Transfer Event

Following material recognition with the motor-driven or manually-driven dispensers 1, 3 including the optically-based CoreCheck routine, the following steps place the dispenser 1, 3 in condition for operation. Subsequent to recognition of the sheet material roll 41, LED indicator 539 is adjusted to blink at the slower blink rate indicating that the dispenser 1 is in the enabled condition and is ready for operation. The stub roll 39 rests on cradle 119 with sheet material 1001 resting over drive roller 139 in contact with drive roller segments 143–147. Sheet material 1001 from roll 41 is urged onto catch 256 which pierces through the sheet material 1001. Sheet material 1001 is further led under pins 259, 261 to hold sheet material 1001 in place on the mechanism 227 as shown in FIG. 26. Mechanism surface 250 rests against sheet material 1001. Surface 250 will ride along sheet material 1001 without tearing or damaging material 1001 as it is dispensed.

The cover 17 is then closed (i.e., the cover position shown in FIG. 3). Movement of cover 17 to the closed position causes the leaf springs 213, 215 mounted on the roller frame 173 to come in contact with the inside of cover 17 resiliently to urge the tension roller 141 into contact with sheet material 1001 from roll 39 thereby ensuring frictional contact between the sheet material 1001 and the drive roller 139 and, more particularly, drive roller segments 143–147.

After one or more dispensing cycles, sheet material 1001 from stub roll 39 will be depleted. Upon passage of the final portion of stub roll 39 sheet material 1001 through nip 157, transfer surface 250 will come into direct contact with arcuate surface 257 of drive roller 139. Frictional engagement of drive roller segment 145 and surface 250 causes mechanism 227 to pivot rearwardly and slide up along slots 237, 239. Movement of mechanism 227 as described brings teeth 253 along arcuate surface 251 into engagement with drive roller segment 145. Engagement of teeth 253 with the frictional surface of segment 145 forcefully urges sheet material 1001 from roll 41 held on catch 256 into contact with drive roller arcuate surface 257 causing sheet material 1001 to be urged into nip 157 resulting in transfer to roll 41 as shown in FIG. 27. Following the transfer event, mechanism 227 falls back to the position shown in FIG. 27. Thereafter, sheet material 1001 from recognized roll 41 is dispensed until depleted or until such time as the sheet material rolls are replenished as described above.

Those of skill in the art will readily understand that material-recognition apparatus 10 may be used in conjunction with sheet material dispensers of types other than dispensers 11 and 13. And, the specific form of the electromechanical or mechanical apparatus comprising the material-recognition apparatus 10 may vary. The material-recognition apparatus 10 of the invention may be made of any suitable material or combination of materials as stated above. Selection of the materials will be made based on many factors including, for example, specific purchaser requirements, price, aesthetics, the intended use of the dispenser and the environment in which the dispenser will be used.

While the principles of this invention have been described in connection with specific embodiments, it should be understood clearly that these descriptions are made only by way of example and are not intended to limit the scope of the invention.

What is claimed is:

1. A dispenser apparatus for dispensing sheet material from a roll of the type including a housing, a roll support supporting the roll for rotation within the housing, a discharge apparatus and a drive apparatus powering the discharge apparatus to discharge the sheet material from the dispenser, the improvement comprising:

a sensor mounted in the housing, said sensor being positioned to read a code associated with the roll and generate a code signal corresponding to the code;

a control circuit operatively connected to the sensor, said control circuit being adapted to (a) receive the code signal, (b) compare the code represented by said code signal to at least one code in a code database, and (c) set a dispenser-enabled state in which the dispenser is enabled corresponding to agreement between the codes and a dispenser-disabled state in which the dispenser is disabled when no such agreement exists; and power supply apparatus adapted to supply electrical energy to the sensor and control circuit.

2. The dispenser of claim 1 wherein the roll-associated code comprises a bar code.

3. The dispenser of claim 2 wherein the roll is wound on a core, said core including an axial length, inner and outer surfaces and a pair of ends, and the bar code is located on the core inner surface.

4. The dispenser of claim 3 wherein:

the roll support comprises a pair of opposed roll holders each adapted to support a respective core end; and the sensor is mounted on at least one of the roll holders.

5. The dispenser of claim 1 wherein the sensor comprises:

an optical source adapted to direct optical energy toward the roll-associated code; and an optical detector adapted to receive the optical energy from the roll-associated code and generate the code signal corresponding to the roll-associated code.

6. The dispenser of claim 5 wherein:

the optical source includes an infrared-emitting diode; and the optical detector includes a phototransistor adjacent the diode.

7. The dispenser of claim 1 wherein:

the discharge apparatus comprises a tension roller rotatably mounted with respect to the housing and a drive roller rotatably mounted with respect to the housing and tension roller, said drive and tension rollers forming a nip therebetween; and the drive apparatus is in power-transmission relationship with the drive roller, said drive apparatus rotatably powering the drive roller such that the sheet material moves through the nip for discharge from the dispenser.

8. The dispenser of claim 7 further comprising:

an electric motor in power-transmission relationship with the drive roller, said electric motor powering the drive apparatus and drive roller;

an input device responsive to a user, said input device triggering electric motor operation if the dispenser is in the dispenser-enabled state; and the control circuit affects the electric motor such that, in the dispenser-enabled state, electric motor operation is triggered responsive to a signal from the input device and, in the dispenser-disabled state, the electric motor is disabled.

9. The dispenser of claim 8 wherein the control circuit includes a microcontroller programmed to perform the code comparison and to enable the electric motor based on agreement between the codes and disable the electric motor when no such agreement exists.

10. The dispenser of claim 7 further comprising:

a manually-driven drive apparatus in power-transmission relationship with the drive roller such that the drive roller rotates responsive to the manually-driven drive apparatus; and an interlock device operatively connected to the control circuit, said interlock device being adapted to respond to the setting of the state such that, in the dispenser-enabled state the manually-driven drive apparatus is operational and, in the dispenser-disabled state, the manually-driven drive apparatus is disabled.

11. The dispenser of claim 10 wherein the manually-driven drive apparatus comprises:

a manually-operated contact member including a user-contact portion and an input gear; and a gear train in power-transmission relationship with the contact member and drive roller such that the drive roller rotates responsive to movement of the contact member.

12. The dispenser of claim 11 wherein:

the gear train includes a free-wheel gear mounted for movement between a gear-engagement position in which the contact member is connected to the drive roller through the gear train enabling the contact member to power the drive roller and a gear-disengagement position in which the contact member is disconnected from the drive gear, thereby preventing the contact member from powering the drive roller; and the interlock device includes an electromechanical actuator in engagement with the free-wheel gear, said electromechanical actuator being adapted to move the free-wheel gear between the gear-engagement and gear-disengagement positions.

13. The dispenser of claim 12 wherein:

the interlock device includes a solenoid having an armature displaceable between a first position and a second position;

the armature is in engagement with the free-wheel gear through a linkage; and when the armature is in the first position, the free-wheel gear is in the gear-engagement position, and, when the armature is in the second position, the free-wheel gear is in the gear-disengagement position.

14. The dispenser of claim 10 wherein the interlock device comprises:

a locking pin movable between a pin-engaged position in which the locking pin disables the drive apparatus and a pin-disengaged position in which drive apparatus is operational; and an electromechanical actuator which moves the locking pin between the pin-engaged and pin-disengaged positions.

15. The dispenser of claim 14 wherein the electromechanical actuator comprises a solenoid.

16. The dispenser of claim 14 wherein the electromechanical actuator comprises an interlock motor.

17. A method of sheet material recognition enabling operation of a sheet material dispenser with sheet material from an authorized source comprising:

loading a roll of sheet material in the dispenser, the sheet material roll including a code associated therewith indicating that the sheet material from the authorized source;

sensing the code;

generating a code signal associated with the code;

receiving the code signal with a control circuit operatively connected to the sensor;

comparing the code represented by said code signal to at least one code in a code database to determine that the roll is from the authorized source; and setting a dispenser-enabled state corresponding to agreement between the codes, said agreement indicating that the roll is from the authorized source, and a dispenser-disabled state when no such agreement exists.

18. The method of claim 17 wherein the code comprises a bar code.

19. The method of claim 18 wherein the sensing step comprises the steps of:

directing optical energy toward the bar code;

rotating the roll; and receiving the optical energy from the bar code.

20. The method of claim 18 further including, before the sensing step, the step of performing a CoreCheck routine to determine whether the sheet material roll has been loaded in the dispenser in place of a stub sheet material roll previously loaded therein.

21. The method of claim 20 wherein the step of performing the CoreCheck routine comprises the steps of:

determining whether the dispenser is sensing the bar code;

if the dispenser is not sensing the bar code, detecting ambient light with an optical detector such that a detection of ambient light represents removal of the sheet material stub roll;

if ambient light is detected, placing the dispenser in a dispenser-disabled state;

if ambient light is not detected, activating an optical source adapted to direct optical energy toward the sheet material roll;

detecting the reflected optical energy with the optical detector such that (a) detection of reflected optical energy when the dispenser is previously in the dispenser-disabled state represents that the full sheet material roll has been loaded in place of the sheet material stub roll, while (b) detection of reflected optical energy when the dispenser is previously in a dispenser-enabled state represents that the sheet material stub roll remains loaded; and if the optical energy is detected and the dispenser is in the dispenser-disabled state, causing the dispenser to perform the sensing step.

22. The method of claim 21 wherein the dispenser is a motor-driven dispenser including a housing, a cover switch and a dispenser cover movable between a first position in which the dispenser is open for loading of the sheet material roll and a second position in which the dispenser is closed, and the step of performing the CoreCheck routine further comprises the steps of:

opening the cover switch responsive to moving the cover to the first position such that opening of the switch represents opening of the dispenser cover to remove the stub sheet material roll from the dispenser;

closing the cover switch responsive to moving the cover to the second position such that closing of the switch represents closing of the dispenser housing cover after a full sheet material roll has been loaded in place of the sheet material stub roll;

powering the motor for a predetermined time interval responsive to closing of the switch;

rotating the full roll by means of the motor for the predetermined time interval; and enabling the dispenser to perform the sensing step during the rotating step.

23. The method of claim 17 wherein the dispenser is a motor-driven dispenser and the method further comprises the steps of:

enabling operation of an electric motor when the dispenser-enabled state is set;

triggering operation of the enabled electric motor responsive to a user; and dispensing a length of sheet material with a drive roller powered by the electric motor.

24. The method of claim 17 wherein the dispenser is a manually-driven dispenser and the method comprises the further steps of:

generating an interlock signal based on agreement between the codes;

receiving the interlock signal with an interlock device;

setting, through the interlock device, the dispenser-enabled state; and dispensing a length of sheet material with the enabled dispenser.

25. The method of claim 24 wherein the step of setting the dispenser-enabled state comprises the further steps of:

actuating an electromechanical interlock device; and moving, through the electromechanical interlock device, a free-wheel gear to a gear-engagement position to enable a dispenser drive apparatus and set the dispenser-enabled state.

26. The method of claim 24 wherein the step of setting the dispenser-enabled state comprises the further steps of:

actuating an electromechanical interlock device; and moving, through the electromechanical interlock device, a pin to a pin-disengagement position to enable a dispenser drive apparatus and set the dispenser-enabled state.

27. A sheet material dispenser including material-recognition apparatus enabling operation of the dispenser with sheet material from an authorized source, comprising:

a dispenser housing;

a sheet material support adapted to rotatably mount a sheet material roll within the housing, said sheet material roll including sheet material wound about a core having an inner surface and a bar code located on the core inner surface;

a tension roller rotatably mounted with respect to the housing;

a drive roller rotatably mounted with respect to the housing and tension roller, said drive and tension rollers forming a nip therebetween;

drive apparatus in power-transmission relationship with the drive roller, said drive apparatus rotatably powering the drive roller such that the sheet material moves through the nip for discharge from the dispenser;

a sensor mounted on the sheet material support, said sensor being positioned to read the bar code when the core is mounted on the sheet material support and generate a code signal corresponding to a code embodied in the bar code;

a control circuit operatively connected to the sensor, said control circuit including a microcontroller adapted to (a) receive the code signal, (b) compare the code represented by said code signal to at least one code in a code database, and (c) set a dispenser-enabled state in which the dispenser is enabled corresponding to agreement between the codes and a dispenser-disabled state in which the dispenser is disabled when no such agreement exists; and power supply apparatus adapted to supply electrical energy to the sensor and control circuit.

28. The dispenser of claim 27 wherein:

the sheet material roll support comprises a pair of opposed roll holders each adapted to support a respective core end; and the sensor is mounted on at least one of the roll holders.

29. The dispenser of claim 27 wherein the sensor comprises:

an optical source adapted to direct optical energy toward the bar code; and an optical detector adapted to receive the optical energy from the bar code and generate the code signal corresponding to the bar code.

30. The dispenser of claim 29 wherein:

the optical source includes an infrared-emitting diode; and the optical detector includes a phototransistor adjacent the diode.

31. The dispenser of claim 27 further comprising:

an electric motor in power-transmission relationship with the drive roller;

an input device responsive to a user triggering motor operation if the dispenser is in the dispenser-enabled state; and the microcontroller affects the electric motor such that, in the dispenser-enabled state, motor operation is triggered responsive to a signal from the input device and, in the dispenser-disabled state, the electric motor is disabled.

32. The dispenser of claim 27 further comprising:

a manually-operated actuator in power-transmission relationship with the drive roller such that the drive roller rotates responsive to the manually-operated actuator;

an interlock device operatively connected to the control circuit, said interlock device being adapted to respond to the setting of the state such that, in the dispenser-enabled state the drive apparatus is operational and, in the dispenser-disabled state, the drive apparatus is disabled.

33. The dispenser of claim 32 wherein the manually-operated actuator comprises:

a manually-operated contact member including a user-contact portion and an input gear; and a gear train in power-transmission relationship with the contact member and drive roller such that the drive roller rotates responsive to movement of the contact member.

34. The dispenser of claim 33 wherein:

the gear train includes a free-wheel gear mounted for movement between a gear-engagement position in which the contact member is connected to the drive roller through the gear train enabling the contact member to power the drive roller and a gear-disengagement position in which the contact member is disconnected from the drive gear, thereby preventing the contact member from powering the drive roller; and the interlock device includes an electromechanical actuator in engagement with the free-wheel gear, said electromechanical actuator being adapted to move the free-wheel gear between the gear-engagement and gear-disengagement positions.

35. The dispenser of claim 34 wherein:

the interlock device includes a solenoid having an armature displaceable between a first position and a second position;

the armature is in engagement with the free-wheel gear through a linkage; and when the armature is in the first position, the free-wheel gear is in the gear-engagement position, and, when the armature is in the second position, the free-wheel gear is in the gear-disengagement position.

36. The dispenser of claim 32 wherein the interlock device comprises:

a locking pin movable between a pin-engaged position in which the locking pin disables the drive apparatus and a pin-disengaged position in which drive apparatus is operational; and an electromechanical actuator which moves the locking pin between the pin-engaged and pin-disengaged positions.

37. The dispenser of claim 36 wherein the electromechanical actuator comprises a solenoid.

38. The dispenser of claim 36 wherein the electromechanical actuator comprises an interlock motor.

39. A dispenser apparatus for dispensing sheet material from a roll of the type including a housing, a roll support supporting the roll for rotation within the housing, a discharge apparatus and a drive apparatus powering the discharge apparatus to dispense the sheet material from the dispenser, the improvement comprising:

a sensor mounted in the housing, said sensor being positioned to read a code associated with the roll and generate a code signal corresponding to the code;

a control circuit operatively connected to the sensor, said control circuit being adapted to (a) receive the code signal, (b) validate the code represented by said code signal, and (c) allow sheet material dispensing if the code is valid or not allow sheet material dispensing if the code is invalid; and power supply apparatus adapted to supply electrical energy to the sensor and control circuit.

40. The dispenser of claim 39 wherein the code comprises a bar code.

41. The dispenser of claim 40 wherein the roll is wound on a core, said core including an axial length, inner and outer surfaces and a pair of ends, and the bar code is located on the core inner surface.

42. The dispenser of claim 41 wherein:

the roll support comprises a pair of opposed roll holders each adapted to support a respective core end; and the sensor is mounted on at least one of the roll holders.

43. The dispenser of claim 39 wherein the sensor comprises:

an optical source adapted to direct optical energy toward the code; and an optical detector adapted to receive optical energy from the code and generate the code signal.

44. The dispenser of claim 43 wherein:

the optical source includes an infrared-emitting diode; and the optical detector includes a phototransistor adjacent the diode.

45. The dispenser of claim 39 wherein the discharge apparatus includes drive and tension rollers forming a nip therebetween through which the sheet material is received, the drive apparatus includes a motor powering the drive roller and the dispenser further comprises:

an input device triggering motor operation responsive to a user; and the control circuit affects the motor such that, if the code is valid, motor operation is triggered responsive to a signal from the input device and, if the code is invalid, the motor is disabled.

46. The dispenser of claim 45 wherein the control circuit includes a microcontroller adapted to:

compare the code to at least one code associated with the control circuit; and determine whether there is agreement between the codes; whereby, agreement between the codes indicates that the code is valid and non-agreement between the codes indicates that the code is invalid.

47. The dispenser of claim 46 wherein the microcontroller is further adapted to:

enable the motor for operation based on agreement between the codes; and disable the motor when no such agreement exists.

48. The dispenser of claim 39 wherein the discharge apparatus includes drive and tension rollers forming a nip therebetween through which the sheet material is received, the drive apparatus includes a manually-driven drive apparatus powering the drive roller and the dispenser further comprises an interlock device operatively connected to the control circuit, said interlock device enabling operation of the manually-driven drive apparatus if the code is valid and disabling operation of the manually-driven drive apparatus if the code is invalid.

49. The dispenser of claim 48 wherein the manually-driven drive apparatus further comprises:

a manually-operated lever including a user-contact portion and an input gear;

at least one gear in power-transmission relationship with the input gear and drive roller, said at least one gear including a free-wheel gear mounted for movement between a gear-engagement position in which the input gear and drive roller are in the power-transmission relationship and a gear-disengagement position in which the input gear and drive roller are not in power-transmission relationship; and the interlock device includes an actuator in engagement with the free-wheel gear, said actuator being adapted to move the free-wheel gear between the gear-engagement and gear-disengagement positions.

50. The dispenser of claim 49 wherein:

the actuator includes an armature displaceable between a first position and a second position;

the armature is in engagement with the free-wheel gear through a linkage; and when the armature is in the first position, the free-wheel gear is in the gear-engagement position, and, when the armature is in the second position, the free-wheel gear is in the gear-disengagement position.

51. The dispenser of claim 48 wherein the interlock device comprises:

a locking pin movable between a pin-engaged position in which the locking pin disables the manually-driven drive apparatus and a pin-disengaged position in which the manually-driven drive apparatus is operational; and an actuator which moves the locking pin between the pin-engaged and pin-disengaged positions.

52. The dispenser of claim 51 wherein the actuator is selected from the group consisting of a linear actuator and an interlock motor.

53. A method of controlling operation of a sheet material dispenser comprising:

loading a roll of sheet material in the dispenser, the sheet material roll including a code associated therewith;

sensing the code;

validating the code; and controlling dispenser operation by allowing sheet material dispensing if the code is valid or not allowing sheet material dispensing if the code is invalid.

54. The method of claim 53 wherein the code comprises a bar code and the sensing step comprises the steps of:

directing optical energy toward the bar code;

rotating the roll; and receiving, with a sensor, optical energy reflected from the bar code.

55. The method of claim 53 wherein the code comprises one or more of the group consisting of a linear optical array, a static bar code, a static symbol, an RFID code and an electrically-conductive code and the sensing step comprises receiving, with a sensor, a signal corresponding to detection of the code.

56. The method of claim 53 wherein the validating step comprises:

comparing the code to at least one code associated with a control circuit; and determining whether there is agreement between the codes;

whereby, agreement between the codes indicates that the code is valid and non-agreement between the codes indicates that the code is invalid.

57. The method of claim 53 wherein the dispenser includes a discharge apparatus including drive and tension rollers forming a nip therebetween through which the sheet material is received and a drive apparatus including a motor powering the drive roller, and the controlling step further comprises the steps of:

enabling the motor for operation if the code is valid; or disabling the motor if the code is invalid.

58. The method of claim 53 wherein the dispenser includes a discharge apparatus including drive and tension rollers forming a nip therebetween through which the sheet material is received and a manually-powered drive apparatus for powering the drive roller, and the method further comprises the steps of:

generating an interlock signal if the code is valid;

receiving the interlock signal with an interlock device; and setting, through the interlock device, a dispenser-enabled state in which the manually-powered drive apparatus is operational to power the drive roller.

59. The method of claim 58 wherein the interlock device comprises an electromechanical interlock device and the step of setting the dispenser-enabled state comprises the further steps of:

actuating the electromechanical interlock device; and moving, through the electromechanical interlock device, a free-wheel gear to a gear-engagement position such that the manually-powered drive apparatus is in power-transmission relationship with the drive roller.

60. The method of claim 59 wherein the interlock device comprises an electromechanical interlock device having a pin movable between positions of engagement and disengagement with the manually-powered drive apparatus, and the step of setting the dispenser-enabled state comprises the further steps of:

actuating the electromechanical interlock device; and moving, through the electromechanical interlock device, the pin to a pin-disengagement position such that the manually-powered drive apparatus is operational to power the drive roller.

61. The method of claim 53 further comprising the step of, if the code is valid, powering the drive roller to dispense a length of sheet material from the dispenser.

62. The method of claim 53 further including the step of performing a CoreCheck routine to determine whether the roll is loaded in the dispenser.

63. The method of claim 62 wherein the CoreCheck routine comprises the steps of:

determining whether the dispenser is sensing the bar code;

if the dispenser is not sensing the bar code, detecting ambient light with the sensor such that detection of ambient light represents removal of the roll;

if ambient light is detected, placing the dispenser in a dispenser-disabled state;

if ambient light is not detected, activating an optical source adapted to direct optical energy toward the roll;

detecting optical energy reflected from the roll with the sensor such that (a) detection of reflected optical energy when the dispenser is previously in a dispenser-disabled state represents that the roll has been loaded subsequent to a preceding CoreCheck routine, while (b) detection of reflected optical energy when the dispenser is previously in a dispenser-enabled state represents that the roll was loaded prior to the preceding CoreCheck routine; and if the optical energy is detected and the dispenser is in the dispenser-disabled state, causing the dispenser to perform the sensing step.

64. The method of claim 63 wherein the dispenser is a motor-driven dispenser including a housing, a cover switch and a dispenser cover movable between a first position in which the dispenser is open for loading of the roll and a second position in which the dispenser is closed, and the step of performing the CoreCheck routine further comprises the steps of:

opening the cover switch responsive to moving the cover to the first position;

closing the cover switch responsive to moving the cover to the second position;

powering the motor for a predetermined time interval responsive to closing of the switch;

rotating the roll by means of the motor for the predetermined time interval; and sensing the code during rotating of the roll.

65. A sheet material dispenser comprising:

a housing adapted to receive sheet material, said sheet material having a machine-readable code associated therewith;

a sensor mounted with respect to the housing, said sensor being adapted to read the code and generate a code signal corresponding to the code;

a control circuit operatively connected to the sensor, said control circuit being adapted to (a) receive the code signal, (b) validate the code represented by said code signal, and (c) allow sheet material dispensing if the code is valid or not allow sheet material dispensing if the code is invalid; and a power source adapted to supply electrical energy to the dispenser.

66. The dispenser of claim 65 wherein the housing is adapted to receive the sheet material in the form of a roll wound about a core and the code is associated with the core.

67. The dispenser of claim 66 wherein the code is a bar code and the sensor is adapted to read the bar code.

68. The dispenser of claim 66 further comprising:

a tension roller rotatably mounted with respect to the housing;

a drive roller rotatably mounted with respect to the housing and tension roller, said drive and tension rollers forming a nip therebetween;

drive apparatus in power-transmission relationship with the drive roller, said drive apparatus rotatably powering the drive roller such that the sheet material moves through the nip for dispensing from the dispenser; and the control circuit affects the drive apparatus such that the drive apparatus is enabled if the code is valid.

69. The dispenser of claim 68 wherein the control circuit further includes a microcontroller adapted to (a) compare the code to at least one code associated with the control circuit; and (b) determine whether there is agreement between the codes;

whereby, agreement between the codes indicates that the code is valid and non-agreement between the codes indicates that the code is invalid.

70. The dispenser of claim 69 further comprising:

a motor in power-transmission relationship with the drive roller; and wherein the microcontroller is further adapted to:

enable the motor for operation based on agreement between the codes; and disable the motor when no such agreement exists.

* * * * *

UNITED STATES PATENT AND TRADEMARK OFFICE

CERTIFICATE OF CORRECTION

PATENT NO. : 7,040,566 B1
APPLICATION NO. : 10/408970
DATED : May 9, 2006
INVENTOR(S) : Rodrian et al.

It is certified that error appears in the above-identified patent and that said Letters Patent is hereby corrected as shown below:

The title page, showing an illustrative figure, should be deleted and substitute therefor the attached Title page.

Figure 4:
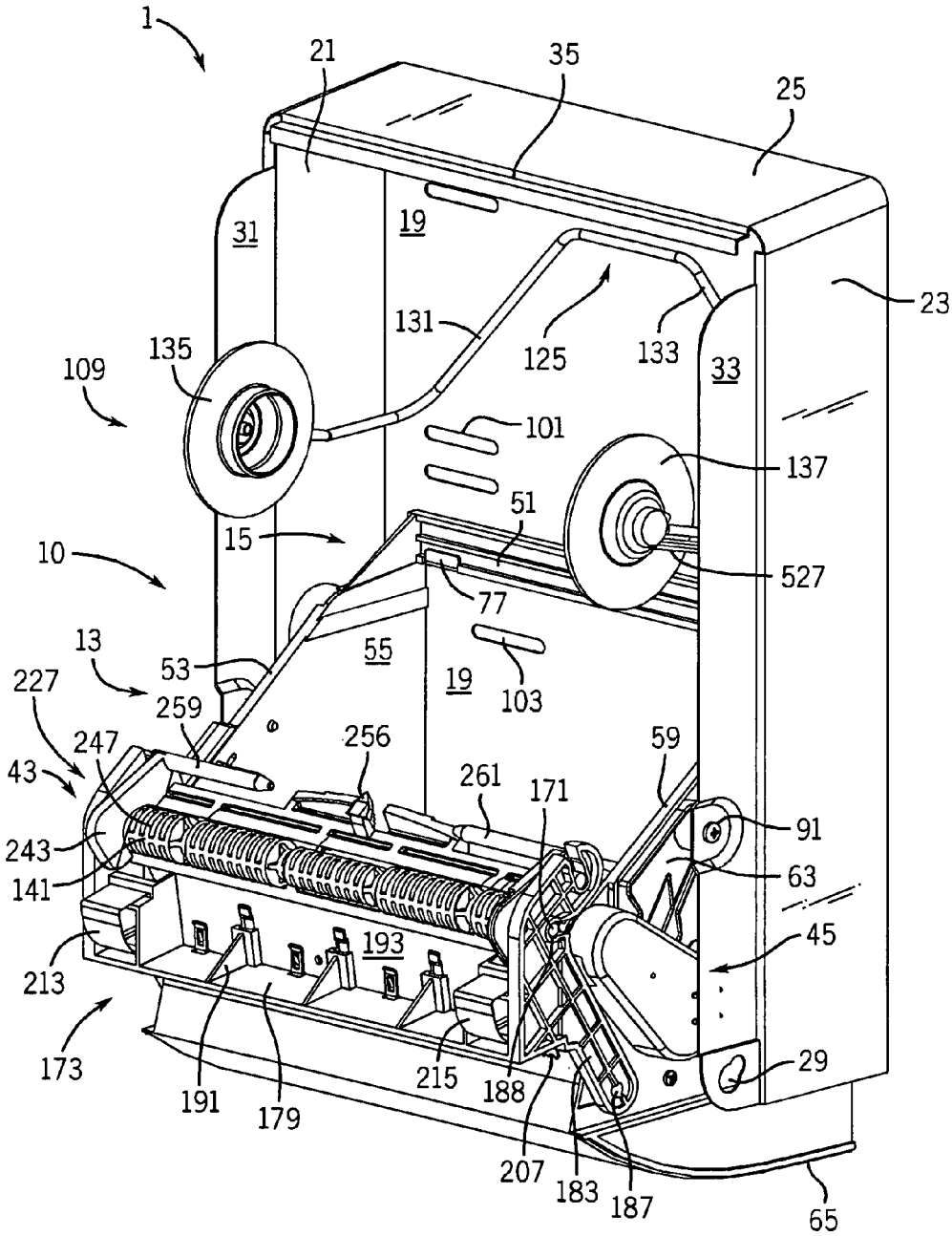
FIG. 4 is a perspective view of the dispenser of FIG. 3 with the housing cover removed.

In the drawings, sheet 4, Fig. 4, delete reference numeral "171" and replace with reference numeral --170--.

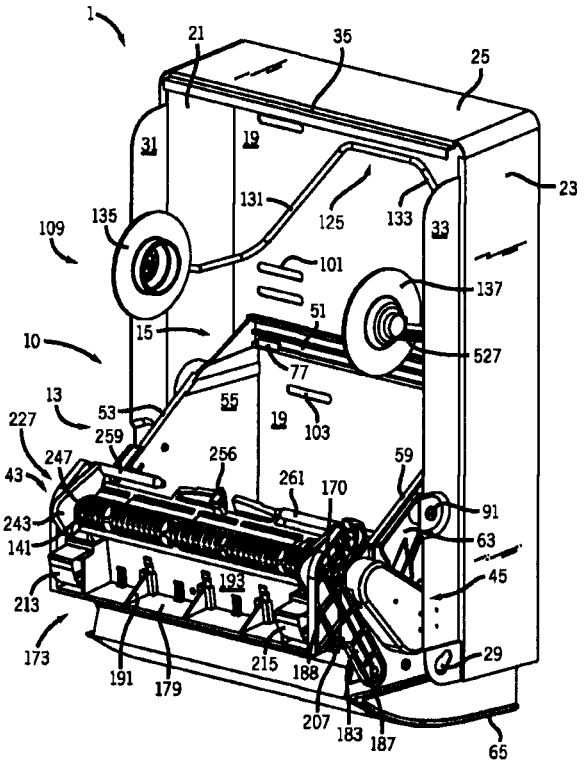

FIG. 4

Signed and Sealed this

Twenty-fifth Day of May, 2010

David J. Kappos

David J. Kappos
*Director of the United States Patent and Trademark Office*

Figure 5:
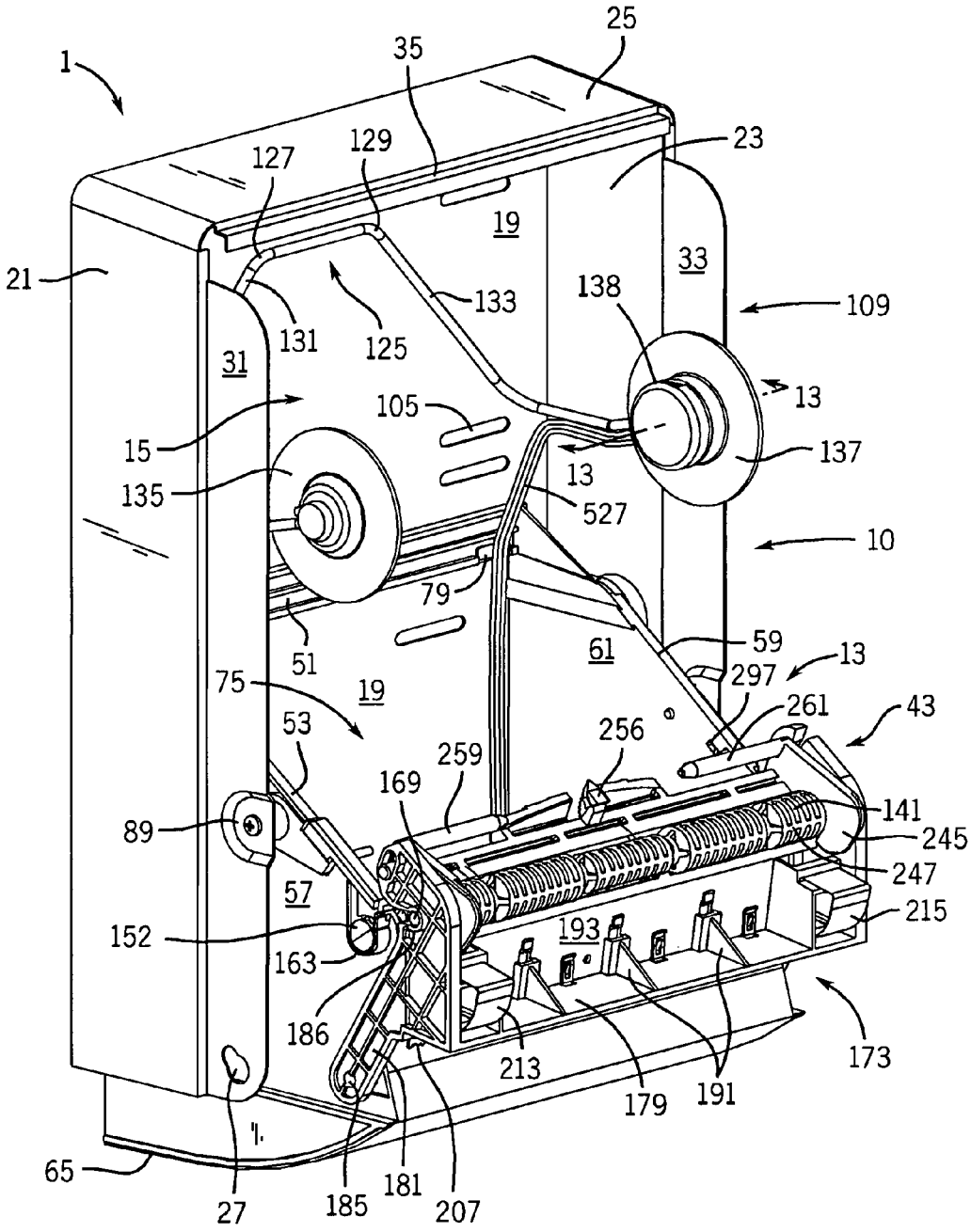
FIG. 5 is another perspective view of the dispenser of FIG. 3 also with the housing cover removed. Sensor apparatus is shown mounted to a roll holder.

In the drawings, sheet 5, Fig. 5, delete reference numeral "169" and replace with reference numeral --168--.

Figure 6:
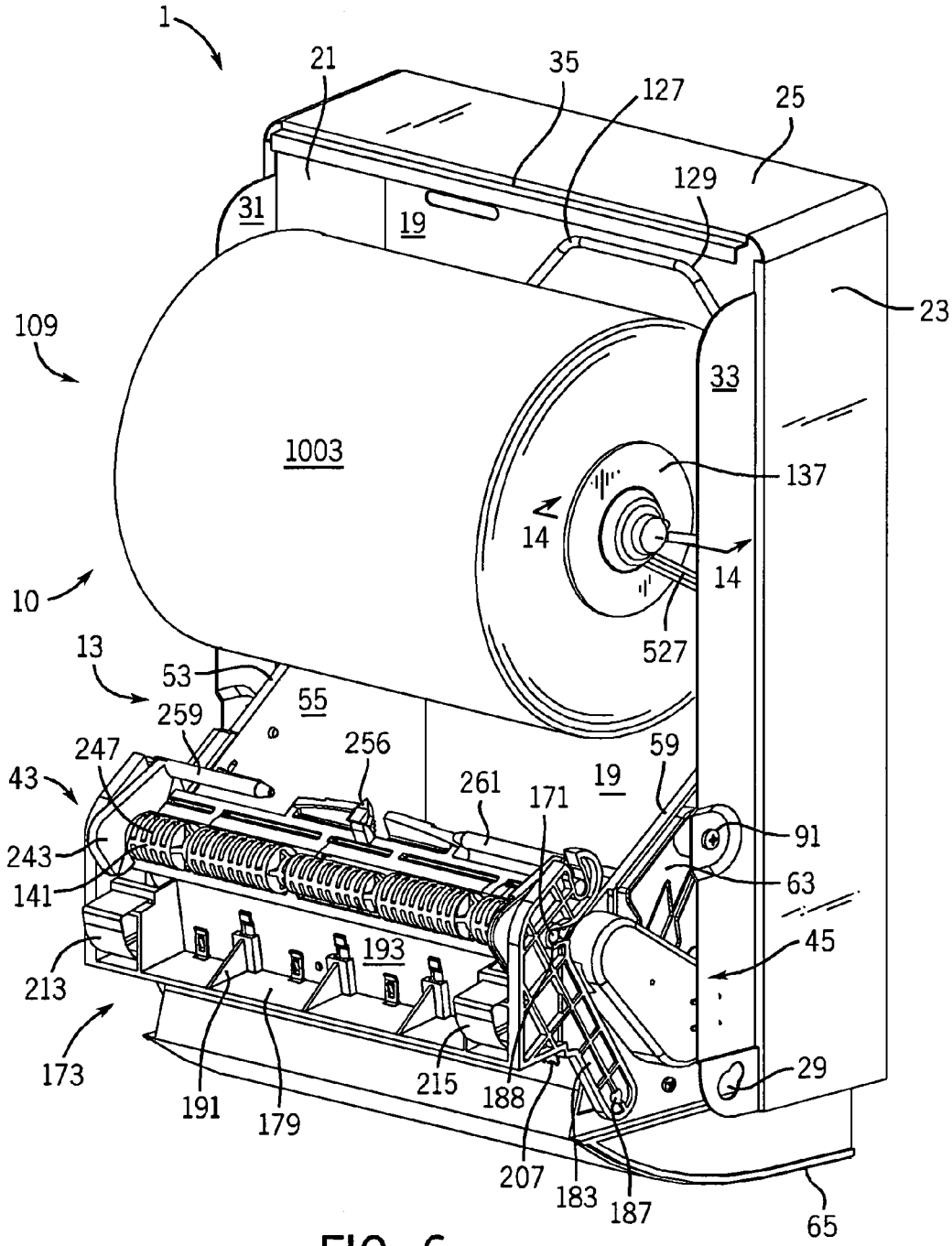
FIG. 6 is further perspective view of the dispenser of FIG. 3 but with the sheet material roll loaded.
Figure 7:
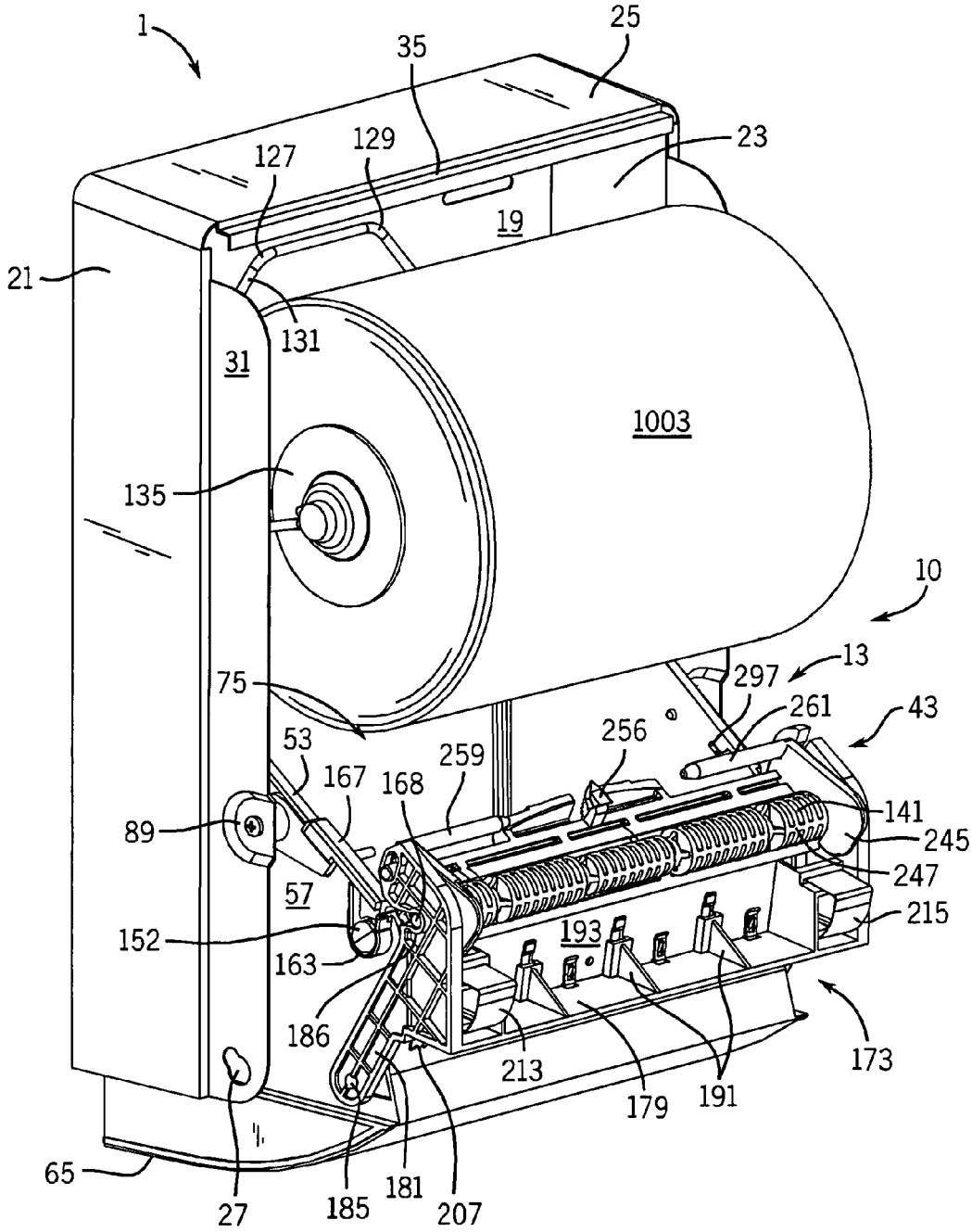
FIG. 7 is further perspective view of the dispenser of FIG. 3 including the loaded roll of sheet material.

In the drawings, sheet 6, Fig. 6, delete reference numeral "171" and replace with reference numeral --170--.

Figure 8:
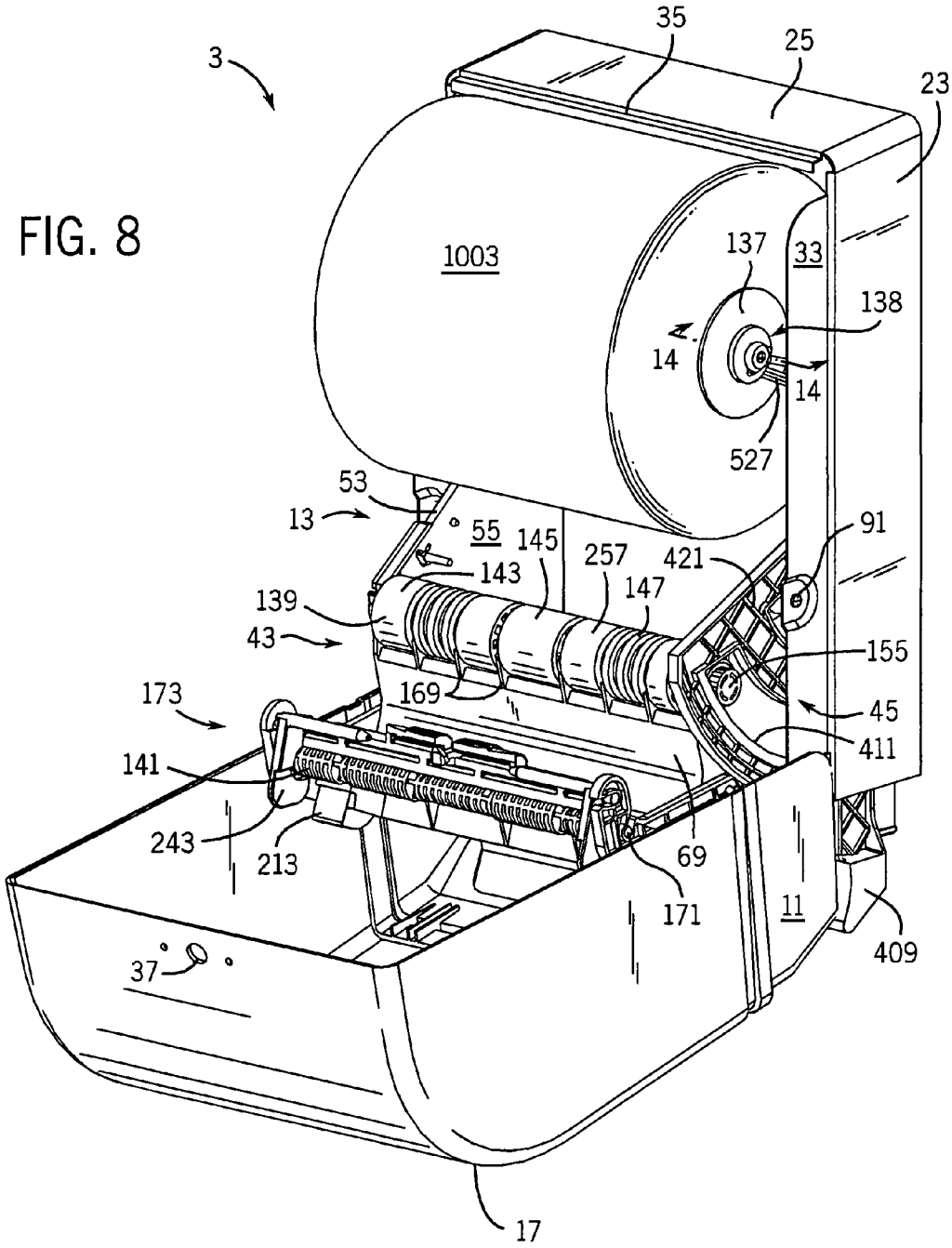
FIG. 8 is a perspective view of a manually-driven dispenser embodiment in accordance with this invention. The housing cover is shown in the open position and a roll of sheet material is loaded in the dispenser.
Figure 9:
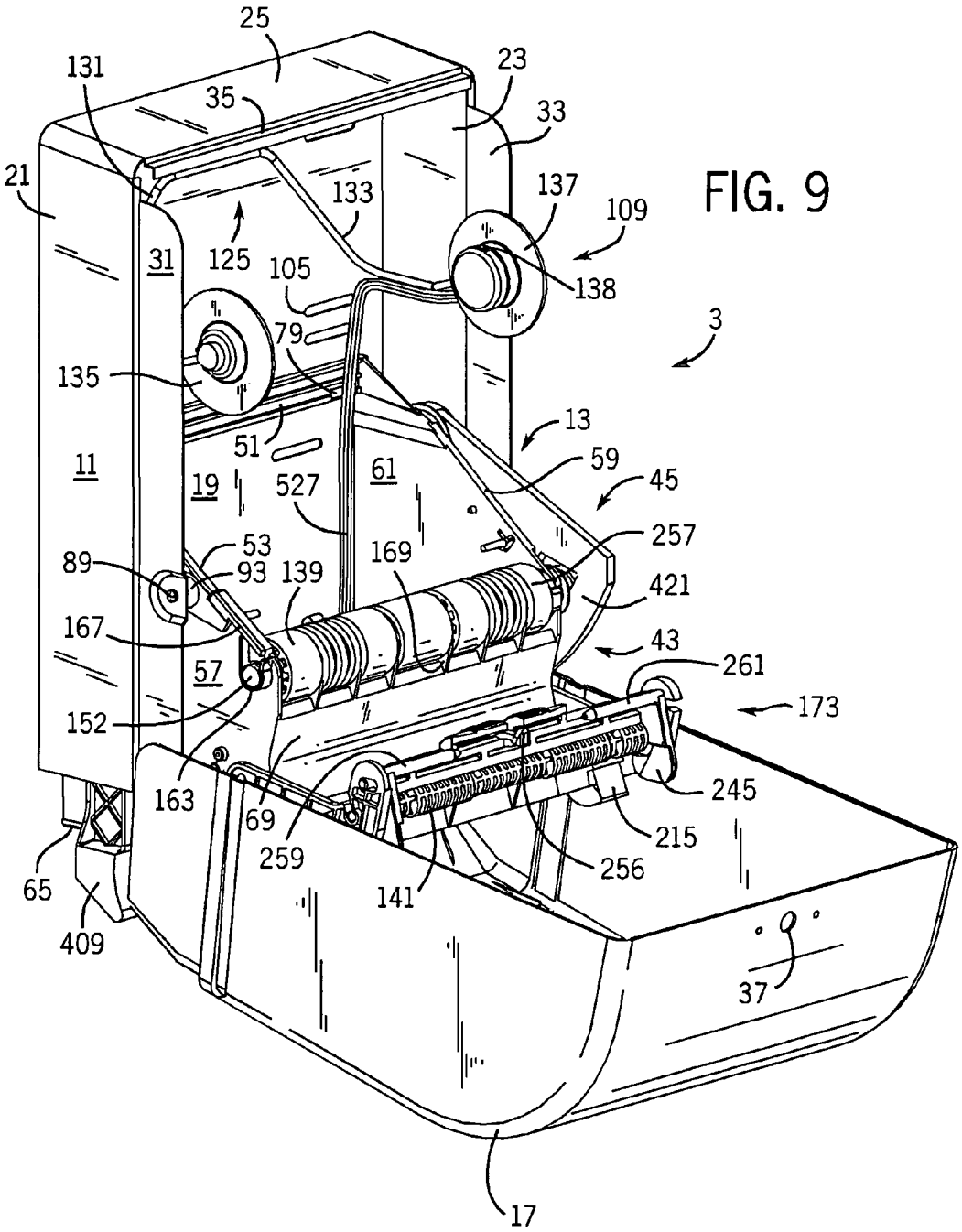
FIG. 9 is another perspective view of the dispenser of FIG. 8 with the housing cover in the open position but with the roll of sheet material removed.
Figure 10:
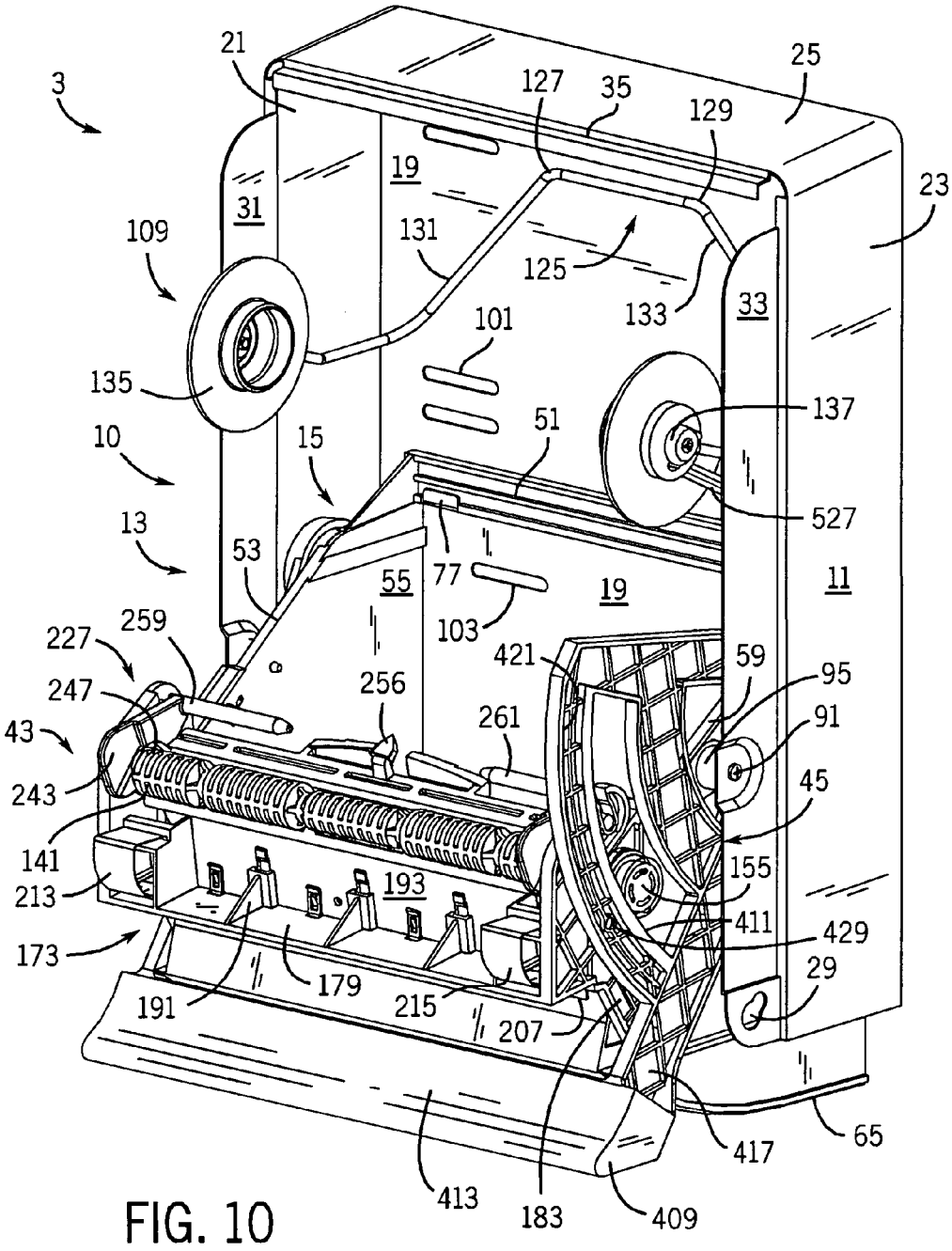
FIG. 10 is further perspective view of the dispenser of FIG. 8 but with the housing cover and sheet material roll removed.
Figure 11:
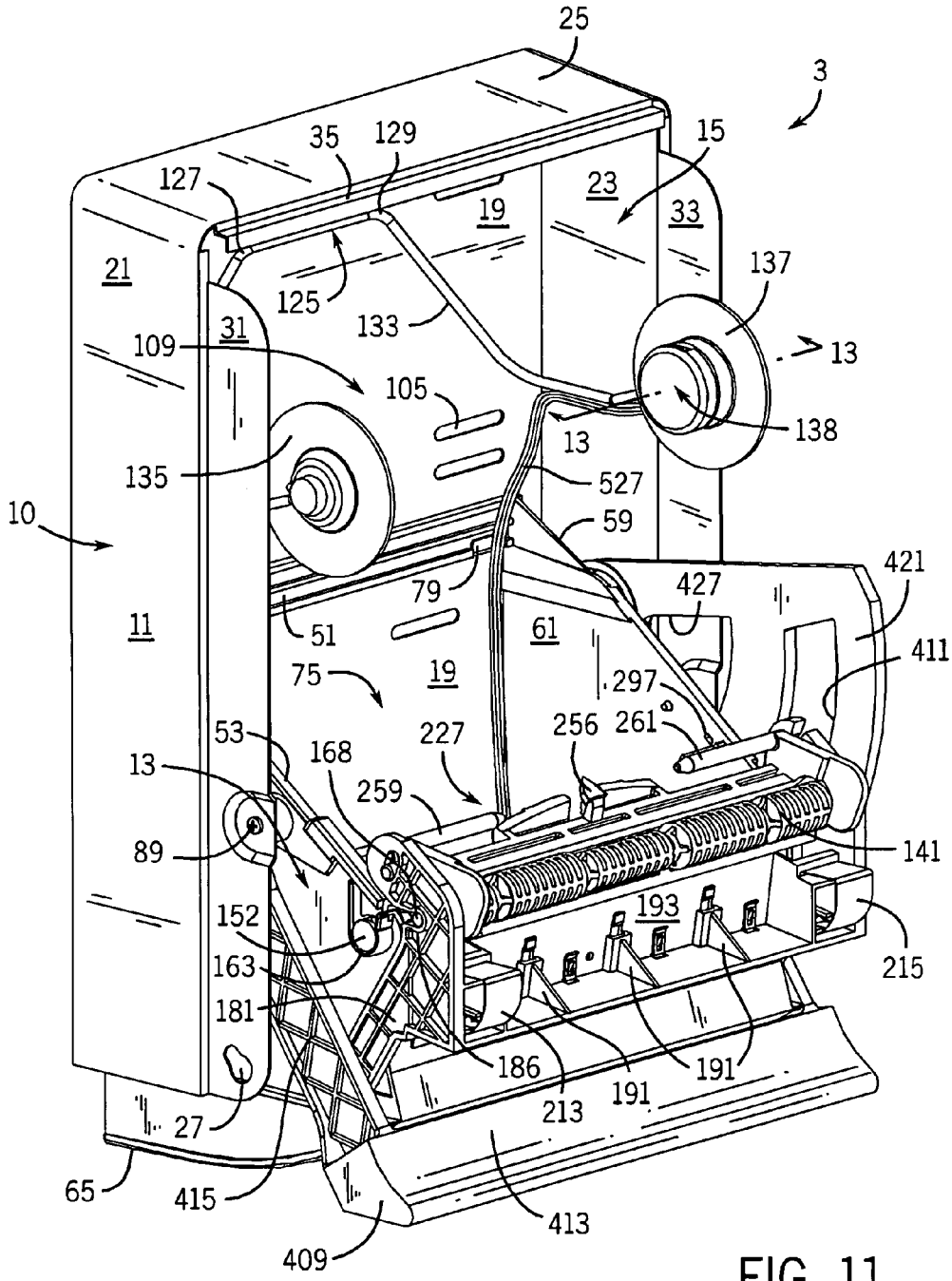
FIG. 11 is further perspective view of the dispenser of FIG. 8 but with the housing cover and sheet material roll removed. The sensor apparatus is shown mounted to a roll holder.

In the drawings, sheet 8, Fig. 8, delete reference numeral "171" and replace with reference numeral --170--.

In the drawings, sheet 15, Fig. 17, delete reference numeral "273" and replace with reference numeral --223-- and delete reference numeral "255" and replace with reference numeral --257--. Add reference numerals --349--, --353--, --355--, and --363--.

In the drawings, sheet 18, Fig. 23, delete reference numeral “437” and replace with reference numeral --438--.

Figure 24:
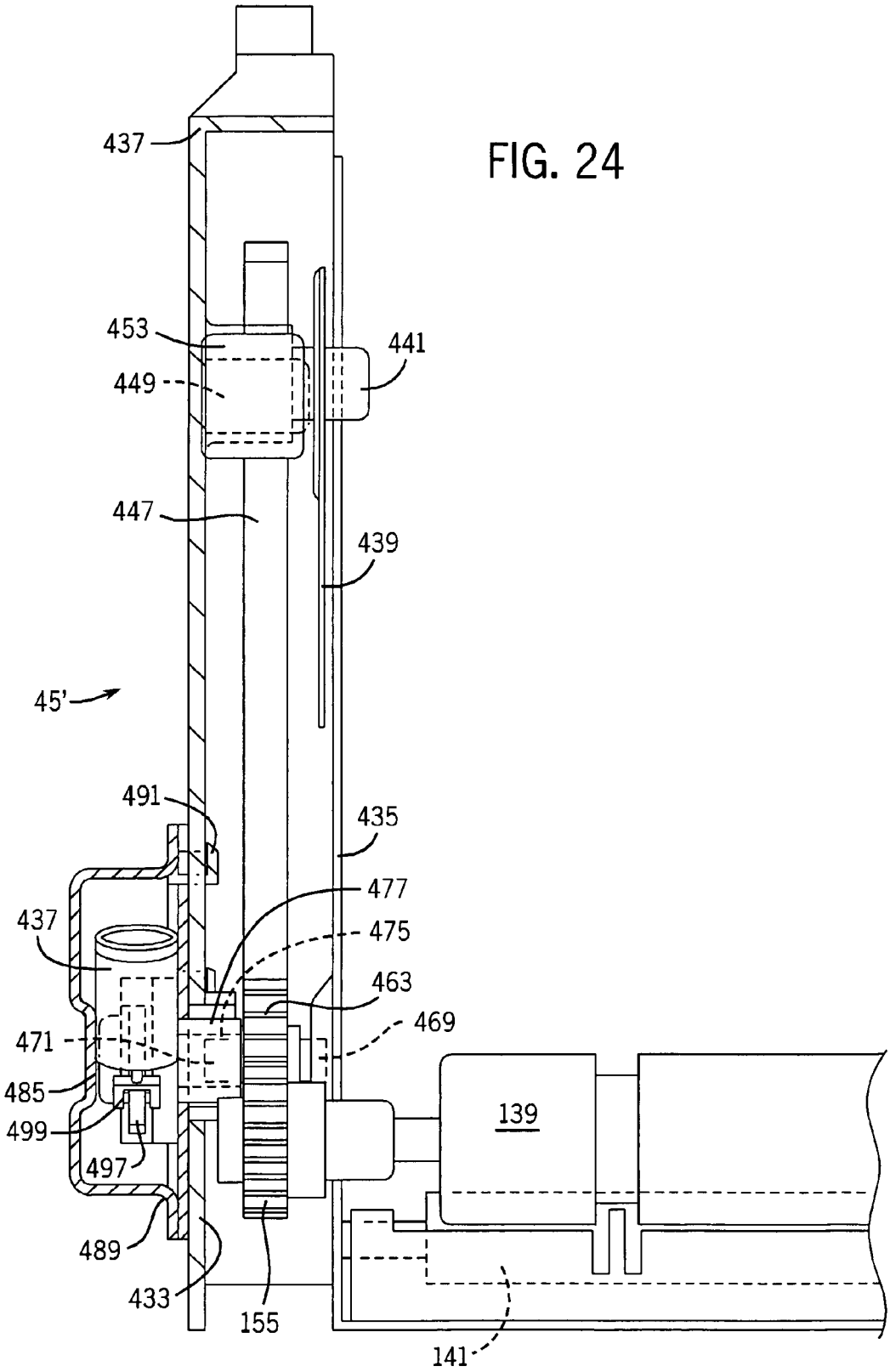
FIG. 24 is partial rear assembly view of the drive apparatus of FIG. 23.

In the drawings, sheet 19, Fig. 24, delete reference numeral "437" and replace with reference numeral --438--.

Figure 25:
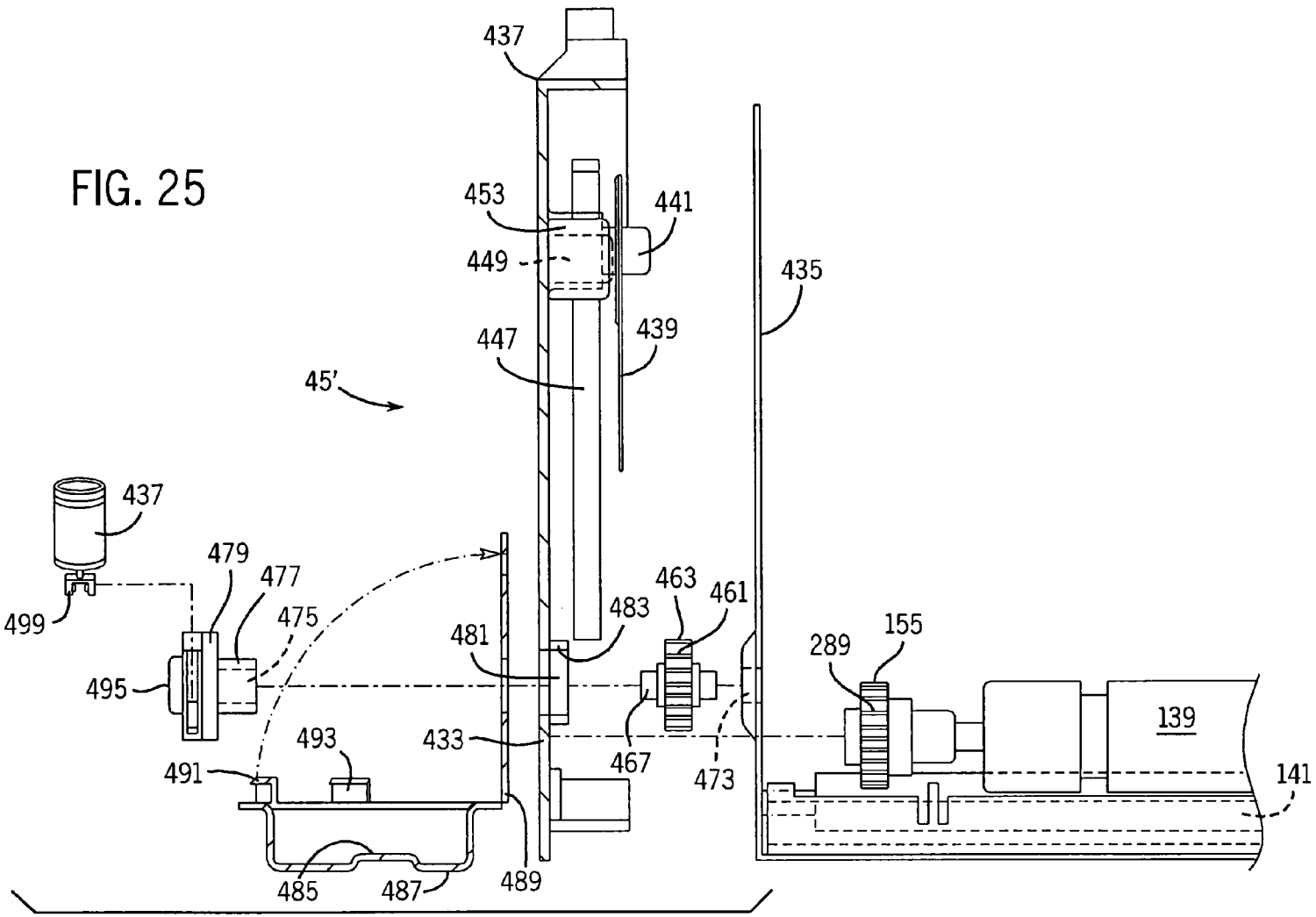
FIG. 25 is partial exploded view of the drive apparatus of FIG. 23.

In the drawings, sheet 20, Fig. 25, delete reference numeral "437" and replace with reference numeral --438--.

In the drawings, sheet 23, Fig. 29, delete reference numeral "357" and replace with reference numeral --347-- and extend the lead line. Add reference numerals --357-- (two occurrences), --361--, --369--, and --371--.

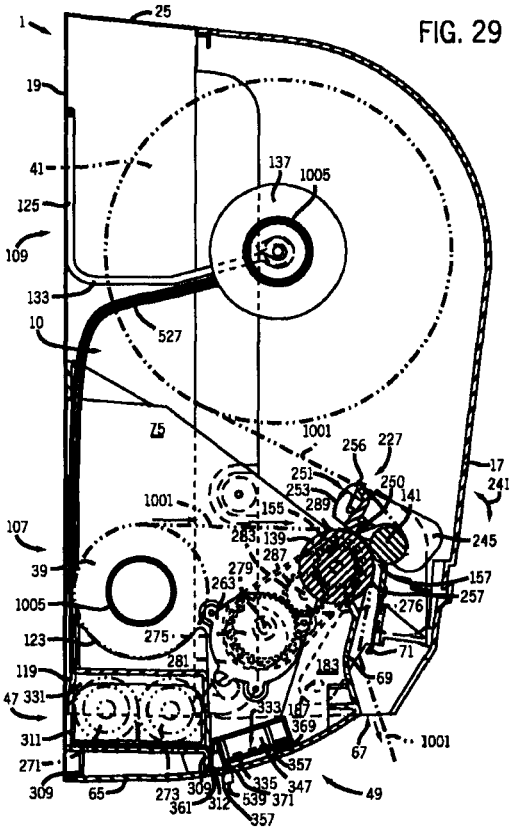
In column 12, line 58, delete “489” and insert --543--.
In column 13, line 16, after spaced along, delete “surface 423” and insert --segment 421--.
In column 13, line 27, after FIGS. 10-11 and, delete “17” and insert --18--.
In column 13, line 35, after FIGS., delete “31” and insert --32--.

In column 14, line 44, delete “437” and insert --438--.

In column 14, line 46, delete “437” and insert --438--.

In column 14, line 51, delete “437” and insert --438--.

In column 16, line 3, after 475, delete “in the direction of arrow 501”.

In column 16, lines 27-28, after 475, delete “in the direction of arrow 501”.

In column 16, line 30, delete “roller” and insert --gear--.

In column 16, line 33, delete “449” and insert --463--.

In column 16, line 42, delete “449” and insert --463--.

In column 16, line 43, delete “455” and insert --479--.

In column 17, line 25, delete “Tabs 310, 312” and insert --Tabs (one shown as 312 in FIGS. 29-30)--.

In column 20, line 7, after FIG., delete “26” and insert --29--.

In column 20, line 8, after FIGS., delete “26 and 27” and insert --17, 29 and 30--.

In column 20, line 60, delete “29” and insert --31--.

In column 26, line 1, delete “39” and insert --41--.

In column 26, line 2, delete “39” and insert --41--.

In column 26, line 25, delete “481” and insert --531--.

In column 26, line 33, delete “481” and insert --531--.

In column 26, line 40, delete “479” and insert --529--.

In column 26, line 65, delete “669” and insert --663--.

In column 27, line 28, after switch, delete “493” and insert --541--.

In column 27, line 31, delete “(FIG. 29)” and insert --(FIG. 31)--.

In column 27, line 35, delete “ambient”.

(12) United States Patent
Rodrian et al.

(10) Patent No.: US 7,040,566 B1
(45) Date of Patent: May 9, 2006

(54) DISPENSER WITH MATERIAL-RECOGNITION APPARATUS AND MATERIAL-RECOGNITION METHOD

(75) Inventors: James A. Rodrian, Grafton, WI (US); Lawrence R. Hansen, Green Bay, WI (US); Daniel C. Kananen, New Franken, WI (US); Alan P. Paal, New Franken, WI (US); Robert T. Buczkiewicz, West Bend, WI (US)

(73) Assignee: Alwin Manufacturing Co., Inc., Green Bay, WI (US)

( * ) Notice: Subject to any disclaimer, the term of this patent is extended or adjusted under 35 U.S.C. 154(b) by 93 days.

(21) Appl. No.: 10/408,970

(22) Filed: Apr. 8, 2003

(51) Int. Cl.
*B65H 43/00* (2006.01)

(52) U.S. Cl. ..... 242/563; 242/564.2

(58) Field of Classification Search ..... 242/564, 242/564.1, 564.2, 563; 312/34.22, 34.8; 235/462.01, 462.13, 454, 470
See application file for complete search history.

(56) References Cited

U.S. PATENT DOCUMENTS

| | | | | |
|---|---|---|---|---|
| 4,796,825 | A * | 1/1989 | Hawkins | 242/564 |
| 4,961,088 | A | 10/1990 | Gilliland et al. | |
| 5,452,033 | A | 9/1995 | Balling et al. | |
| 5,481,100 | A | 1/1996 | Terauchi | |
| 5,507,277 | A | 4/1996 | Rubsamen et al. | |
| 5,694,156 | A | 12/1997 | Hoisington et al. | |
| 5,772,291 | A * | 6/1998 | Byrd et al. | 312/34.22 |
| 5,829,434 | A | 11/1998 | Ambrosio et al. | |
| 5,832,972 | A | 11/1998 | Thomas et al. | |
| 5,940,103 | A | 8/1999 | Hetzer et al. | |
| 5,992,698 | A | 11/1999 | Copeland et al. | |
| 5,995,774 | A | 11/1999 | Applegate et al. | |
| 6,105,633 | A | 8/2000 | Pedersen et al. | |
| 6,109,480 | A | 8/2000 | Monsrud et al. | |
| 6,143,257 | A | 11/2000 | Spriggs et al. | |
| 6,158,486 | A | 12/2000 | Olson et al. | |
| 6,170,937 | B1 | 1/2001 | Childers et al. | |
| 6,209,184 | B1 | 4/2001 | Copeland et al. | |
| 6,250,530 | B1 | 6/2001 | LaCount et al. | |

(Continued)

FOREIGN PATENT DOCUMENTS

| | | |
|---|---|---|
| CA | 2328540 | 12/2000 |

(Continued)

*Primary Examiner*—William A. Rivera
(74) *Attorney, Agent, or Firm*—Jansson, Shupe, Munger & Antaramian, Ltd.

(57) ABSTRACT

Dispenser apparatus for dispensing flexible sheet material including material-recognition apparatus permitting the dispenser to recognize sheet material from an authorized source and to be enabled for operation with such material. The dispenser preferably includes standard mechanical components for dispensing sheet material from the dispenser including a housing, structure for supporting a roll of sheet material, drive and tension rollers forming a nip through which the sheet material is displaced as the drive roller rotates and drive apparatus in power-transmission relationship with the drive roller. The material-recognition apparatus includes a sensor mounted in the dispenser housing and in position to scan a code, preferably located on the core on which the sheet material is wound. The sensor generates a code signal corresponding to the code. A control circuit operatively connected to the sensor is adapted to receive the code signal and compare the code represented by said code signal to at least one code in a code database. The dispenser is placed in a dispenser-enabled state capable of dispensing sheet material corresponding to agreement between the codes and a dispenser-disabled state in which the dispenser is disabled when no such code agreement exists.

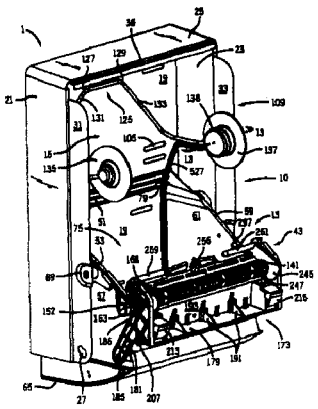

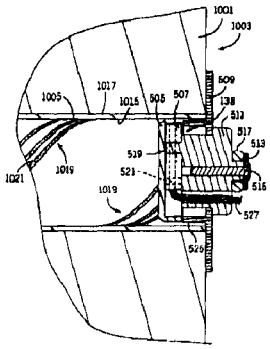

70 Claims, 33 Drawing Sheets